US008157710B2

(12) United States Patent
Gautier

(10) Patent No.: US 8,157,710 B2
(45) Date of Patent: Apr. 17, 2012

(54) MULTI-AXIS RESISTANCE EXERCISE DEVICES AND SYSTEMS

(76) Inventor: Kenneth Bryan Gautier, Senatobia, MS (US)

( * ) Notice: Subject to any disclaimer, the term of this patent is extended or adjusted under 35 U.S.C. 154(b) by 0 days.

(21) Appl. No.: 12/584,197

(22) Filed: Sep. 1, 2009

(65) Prior Publication Data

US 2010/0190617 A1 Jul. 29, 2010

Related U.S. Application Data

(63) Continuation-in-part of application No. 11/899,463, filed on Sep. 6, 2007, now Pat. No. 7,601,106, which is a continuation of application No. 10/758,870, filed on Jan. 16, 2004, now Pat. No. 7,341,546.

(60) Provisional application No. 60/441,708, filed on Jan. 21, 2003.

(51) Int. Cl.
*A63B 21/062* (2006.01)

(52) U.S. Cl. ..... 482/103; 482/99

(58) Field of Classification Search ..... 482/93–103, 482/133–138

See application file for complete search history.

(56) References Cited

U.S. PATENT DOCUMENTS

| | | | | |
|---|---|---|---|---|
| 5,018,725 | A * | 5/1991 | Cook | 482/103 |
| 5,102,122 | A * | 4/1992 | Piane et al. | 482/133 |
| 6,165,110 | A * | 12/2000 | Gajda | 482/102 |
| 6,685,600 | B1 * | 2/2004 | Ullman | 482/103 |
| 6,705,976 | B1 * | 3/2004 | Piane, Jr. | 482/103 |
| 7,056,224 | B1 * | 6/2006 | Keyes | 473/257 |
| 7,159,875 | B2 * | 1/2007 | Seymour | 280/14.21 |
| 7,341,546 | B2 * | 3/2008 | Gautier | 482/103 |
| 2003/0027694 | A1 * | 2/2003 | Harrison | 482/94 |

* cited by examiner

*Primary Examiner* — Fenn Mathew
(74) *Attorney, Agent, or Firm* — Steven R. Scott

(57) ABSTRACT

This is an exercise apparatus and system charactered generally by the presence of a user interface member haying a point of attachment to the apparatus that is posttionable at different locations along an arcuate path determined, dicated and/or supported/braced bv an arcuate guide The central axis of the arcuate oath mav intersect the ball joint of a user. The arcuate oath and the arcuate guide mav lie in spaced substantially parallel planes and the user interface member be one of a rigid arm with a handio or forearm interface, or a flexible member with a froo handle at its end forming the user interface. A flexible linkage forms pan of the operative connection betwoen the user interface and a weight stack or other apparatus providing adjustable resistance, with the flexible linkage being reeved through a centering cuiley proximate the central axis of the arcuate member.

16 Claims, 87 Drawing Sheets

Axes of Shoulder Motion

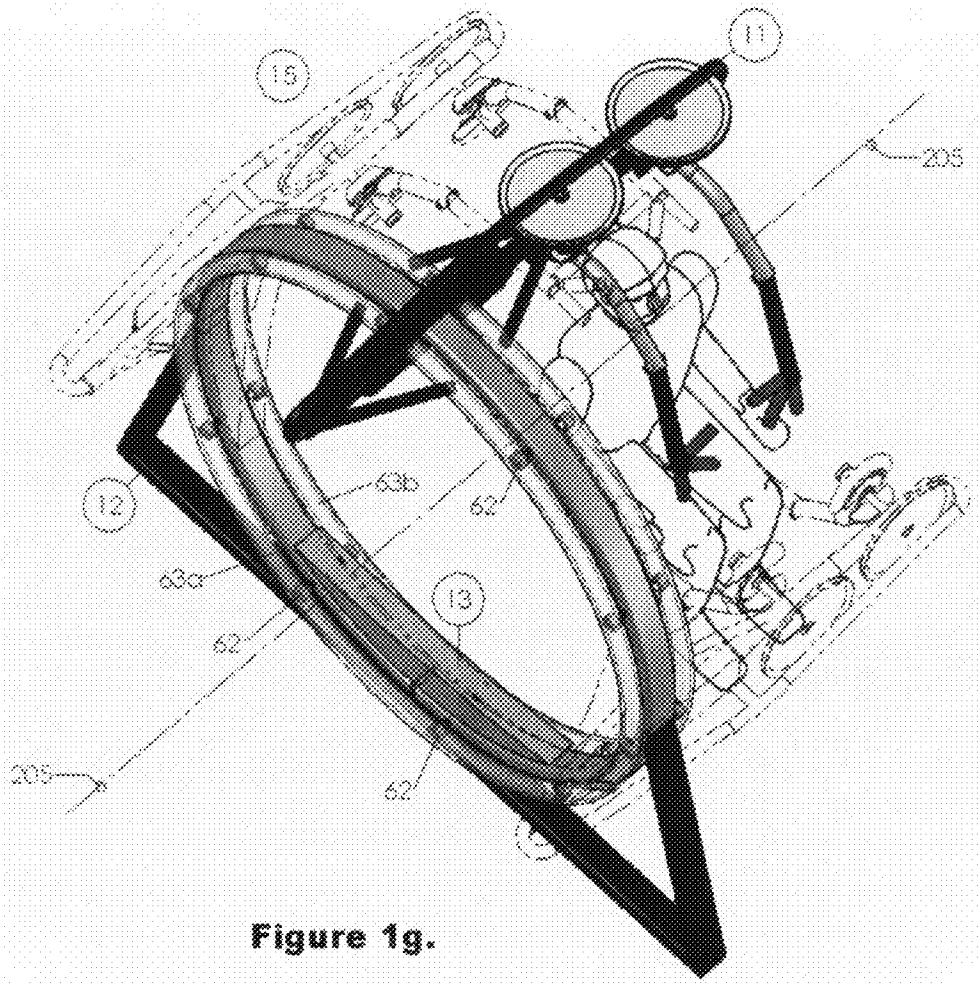
205
11
19
19
19

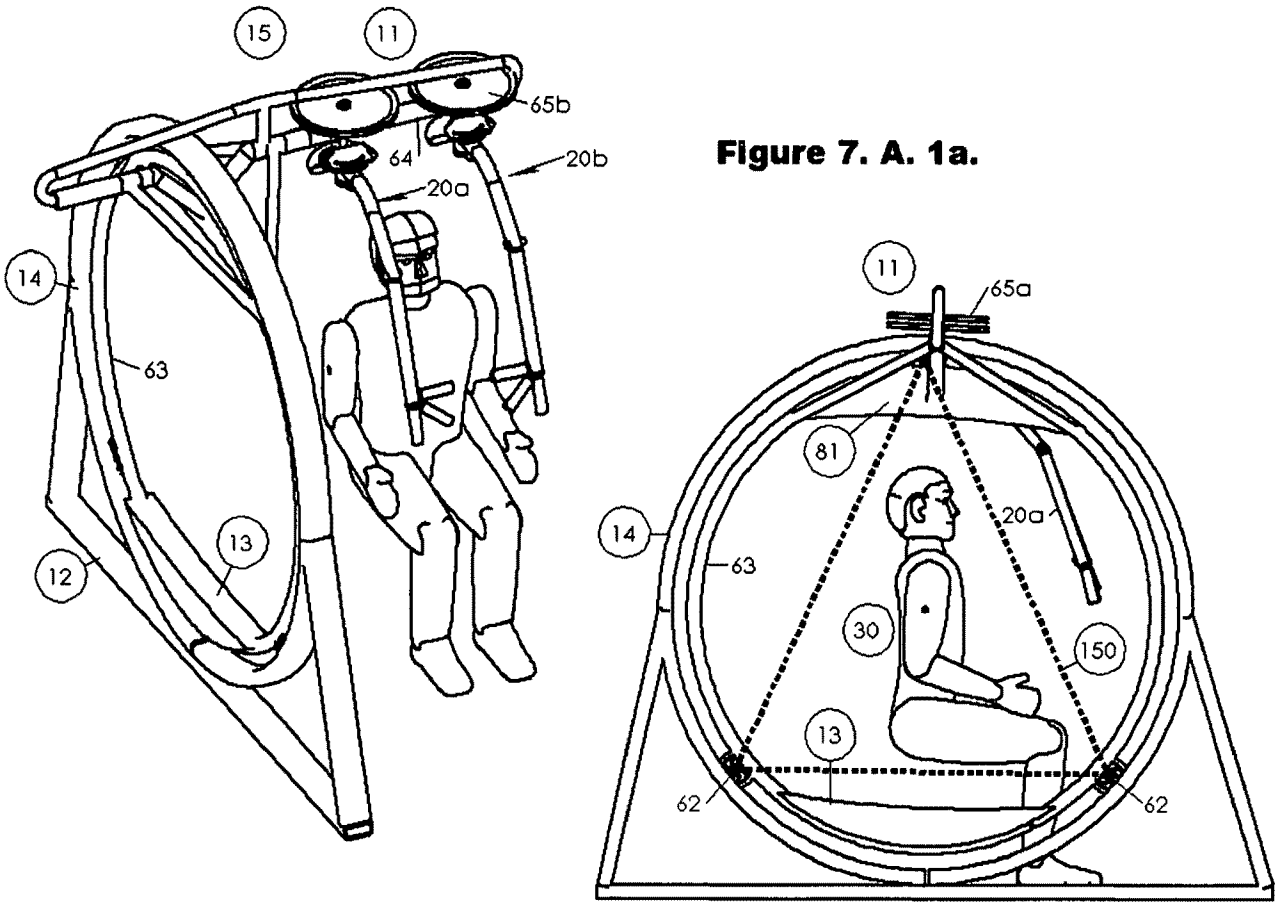
Figure 7. A. 1a.

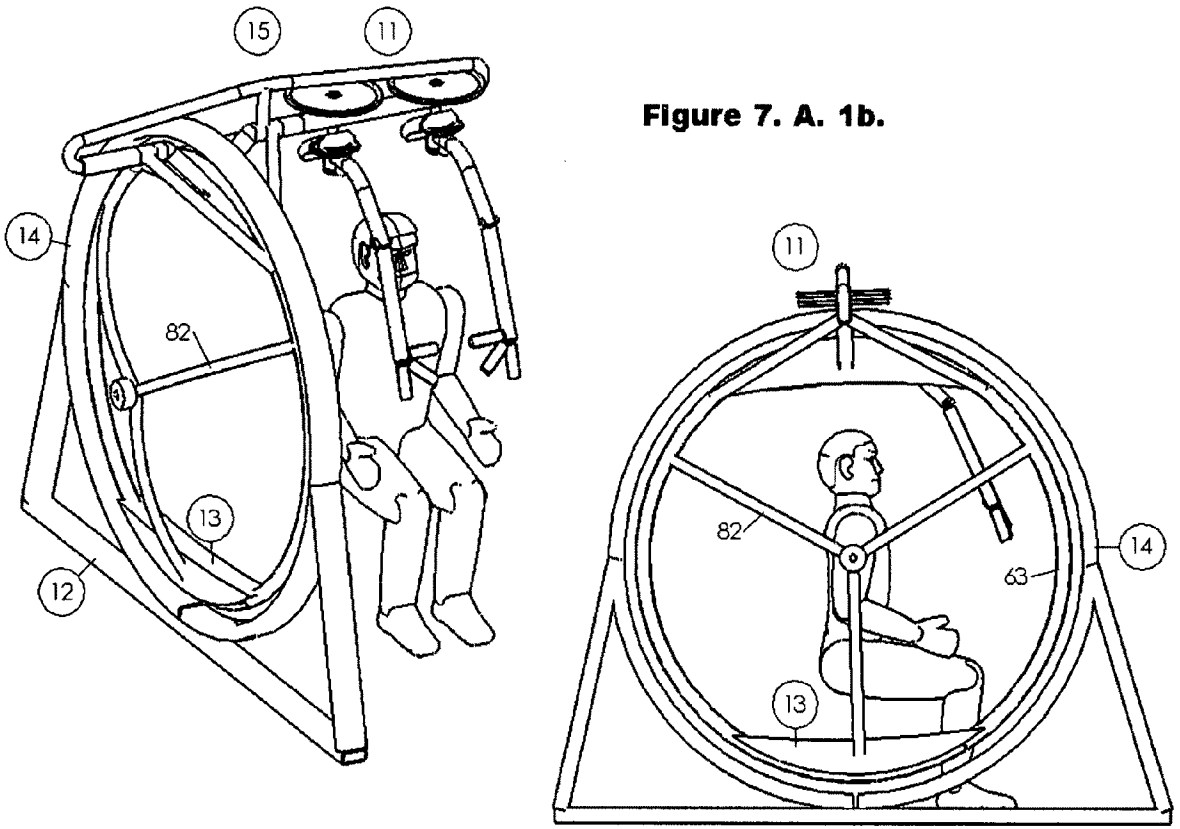
Figure 7. A. 1b.

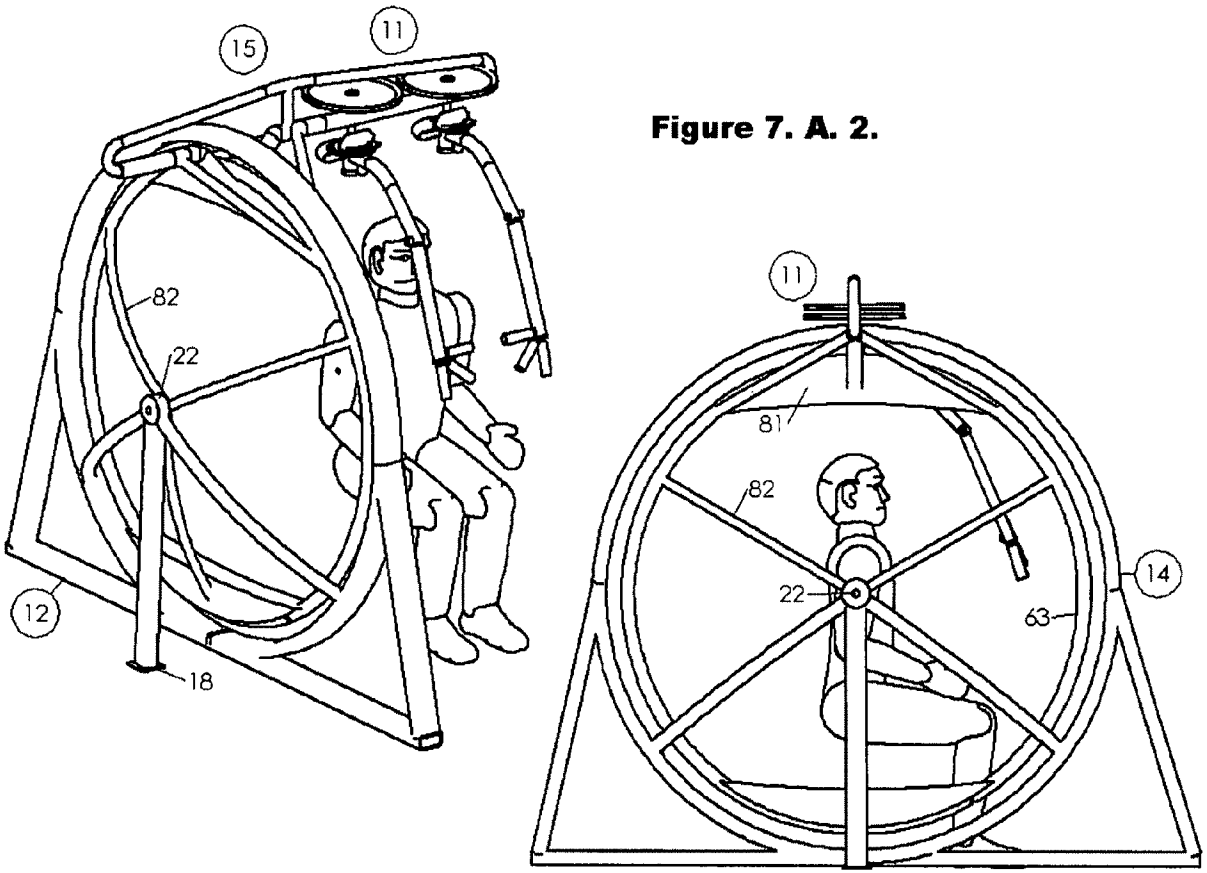
Figure 7. A. 2.

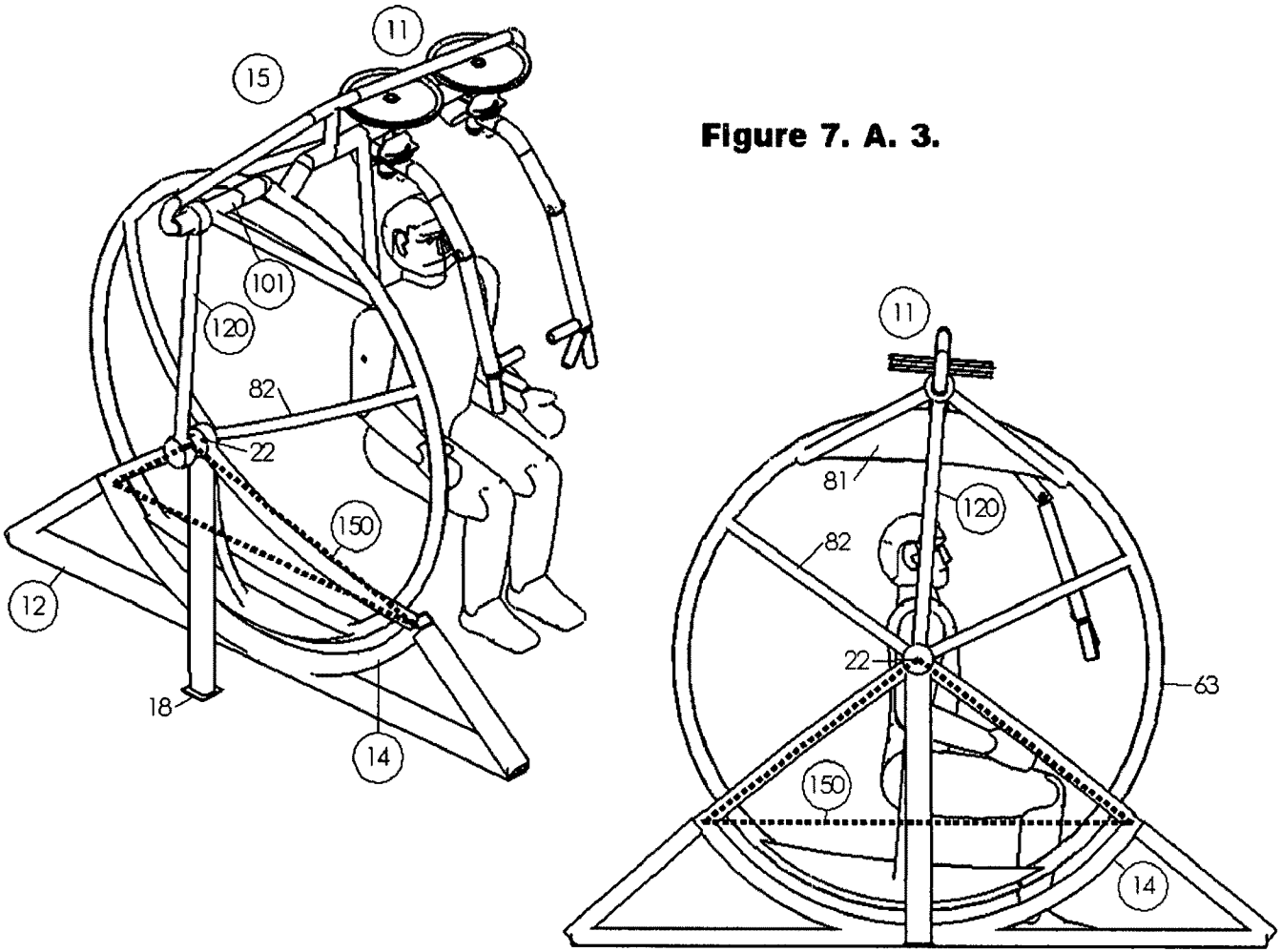
Figure 7. A. 3.

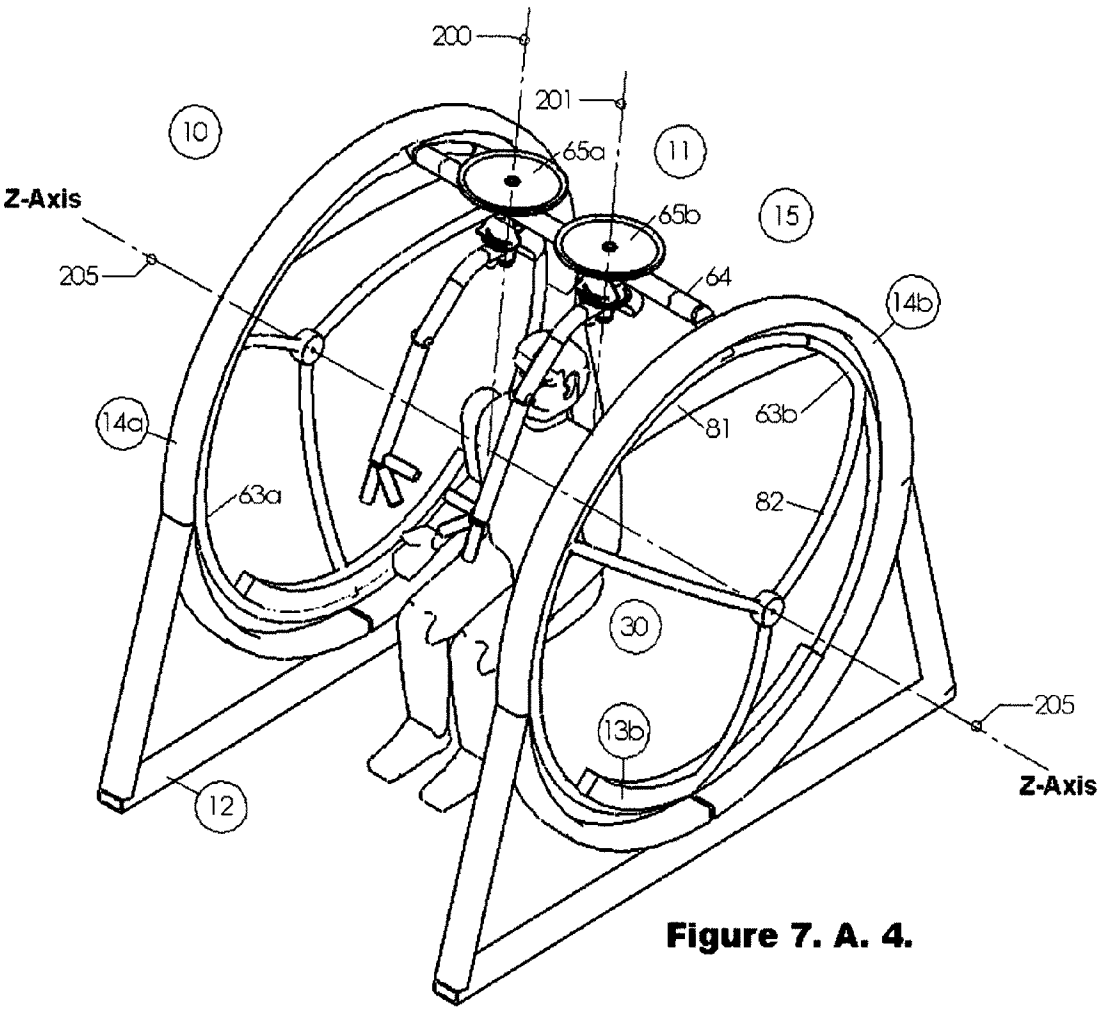
Figure 7. A. 4.

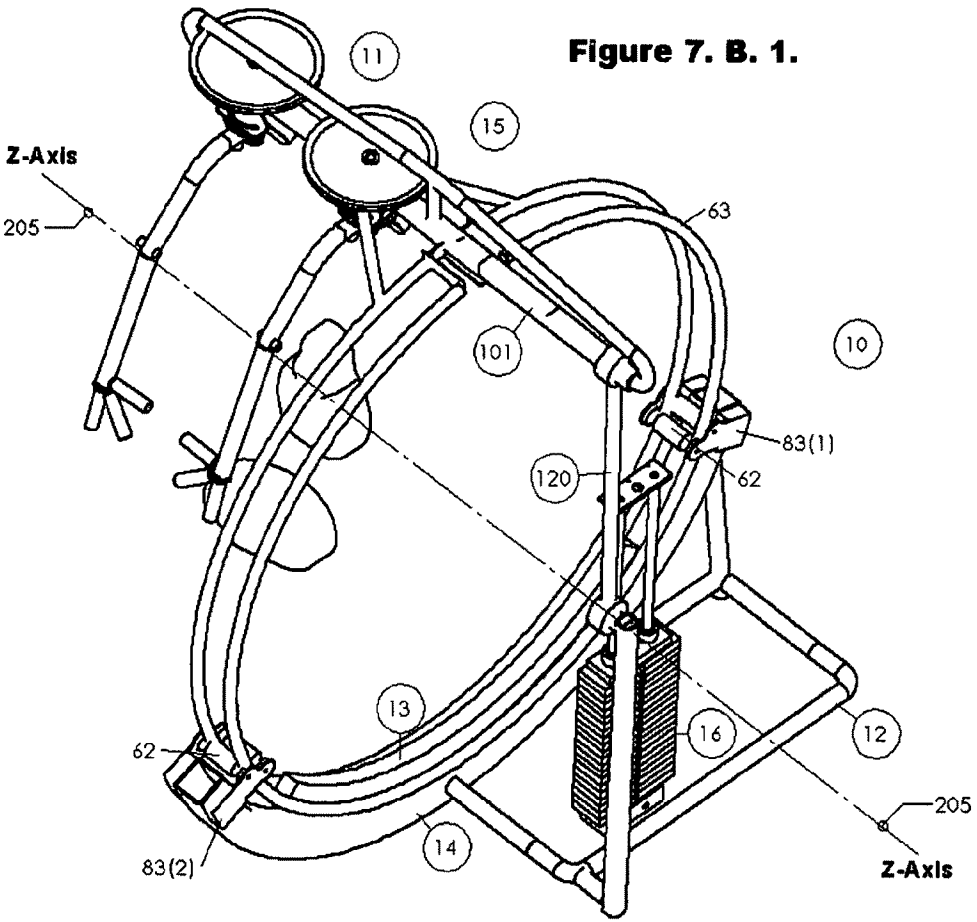
Figure 7. B. 1.

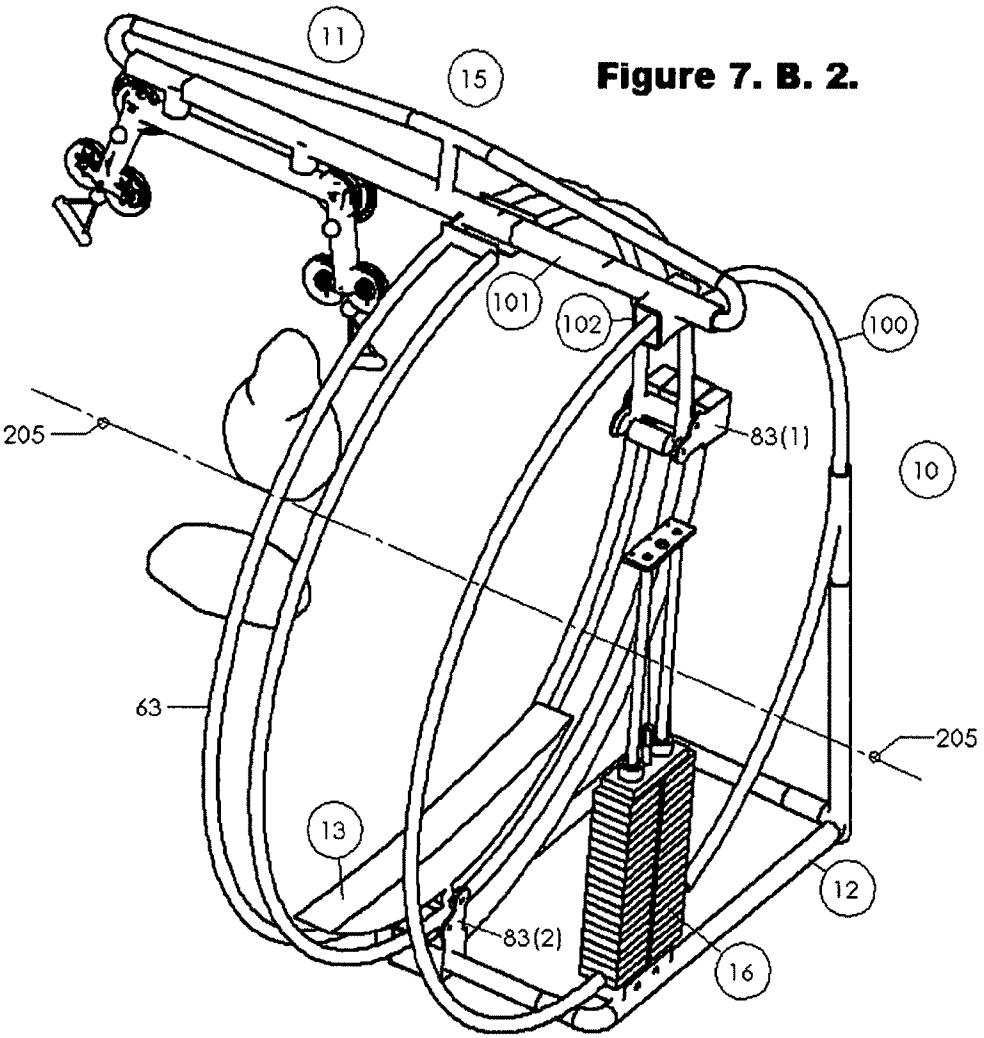
Figure 7. B. 2.

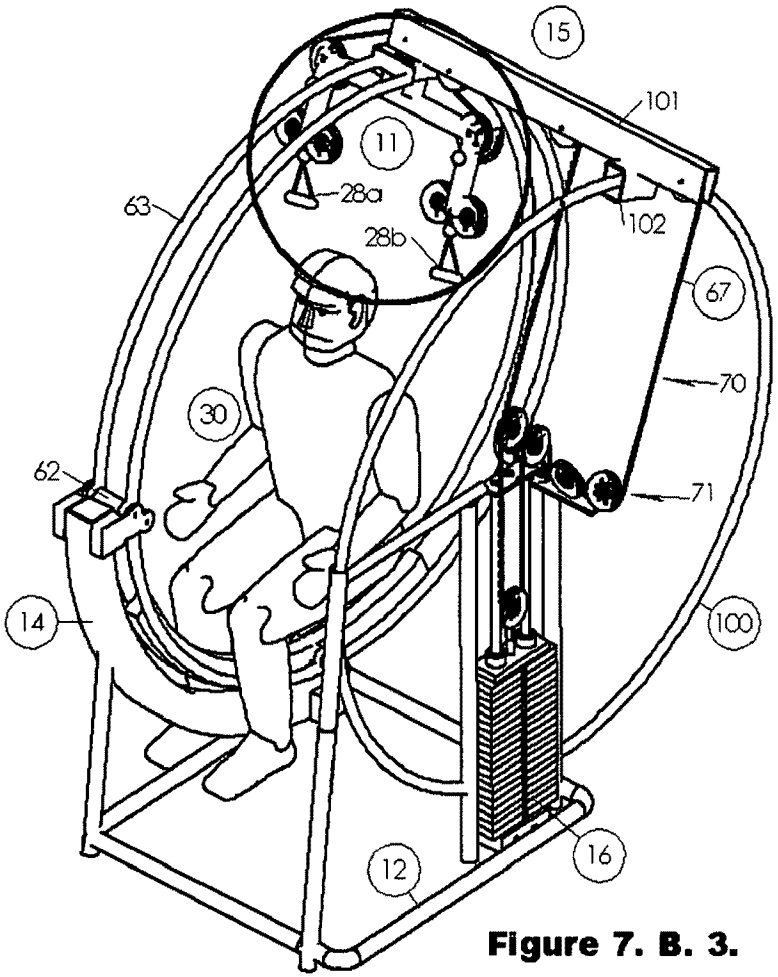
Figure 7. B. 3.

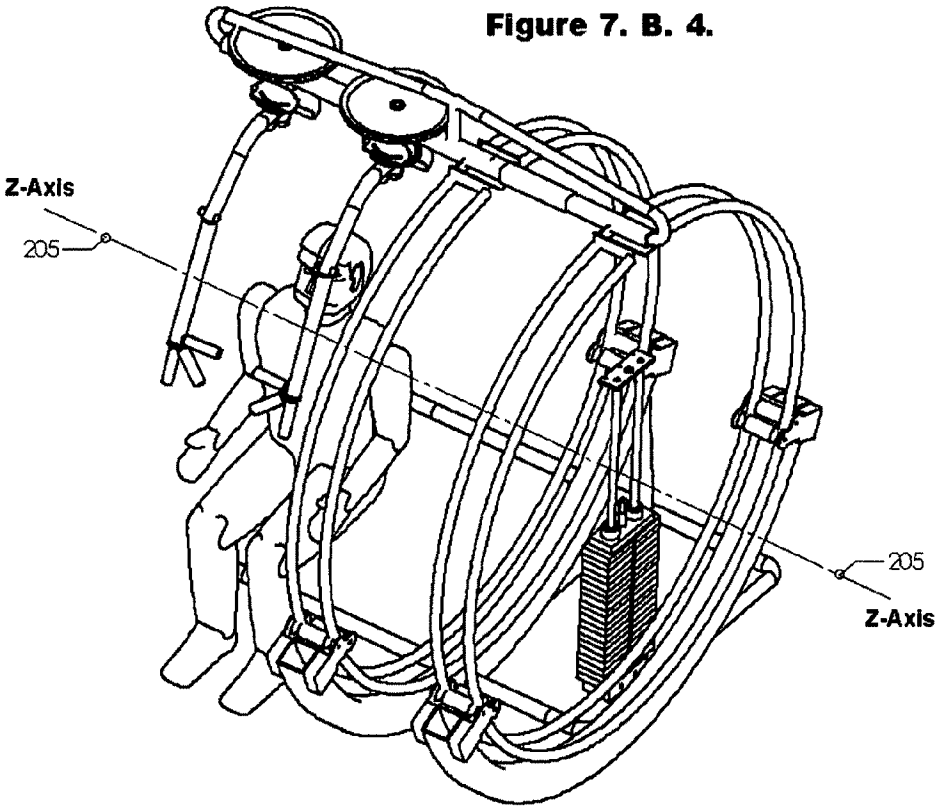
Figure 7. B. 4.

Decagon Roller Pattern (155)

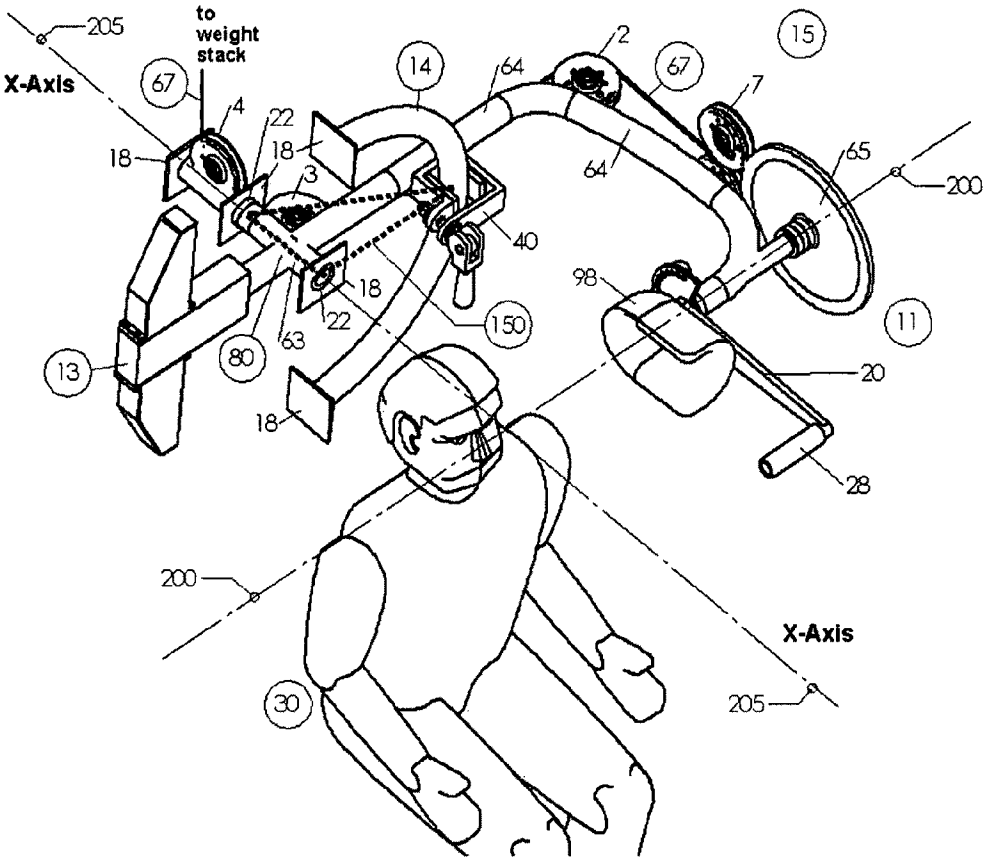
Figure 14. A. 1.

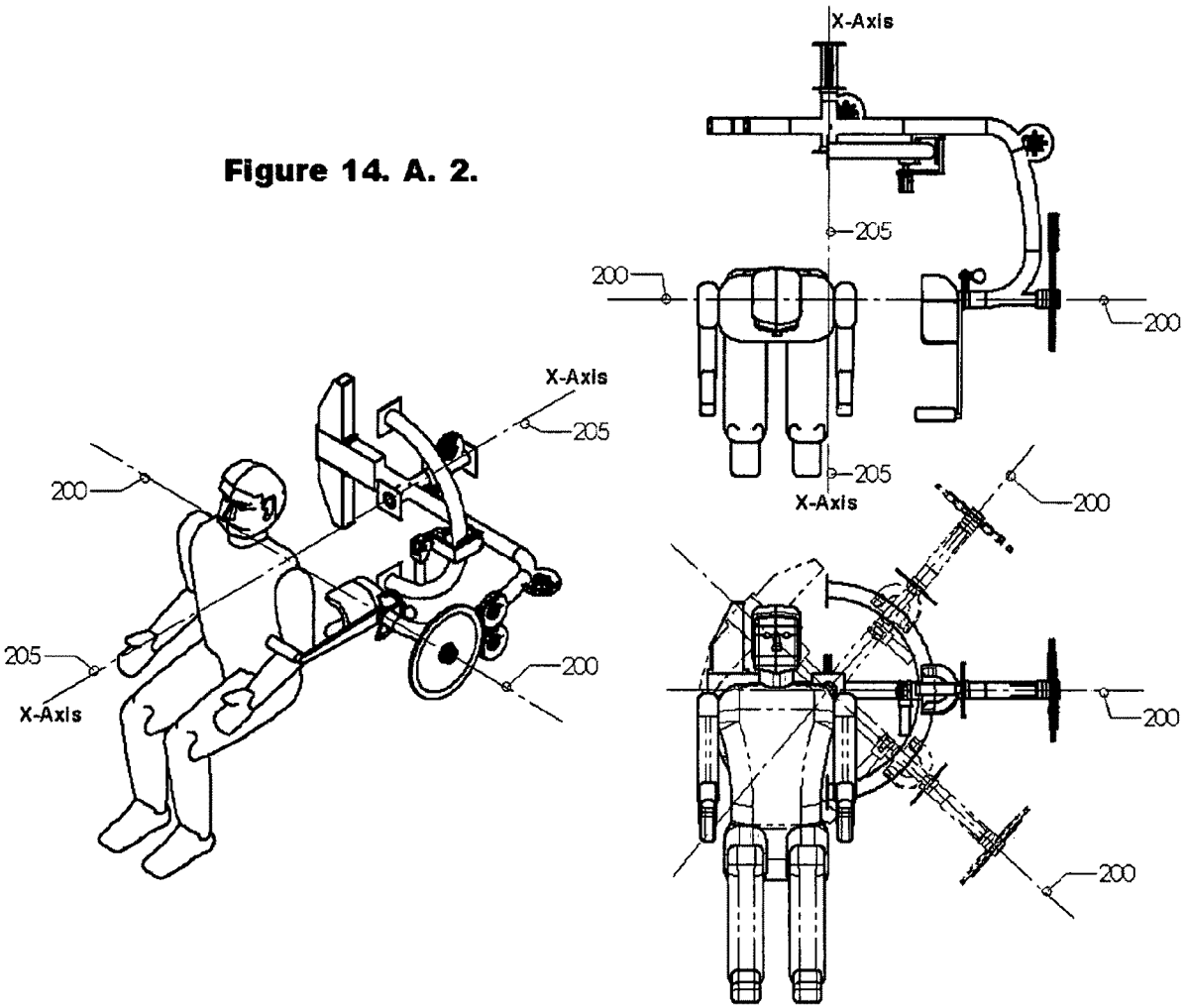
Figure 14. A. 2.

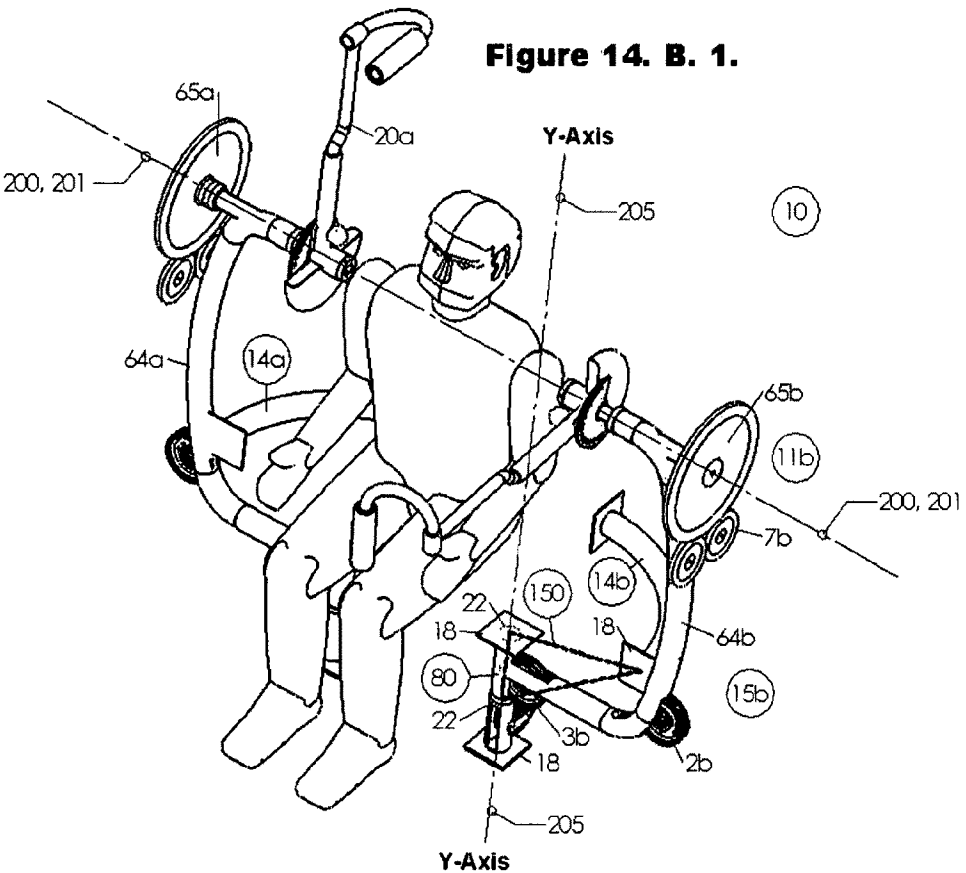
Figure 14. B. 1.

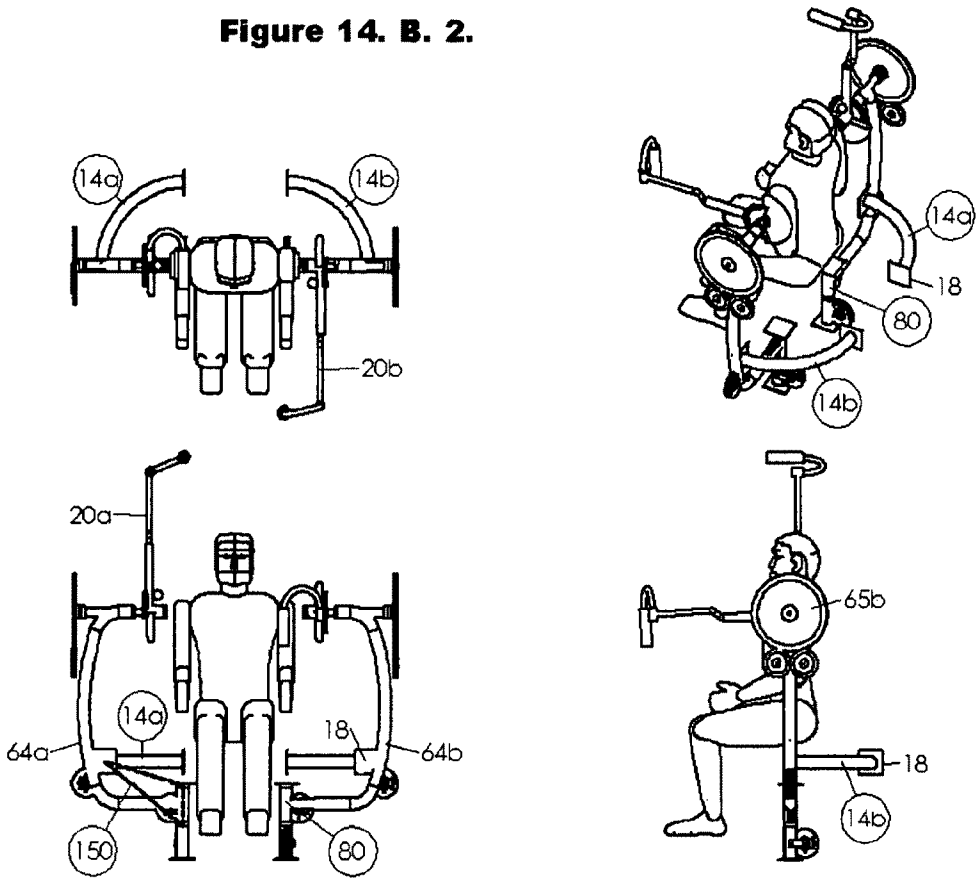
Figure 14. B. 2.

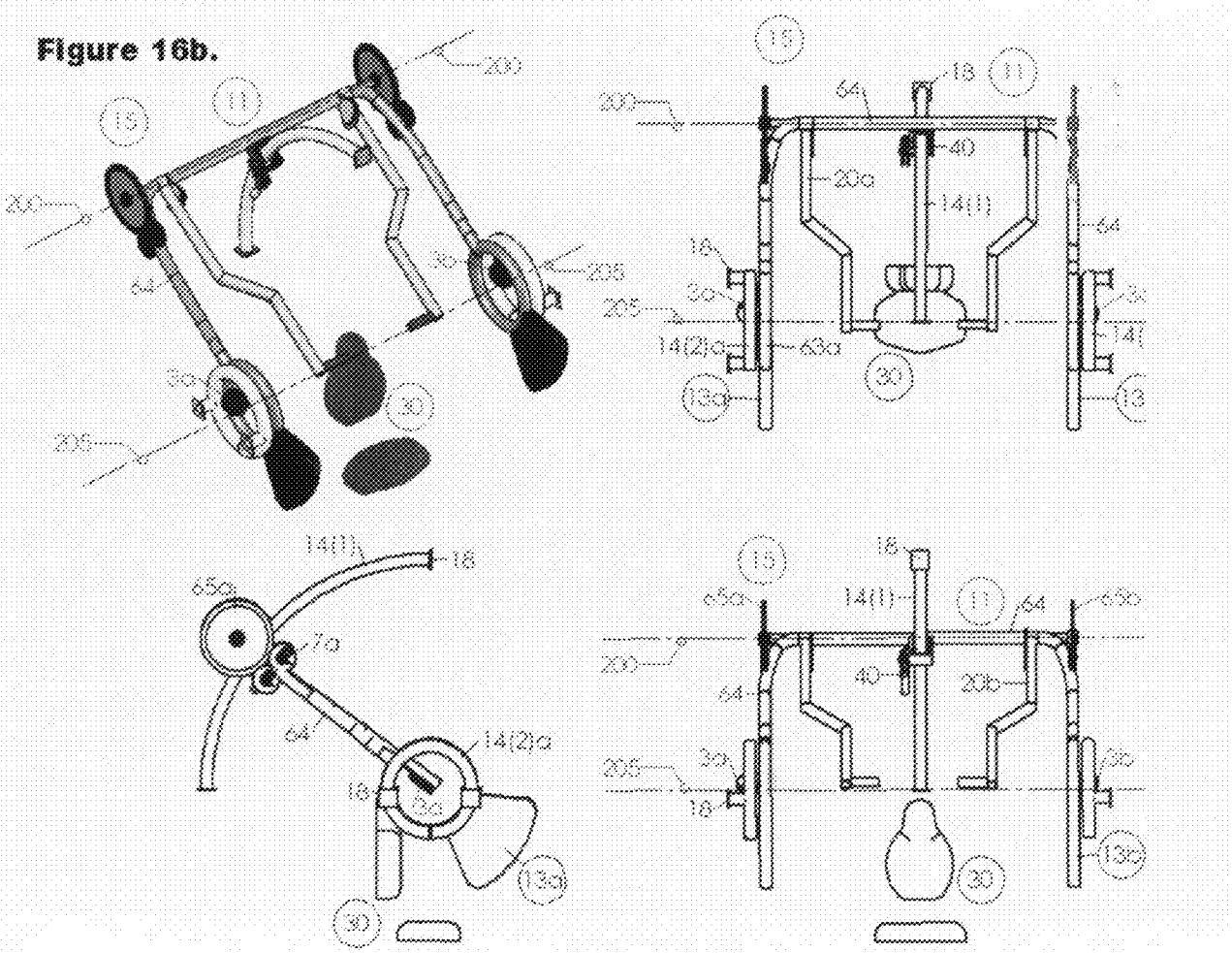
200
202
204
206
208
14
18
49
1411
1412a
1411a
70
74
50
52
54
56
58
60
62
64
66
68
70
72
74
76
78
80
82
84
86
88
90
92
94
96
98
100
102
104
106
108
110
112
114
116
118
120
122
124
126
128

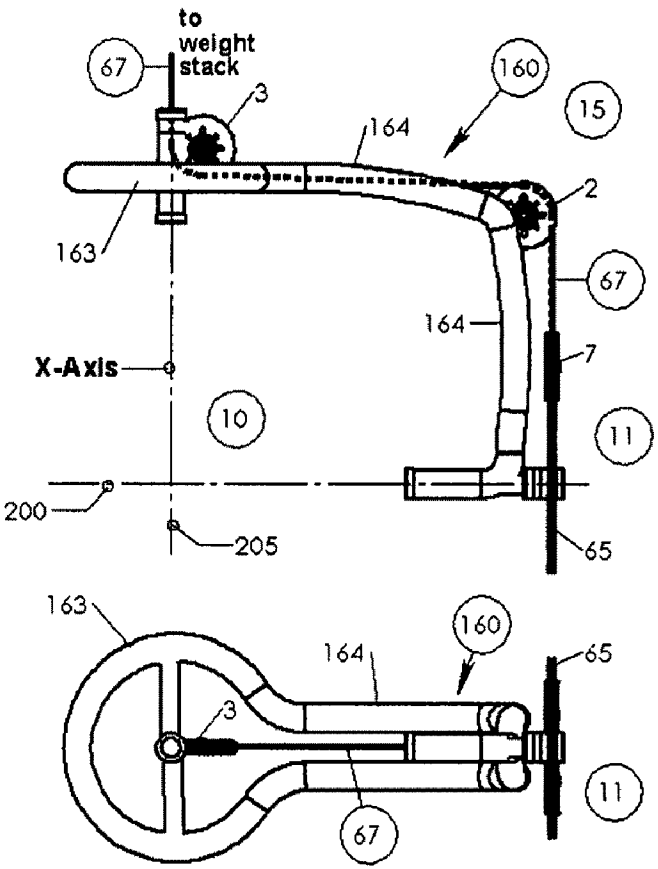
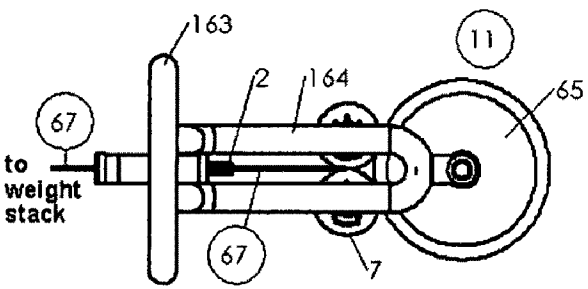
Figure 18h.

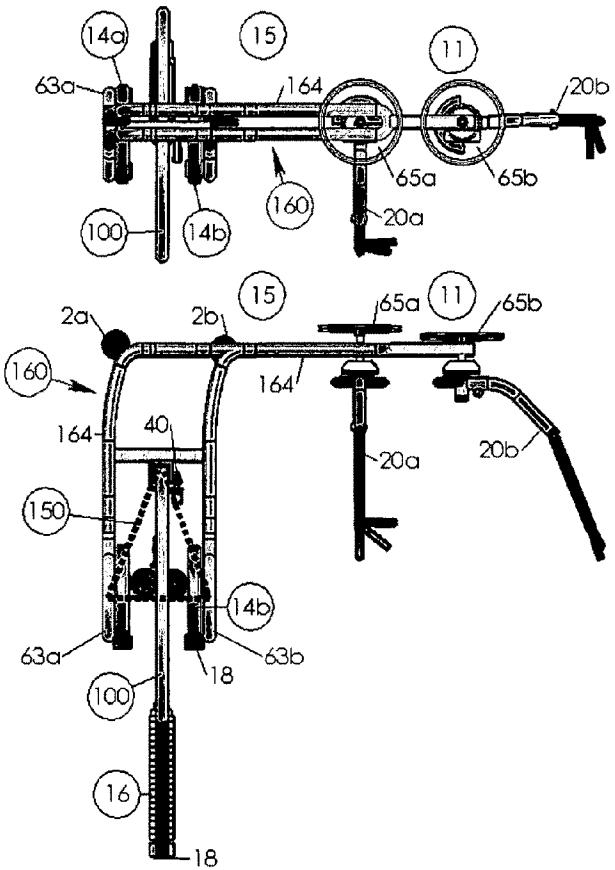
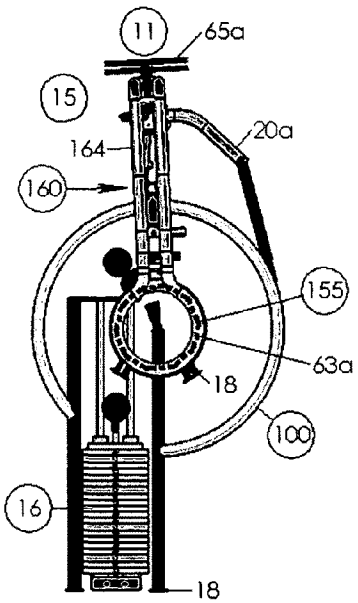
Figure 19d.

MULTI-AXIS RESISTANCE EXERCISE DEVICES AND SYSTEMS

CROSS-REFERENCE TO RELATED APPLICATIONS

This continuation-in-part application is based on and claims priority through my non-provisional continuing application titled "Multi-Axis Resistance Exercise Device" (Ser. No. 11/899,463), now U.S. Pat. No. 7,601,106, filed Sep. 6, 2007, which said continuing application was based on and claims priority through my non-provisional application titled "Multi-Axis Resistance Exercise Device" (Ser. No. 10/758,870), now U.S. Pat. No. 7,341,546, filed Jan. 16, 2004, which said non-provisional application and patent was based on and claimed priority to my provisional application titled "Multi-Axis Resistance Exercise Device" (Ser. No. 60/441,708), filed Jan. 21, 2003, the full disclosures of which are incorporated herein by reference.

BACKGROUND AND SUMMARY

This invention is generally related to exercise devices for muscles surrounding the ball-and-socket joints (or ball joints) of a user, and more particularly, to weight resistance exercise machines for the muscles surrounding the shoulder joints of a user.

The shoulder is the most mobile joint in the human body, with 360 degrees of motion in circumduction, and 180 degrees of motion in all simple radial planes of movement of the joint. The three dimensional range of movement of the shoulder can be mapped as a virtual hemisphere, centered at the glenohumeral joint.

The remarkable range of motion of the shoulder is made possible by minimal static stabilization of the joint. The static stabilizers include bone and non-elastic capsuloligamentous structures. Since the joint capsule and ligaments surrounding the joint are redundant in length, they provide restraint and stability only at wide ranges of motion. The bone structure of the shoulder joint consists of the head of the humerus which glides or rolls in the narrow and shallow glenoid fossa of the scapula. The stability of the glenohumeral or shoulder joint is comparable to the stability of a golf ball (i.e. the humeral head) resting on a golf tee (i.e. the glenoid process).

The biomechanical tradeoff for the tremendous range of motion of the shoulder is minimal static stability. So the shoulder is the most mobile joint, and mutually, it is the least stable joint in the human body as well.

Enhanced dynamic stability, provided by the surrounding musculature (i.e. the dynamic stabilizers), compensates for minimal static stability in the shoulder. From the side view, with the humerus at 90 degrees of abduction, we see a 360 degree radial array of muscles and muscle fibers originating on the trunk, scapula, and clavicle, spanning the shoulder complex, converging and inserting circumferentially into the proximal humerus. Each radial plane of muscle fibers can be recruited to move the shoulder in the coplanar plane of motion. This radial array of muscle fibers about the shoulder also provides coordinated stabilizing radial traction forces throughout the range of motion, in any or all directions simultaneously, for maintaining optimal dynamic alignment of the joint. Therefore, the 360 degree radial array of muscle fibers surrounding the shoulder is the basis for both movement in all radial planes of motion, and for stabilization of the joint in any direction, position, plane, or part of its range of motion. The unique and extensive reliance on radial musculature for 360-degree-motion and stability means that strength training has the potential to provide more effective performance enhancement to the shoulder than any other joint.

The musculature and nervous system respond to training with specific adaptation to specific imposed demand. Training in any specific plane of motion stimulates an increase in strength, stability, and therefore performance in that specific plane of training, with little enhancement of performance in other planes of musculature and motion.

Therefore, in order to optimize strength and stability in multiple planes of motion, the shoulder must be strength trained in multiple planes of movement. For ideal performance gains, for optimal restoration of function after injury, and for maximum protection from instability, the shoulder should be trained in an exponential number of planes of motion throughout its 360 degree radial array of planes of motion about multiple axes.

Six out of ten strength training machines target the shoulder because of the many planes of resisted motion that must be implemented for adequate shoulder training and injury rehabilitation. Theoretically, one should be able to exercise the muscle fibers in every conceivable plane of shoulder motion. However, exercise machines of the past, including the most sophisticated rehabilitation and strength testing devices, have never been capable of practically reproducing the remarkable number of planes of motion of the shoulder. In fact, most shoulder exercise machines are manufactured to build strength in only one or a few standard planes of motion.

Since most prior art strength training machines (and lines of machines) permit exercise in only one or a few planes of motion, specific adaptation (i.e. enhanced strength and stability) occurs only in the same limited number of planes. On past shoulder strength training equipment, the angular distances are large between the conventional, standard radial planes of training. This means performance carryover between these planes of training is minimal. When training is limited to these few conventional planes of exercise, over-training of the musculature occurs in the conventional planes of resistance exercise, and under-training occurs in planes oblique to the conventional planes of exercise. In this way, repetitive training in a limited number of fixed planes of resistance by the prior art paradigm, builds asymmetric strength in the musculature surrounding the shoulder. Asymmetric strength predisposes the joint to instability and injury.

Consequently, training with past equipment leaves the shoulder with less than optimal strength and stability gains, and vulnerable to injury. The limited number of planes of resistance provided by the prior art is a reflection of the unwritten (and erroneous) prior art paradigm that resistance exercise performed through a few standard planes of motion is adequate for building optimal multi-planar strength and stability in the shoulder.

Past exercise machines and equipment, though prolific, employ similar past methods of strength training and assessment. For the purpose of this discussion, the four most important strength training and assessment modalities in use today are: (1) free weights; (2) electromechanical strength training and assessment devices; (3) fulcrum-flexible-linkage strength training machines; and (4) cable functional strength training machines.

Free weights are one of the oldest and simplest tools for strength training and assessment. Free weights are most effective when lifted vertically in a straight line or plane, particularly in compound joint movement. As with all modes of exercise, free weights have limitations. A misconception in the industry is that free weights provide a more functional form of resistance than machines. For example, studies have noted kinetic and kinematic similarities between certain ballistic free weight lifting techniques and sprinting-jumping activities. But utilizing these strength training techniques has not been shown to directly improve functional performance of similar and dissimilar athletic movements in controlled longitudinal studies any more effectively than conventional techniques. The reason for this is that training has very specific effects. Strength training builds strength only in the specific plane and speed of motion of training. And because strength training does not precisely replicate functional, complex multi-planar movement (e.g. skilled athletic movements), it cannot directly enhance performance of functional, complex multi-planar movement.

Shoulder press exercises with free weights, as another example, do not closely simulate any true functional movement, skill, or ballistic motion; nor do free weights closely simulate dynamically varying forces encountered in the real world, any more so than when performing press exercises with other modes of resistance training. So there is little or no greater direct effect on performance when shoulder resistance exercise is performed with free weights as opposed to machines.

In critical comparison to training with presently available machines, training an individual in the skills of lifting free weights has only marginal (if any) added effect on functional performance enhancement for the vast majority of real-world skilled, precision, ballistic, impact, and/or high-performance movements.

Further, in terms of strength assessment, past standard methods do not provide comprehensive physiologic, multi-plane strength data. For example, the standard measure of upper body strength, especially in power sports, has long been the standard horizontal chest or bench press utilizing free weights. (In practice, this frequently results in a misplaced emphasis on building strength in a single plane of motion as the primary goal of shoulder strength training.) Although it is an expedient way of measuring overall strength in a single plane of movement, the bench press does not accurately measure functional strength or stability. A more accurate way to measure overall functional strength and functional stability of the shoulder is to assess strength in multiple planes of radial motion. But there are few strength assessment devices specifically designed for assessing radial strength of the shoulder in multiple planes.

Strength testing devices manufactured today are designed by the model originally established by Cybex, Biodex, and Chattecx active dynamometers, brand names well-known in the strength training and injury rehabilitation industry. These are electromechanical strength training and assessment devices with microcomputer-based feedback and strength evaluation systems. These machines were originally designed to assess knee strength and angular motion in a single plane of movement. Although these machines can be adapted to assess shoulder strength, like free weights, they are not practical tools for assessing strength in multiple planes of motion.

Machines that employ fulcrum-flexible-linkage resistance mechanisms (such as Nautilus and Cybex International machines) provide full and equal tangential resistance through the full arc and range of motion in the plane of exercise. This makes these machines significantly more effective than free weights for isolated resistance training (such as biceps curls), or for any exercise involving an arc of movement. This type of machine can provide isotonic or dynamic variable resistance exercise (e.g. with variable cammed pulleys). These are proven-effective strength building resistance mechanisms and are advantages that free weights cannot provide in an arc of exercise. The major disadvantage of past conventional fulcrum-flexible-linkage machines is that they cannot provide resistance exercise in more than one or a few planes of motion, as discussed previously.

A well-known exercise method called functional training is intended to enhance strength in functional and athletic movements. Cable linkage functional training is performed with machines utilizing an unconstrained user interface (i.e. handhold) directly attached to the end of a weighted flexible linkage or cable. These devices are also called free cable devices, and are descendents of the well-known cable-cross or cable-column type apparatus. Cable functional training equipment (such as that manufactured by Free Motion Fitness and others) operates in a similar manner to past cable strength training equipment, and therefore, is subject to the same limitations. Because of the mechanics of the handhold-cable-pulley mechanism utilized in these machines, cable-cross and free cable functional training cannot provide full and equal tangential resistance through a full arc of motion of exercise, as can fulcrum-flexible-linkage machines. Additionally, past cable machines cannot provide precise alignment and stabilization of the trunk and shoulder in an exponential number of planes of exercise (for precise, reliable targeting and isolation of the exponential planes of muscle action across the joint).

There is disagreement about the influence that any and all forms of strength training may have on injury prevention, specific skills, and sports performance. Most in the industry agree that strength training indirectly improves performance by enhancing joint strength and stability. The idea that strength training can directly enhance actual functional performance is controversial at best.

Generally, strength and stability gains from resistance training do not directly enhance performance. The strength and stability gains resulting from resistance training must be transferred indirectly to functional movement through the process of integration. Integration can be conceptualized as the process of transferring strength, proprioception, muscular coordination, and stability gains from simple, less functional movements, to more complex movements. Pattern integration can also be described as the transfer of enhanced simple pattern neuromuscular function (e.g. as a result of resistance training) into more complex purposeful movement patterns resulting in true functional performance enhancement.

Training in multiple, simple, radial neuromuscular patterns and planes of motion about a joint increases strength and stability more effectively than training in a few fixed planes provided by the prior art. The advantage of resistance training in simple patterns and planes of motion is that the resulting neuromuscular gains are easily integrated indirectly into functional movement, with little or no adverse effect on performance.

It is unlikely that one can directly improve athletic performance by replicating a complex athletic movement using free weights or cable functional training machines. Because the plane of resistance provided by these modes of exercise cannot coincide precisely with that of any real-world skill or sport movement, and because the resistance vector cannot replicate the full and equal tangential resistance or velocity throughout the full functional arc and range of motion, this equipment has limited positive direct effect on performance. Functional and athletic motion is largely too variable, complex, and/or unpredictable for machines or any resistance training method to duplicate, including free weights and cable machines. If the combined dynamic training variables of a complex strength training movement do not exactly replicate the actual movement, the training may even be counter-productive in terms of performance enhancement. This may be secondary to interference with established complex neural patterns of movement. Attempting to replicate a particular complex functional motion with strength training does not result in a direct improvement in performance because of the specificity and complexity of the neuromuscular mechanism of movement and the mechanical limitations of strength training equipment. Thus, there is a clear need for strength training and strength testing equipment that provides resisted motion in the 360 degree radial array of simple planes of motion of the shoulder and other joints about multiple axes, as provided by the present invention.

The present invention provides important advantages over the prior art. First, this invention provides radial, exponential multiplane resistance exercise for both compound and isolated resisted motion of the shoulders or other joints of a user. Resistance exercise can be performed in all planes of the 360 degree radial array of planes of motion of a joint about multiple axes. Second, it can provide full and equal tangential resistance through the full arc and range of motion of exercise. Third, the present invention provides independent user interfaces for simulating functional movement. Fourth, the invention provides industry standard selectorized, electromechanical, and/or other resistance mechanisms or combinations of mechanisms. Fifth, it provides multiple-point or polygonal stabilization and restraint (e.g. triangular, rectangular, decagonal, and/or circular base of stabilization) of the boom and drive assembly, thereby providing multiple-point stabilization for the axis of rotation of the user interface(s) which pivot on the drive assembly. This provides a very stable platform through which symmetric and asymmetric forces generated by the user are transferred. Sixth, the present invention provides a new evidence-based paradigm for the use of this line of devices that includes a method for performing exercise in an exponential number of planes of motion, as well as a method for the transfer or integration of nonspecific strength training gains into functional movement.

BRIEF DESCRIPTION OF THE DRAWINGS

FIG. 1*g* provides a fourth schematic perspective view illustrating the preferred z-axis embodiment of the invention in relation to a seated person positioned for use of the z-axis embodiment, and provides further insight into the wide diameter revolving arc roller system with decagon roller pattern and the range of positions of the revolving assembly.

FIG. 1*i*1 provides a schematic perspective view illustrating a revolving user interface handle for z-axis, compound, and other embodiments of the invention.

FIG. 1*i*2 provides a schematic perspective view illustrating the revolving user interface handle for z-axis and compound embodiments of the invention.

FIG. 1*i*3 provides a schematic perspective view illustrating the revolving user interface handle for z-axis and compound embodiments of the invention.

FIG. 1*i*4 provides a schematic perspective view illustrating the revolving user interface handle for z-axis and compound embodiments of the invention.

FIG. 2 provides a schematic perspective view illustrating a z-axis/multi-axis embodiment of the invention employing a differential drive instead of the flexible linkage differential pulley system used in the preferred embodiment.

FIG. 4 provides a schematic perspective view illustrating a compound selectorized multi-axis embodiment employing a differential drive instead of the flexible linkage differential pulley system employed by the compound concentric drive embodiment.

FIG. 7A1*a* provides (beginning on the left and proceeding to the right) a schematic perspective view and a schematic side view of an embodiment characterized by a single revolving arc with an equilateral triangular support roller pattern.

FIG. 7A1*b* provides (beginning on the left and proceeding to the right) a schematic perspective view and a schematic side view of an embodiment characterized by a single revolving arc as illustrated in FIG. 7A1*a*, and also featuring support spokes and an offset center pivot mechanism.

FIG. 7A2 provides (beginning on the left and proceeding to the right) a schematic perspective view and a schematic side view of an embodiment characterized by a single revolving arc with an equilateral triangular support roller pattern as illustrated in FIG. 7A1*b*, and also featuring a bearing post. (Center pivot Mechanism).

FIG. 7A3 provides a schematic perspective view and a schematic side view of an embodiment characterized by a single revolving arc with an equilateral triangular support roller pattern similar to those previously illustrated, but featuring an arcuate guide that is not a full circle.

FIG. 7A4 provides a schematic perspective view of an embodiment characterized by bilateral wide diameter revolving arcs flanking the user station.

FIG. 7B1 provides a schematic perspective view of an embodiment characterized by double revolving arc and roller mechanism employing a radial stabilizer.

FIG. 7B2 provides a schematic perspective view of an embodiment characterized by double revolving arc employing a free flexible linkage mechanism, an outrigger boom stabilizer and an offset concentric parallel arcuate guide.

FIG. 7B3 provides a schematic perspective view of an embodiment having a double revolving arc mechanism with user interfaces mounted on either side of the revolving arcs.

FIG. 7B4 provides a schematic perspective view of an embodiment having a pair of double revolving arc mechanisms with one being used for lateral stabilization.

FIG. 14A1 provides a schematic perspective view of a center pivot boom design for a shoulder rotation multi-axis resistance exercise embodiment of the present invention.

FIG. 14A2 provides (beginning in the lower left corner and proceeding clockwise) a schematic perspective view, top view, and frontal view providing further detail with regard to user interface range in the shoulder rotation multi-axis resistance exercise embodiment of FIG. 14A1.

FIG. 14B1 provides a schematic perspective view of a center pivot boom design for a shoulder rotation y-axis/multi-axis resistance exercise embodiment of the present invention.

FIG. 14B2 provides (beginning in the upper right corner and proceeding clockwise) schematic perspective, side, frontal, and top views of the center pivot boom design for a shoulder rotation y-axis/multi-axis resistance exercise embodiment of FIG. 14B1.

FIG. 16*b* provides (beginning in the upper left corner and proceeding clockwise) schematic perspective, top, frontal and side views of the multi-axis narrow diameter revolving arc compound shoulder resistance exercise embodiment of FIG. 16*a*.

FIG. 18*h* provides (beginning in the lower left corner and proceeding clockwise) schematic side, top and frontal views illustrating the continuous loop revolving arc and boom with roller assembly of FIG. 18*a* applied with an X-axis boom.

FIG. 19*d* provides (beginning in the lower left corner and proceeding clockwise) schematic side, top, and frontal views further illustrating the compact Z-axis/multi-axis exercise embodiment of FIG. 19*c*.

DESCRIPTION

The present invention is a multiple axis (multi-axis) exercise device providing a user interface (or user interfaces) with a trans-locatable axis (or axes) of rotation for exercise, but especially a trans-locatable axis of rotation that intersects and or is coaxial with (i.e. in collinear or parallel alignment with) the active axis of rotation of the joint trained, regardless of the plane or axis of rotation of exercise (e.g. collinear with the axis of rotation of the elbow in the bicep/tricep embodiment or parallel to the z-axis as in the compound embodiment).

Alternatively, the trans-locatable axis of rotation of exercise may be adjustable or dynamically variable.

The multi-axis exercise device concept may be incorporated into a series of exercise units. Each unit can provide isolated and/or compound exercise about a unique axis of potentially infinite radial planes of joint motion. (Alternatively, some units may provide a potentially infinite number of planes or axes of rotation of exercise to the shoulder or other joints in a parallel or other non-radial array.)

Figure 1A:
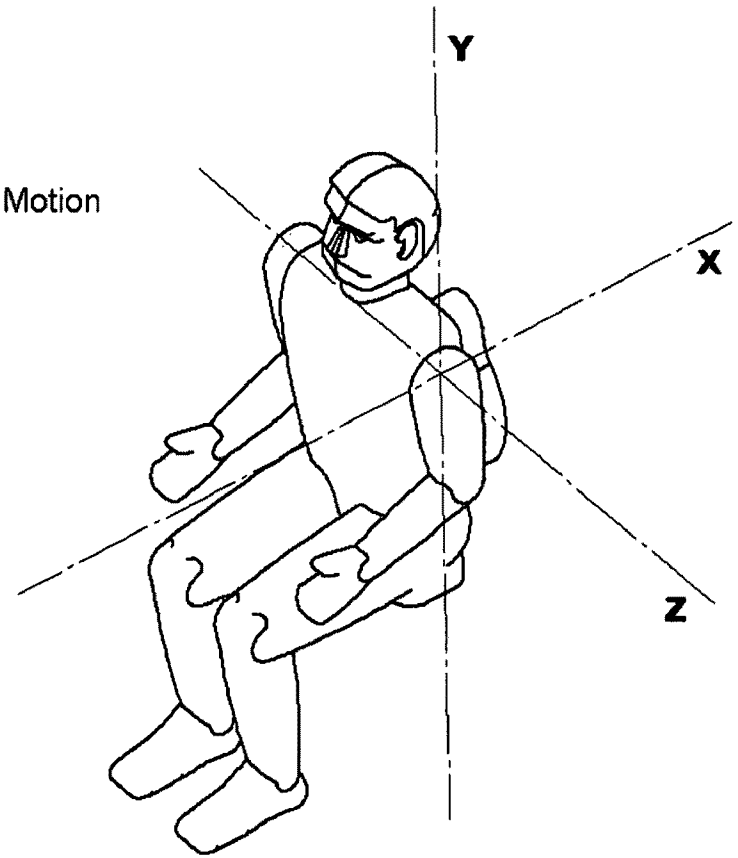
FIG. 1*a* provides a schematic perspective view illustrating the x, y and z axes in relation to the bones of a human shoulder joint.

The primary axes of infinite radial planes of motion of the shoulder are the conventional Cartesian axes, illustrated in FIG. 1*a*. In the preferred embodiment, resistance exercise is provided in all planes of motion radial to or passing through the z-axis of the shoulder. (FIG. 1*b*. shows a previous embodiment of a z-axis device as described in U.S. Pat. No. 7,341,546, and in continuing application Ser. No. 11/899,463 (now U.S. Pat. No. 7,601,106)). Most planes of motion provided by embodiments described in this disclosure are radial to or pass through one of the conventional Cartesian axes, but the present invention may provide resistance exercise in planes radial to any axis passing through the shoulder joint. The concepts applied to shoulder motion in this specification can be applied to other joints and parts of the body as well.

The multi-axis exercise device concept is a sub-concept of the multiple, exponential, or infinite plane concept of resistance training discussed in the background above, and is an integral part of this disclosure. Comprehensive multiple plane resistance training is provided exclusively by the present invention, and is based on two training principles. The first principle is to perform one set of resistance exercise per plane of exercise, and to perform resistance exercise in an exponential or infinite number of planes over time. The second principle is to transfer or integrate neuromuscular gains into functional movement through training in a sequential progression of exercises from simple patterns or planes, advancing to more complex movements, and finally to exercises utilizing true functional movements.

1. Z-Axis/Multi-Axis Shoulder Exercise Device

FIG. 1*c-k* illustrate the preferred z-axis embodiment of the present invention. This embodiment is named for the shoulder z-axis of a user positioned in the user station 30 of the machine, which said z-axis is aligned in (or approximately in) a collinear relationship with the revolving axis 205 of the machine. In this embodiment, the user interface axes of rotation 200, 201 intersect the corresponding shoulders of the user (as in most embodiments disclosed herein), and intersect and/or are perpendicular to the revolving axis 205. This embodiment provides isolated shoulder resistance exercise in any of the infinite radial planes of motion passing through the z-axis of shoulder movement. In the art, isolated shoulder resistance exercise is defined as training in which shoulder joint movement is isolated, with no concurrent angular movement of the distal elbow joint. Examples of isolated shoulder resistance exercise devices are butterfly machines and rear deltoid machines.

Turning to FIGS. 1*c-f* in detail, the exercise machine of the present invention (designated generally as apparatus 10) comprises a base 12 adapted to rest on a supporting surface. A vertical support which also serves the function of a stationary arcuate guide 14 is secured to the base. A resistance mechanism, such as a selectorized weight stack 16, is also secured to the base or frame. Weight stack 16 is operationally connected via a flexible linkage 67 (routed through pulleys) to user interface assemblies 20*a* and 20*b*, providing resistance to motion thereof.

Substantially and/or repositionably mounted on the base 12 and/or on the arcuate guide 14 is a user station/seat 30. The user station/seat 30 has a horizontal component 34, and a vertical back 36 adapted to support a user in a sitting position facing towards or away from the back 36 for use of the apparatus of the present invention. Said user station/seat 30 may have vertical, lateral, and forward-aft adjustment capability. User station/seat 30 may also have vertical axis rotational adjustment capability, permitting user station/seat 30 to swivel to face either forward or backward direction on the preferred embodiment. Vertical axis swiveling may be used to advantage for positioning user station/seat 30 and the user at any angle in relation to the user interface 20*a*, 20*b* in certain other embodiments of the present invention as well.

Turning to the active or working portions of the present invention, the exercise machine 10 comprises a stationary arcuate guide 14 which is generally formed from metal such as steel rectangular tubing. The centerline of the circular arc of the arcuate guide 14 is collinear with the revolving axis 205 of the revolving assembly 15, and is collinear or coincident with the z-axis of motion of the shoulder(s) of a user seated in the user station in the preferred embodiment.

The stationary arcuate guide 14 is the structural support of the revolving functional components of the machine. In the preferred embodiment, revolving arcs 63 are dependent and co-revolving (i.e. substantially fixed to one another by way of boom 64), are parallel and apposed, and designated right and left 63*a*, 63*b*. Revolving arcs 63*a*, 63*b* are concentric with, and are mounted on corresponding right and left sides of arcuate guide 14, by way of rollers 62, as illustrated in FIG. 1*g*. Therefore, revolving arcs 63*a*, 63*b* are concentric with (and revolve about) the revolving axis 205 and the z-axis of the shoulder(s) of a user positioned in the user station/seat 30. The functional components of the machine are fixed to the revolving arcs 63*a*, 63*b*.

In the preferred embodiment, revolving arcs 63*a*, 63*b* are made from metal tubing or channel having cross-sectional or inner dimensions and shape congruent with the cross-sectional, surface, and/or outer dimensions and shape of rollers 62. Rollers 62 are mounted on both planar sides of the arcuate guide 14 in a mirrored polygonal and/or circular pattern, with decagonal pattern illustrated in FIGS. 1*g* and 8*a*. Said polygonal and/or circular pattern has a diameter corresponding to the diameter of revolving arcs 63*a*, 63*b* in the preferred embodiment. Centerlines of rotation of rollers 62 are oriented parallel to the revolving axis 205 in the preferred embodiment. Rollers 62 may have axes of rotation that are radially oriented in relation to revolving axis 205 or otherwise aligned, depending on the roller system employed and the requirements of the specific embodiment of the invention. Rollers 62 roll within the confines of congruent inner surfaces of channel of revolving arcs 63*a*, 63*b*. Thus, when revolving arcs 63*a*, 63*b* are in functional position as shown, rollers 62 provide a "gliding path" along or over which revolving arcs 63*a*, 63*b* glide, roll, or revolve about the revolving axis 205. Because of the width of the diameter of the revolving arcs 63*a*, 63*b* in this embodiment, this is referred to as a wide diameter revolving assembly. (Although a conventional roller/channel system is described, others that may be employed include a follower/roller, roller/bearing, roller/rail, mini-rail, glider/slider or other roller or conveying systems).

Substantially fixed to revolving arcs 63*a*, 63*b* is an overhead or drive assembly 11, along with an adjustably mounted revolving counterweight 13, which revolving counterweight 13 is diametrically opposed to overhead or drive assembly 11 on revolving arcs 63*a*, 63*b*. Revolving arcs 63*a*, 63*b*, overhead or drive assembly 11, and revolving counterweight 13 all revolve as a unit about revolving axis 205, and together are termed the revolving assembly 15. Revolving counterweight 13 has similar mass to overhead or drive assembly 11, and is (or can be) fixed in a diametrically opposed position on revolving arcs 63*a*, 63*b* in relation to overhead or drive assembly 11. This results in a buoyancy-neutral revolving assembly 15.

Overhead or drive assembly 11 is comprised in its basic form by: a boom 64 (with supporting elements), and right and left user interface assemblies 20*a*, 20*b*. User interface assemblies 20 provide isolated shoulder resistance in all planes radial to the z-axis, and are designated right and left 20*a* and 20*b*. Right and left user interface assemblies 20*a*, 20*b* are comprised by right and left: lifting pulleys 65*a*, 65*b*, user interface drive shafts 21*a*, 21*b*, user interface levers 23*a*, 23*b*, user interface handles 28*a*, 28*b*, and a user interface spring pin and index plate assembly (not shown). (Said user interface spring pin and index plate assembly is employed for adjusting starting angle of user interfaces and for limiting range of motion of exercise, as on many strength training and rehabilitation devices of, and well known in, the prior art).

Mounted by way of bearings on boom 64 are right and left user interface drive shafts 21*a*, 21*b*. User interface drive shafts 21*a*, 21*b* have fixed axes of rotation 200 and 201 in relation to boom 64 in the preferred embodiment (although user interface drive shafts 21*a*, 21*b* and their axes 200 and 201 can be adjustable angularly and spatially in relation to each other and in relation to boom 64 in this and other embodiments). Axes of rotation 200 and 201 of user interface drive shafts 21*a*, 21*b* are: (1) separated by a distance (which can be adjustable) that is equal to or approximately shoulder width; (2) approximately parallel to one another; and (3) axis of rotation 200 and 201 of each user interface drive shaft 21*a*, 21*b* intersects the corresponding shoulder joint, and is perpendicular to the z-axis of motion of the shoulders of a user positioned in the user station/seat 30, regardless of the angle of the plane of exercise.

User interface levers 23*a*, 23*b* are concentrically mounted on corresponding user interface drive shafts 21*a*, 21*b* and can revolve freely about user interface drive shafts 21*a*, 21*b*. User interface levers 23*a*, 23*b* are disengageably attached to and drive corresponding user interface drive shafts 21*a*, 21*b* by way of engagement of user interface spring pins into holes in user interface index plates, as is taught in the prior art. This type of spring pin and index plate mechanism can be employed to adjust the starting angle for all user interfaces on drive shafts in these embodiments. When user interface spring pins are engaged in user interface index plates, a user exercises by moving or rotating right and left user interface assemblies 20*a*, 20*b* about corresponding right and left user interface axis of rotation 200 and 201. This rotates right and left user interface drive shafts 21*a*, 21*b*. Right and left user interface drive shafts 21*a*, 21*b* are concentrically attached to and drive corresponding right and left lifting or drive pulleys 65*a*, 65*b*. Lifting or drive pulleys 65*a*, 65*b* each wind a flexible linkage 67.

Referring to FIGS. 1*c-f*, flexible linkage 67 is routed from right and left lifting or drive pulleys 65*a*, 65*b* through corresponding right and left boom redirectioning pulleys 2*a*, 2*b* to right and left tensioning pulleys 3*a*, 3*b*. Tensioning pulleys 3*a*, 3*b* revolve in two planes. First, as do all passive pulleys on these embodiments, tensioning pulleys 3*a*, 3*b* revolve independently about their conventional circular centerline or axis when flexible linkage 67 is wound or unwound from above by lifting or drive pulleys 65*a*, 65*b*. Second, tensioning pulleys revolve (in a perpendicular plane) about a tangent line to the arc of the tensioning pulleys 3*a*, 3*b*, said tangent line is collinear with the revolving axis 205. Further, tensioning pulleys 3*a*, 3*b* freely revolve about revolving axis 205 in an equal-angular relationship simultaneously with revolving assembly 15. This relationship is seen when comparing the side views of this embodiment in FIG. 1*d* (in which the overhead or drive assembly 11 is in a vertical position in relation to the user) and FIG. 1*f*. (in which the overhead or drive assembly 11 is rolled backward in relation to the user). Notice that the tensioning pulleys 3*a*, 3*b* always maintain a fixed geometric relationship with revolving assembly 15. This relationship is maintained by the tension of the flexible linkage 67 stretched between the fixed, boom redirectioning pulleys 2*a*, 2*b* and the tensioning pulleys 3*a*, 3*b*. This tangent pivot tensioning pulley mechanism 71 maintains equal tension in the flexible linkage at all times, regardless of the angle of the overhead or drive assembly 11 in relation to the horizontal surface or floor. This permits movement of overhead or drive assembly 11 from one angle or plane of exercise to another, without the need to make an adjustment for slack in the flexible linkage 67.

After exiting the tensioning pulleys 3*a*, 3*b*, the flexible linkage 67 is then reeved through the fixed, revolving axis redirectioning pulleys 4*a*, 4*b* to the fixed, weight stack redirectioning pulleys 5*a*, 5*b*. From weight stack redirectioning pulleys 5*a*, 5*b*, flexible linkage 67 is reeved around the differential pulley 6, which is substantially mounted on top of the weight stack 16. In this way, a single flexible linkage 67 is routed from the right lifting or drive pulley 65*a* down to the weight stack 16, then back up to left lifting or drive pulley 65*b* by way of redirectioning, tensioning, and differential pulleys. This configuration of pulleys results in a flexible linkage differential selectorized resistance mechanism 70 providing full and equal independent resistance to each of two separate user interfaces 20*a*, 20*b* simultaneously when actuated by a user, in any plane of exercise, and employing only one weight stack. This type of flexible linkage differential selectorized resistance mechanism 70 can be employed on all embodiments of this invention utilizing independent user interfaces.

Figure 1B:
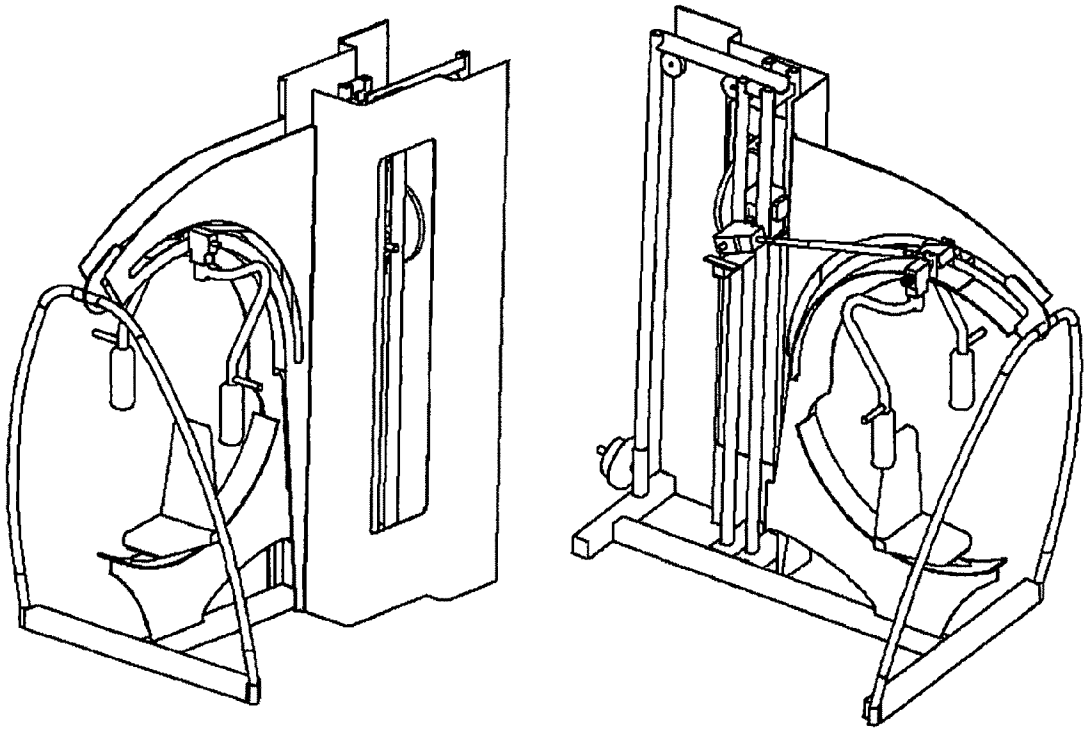
FIG. 1*b* provides schematic perspective view illustrating a previously patented embodiment of the invention.
Figure 1C:
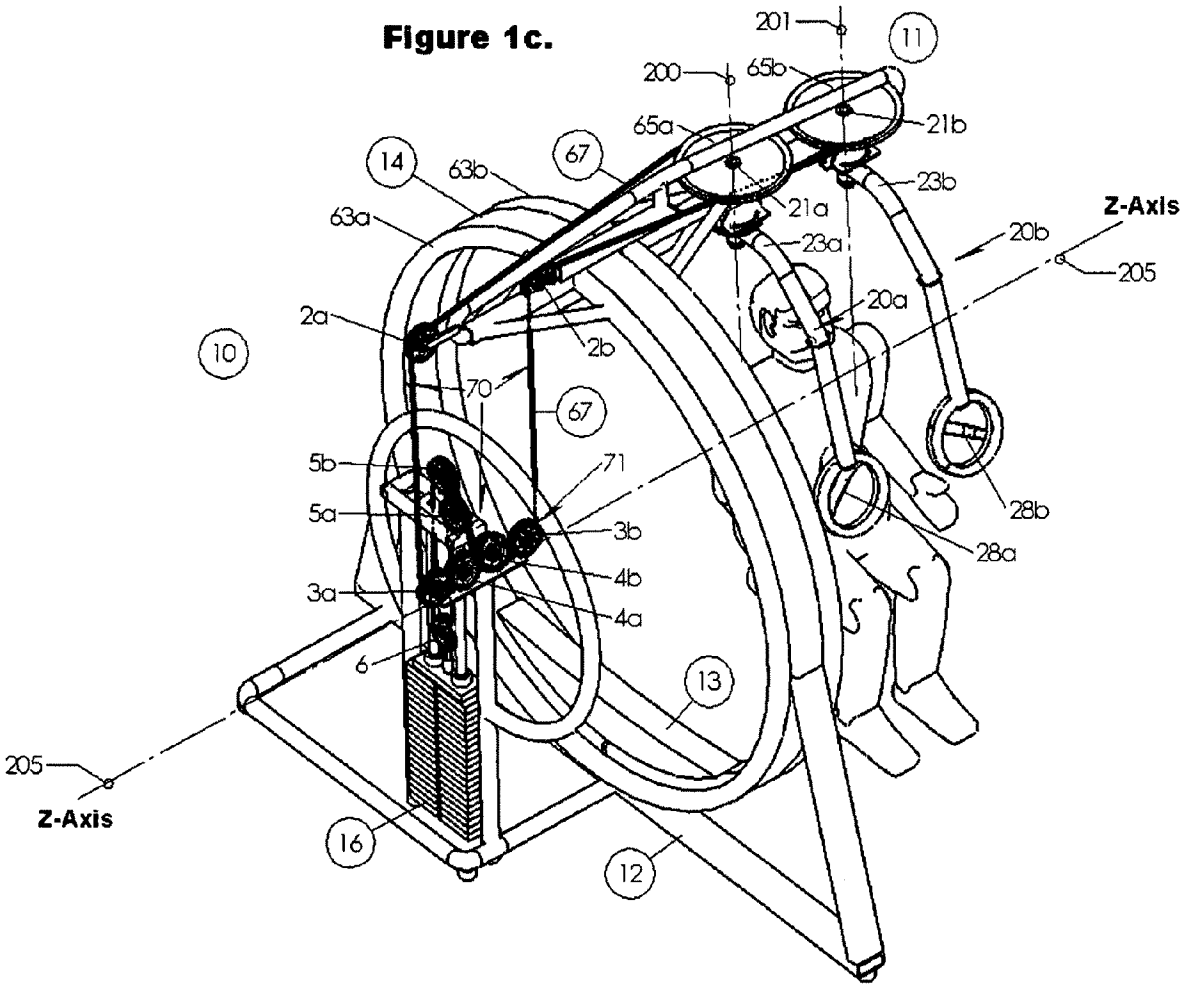
FIG. 1*c* provides a schematic perspective view illustrating the preferred z-axis embodiment of the invention in relation to a seated person positioned for use of the z-axis embodiment.
Figure 1D:
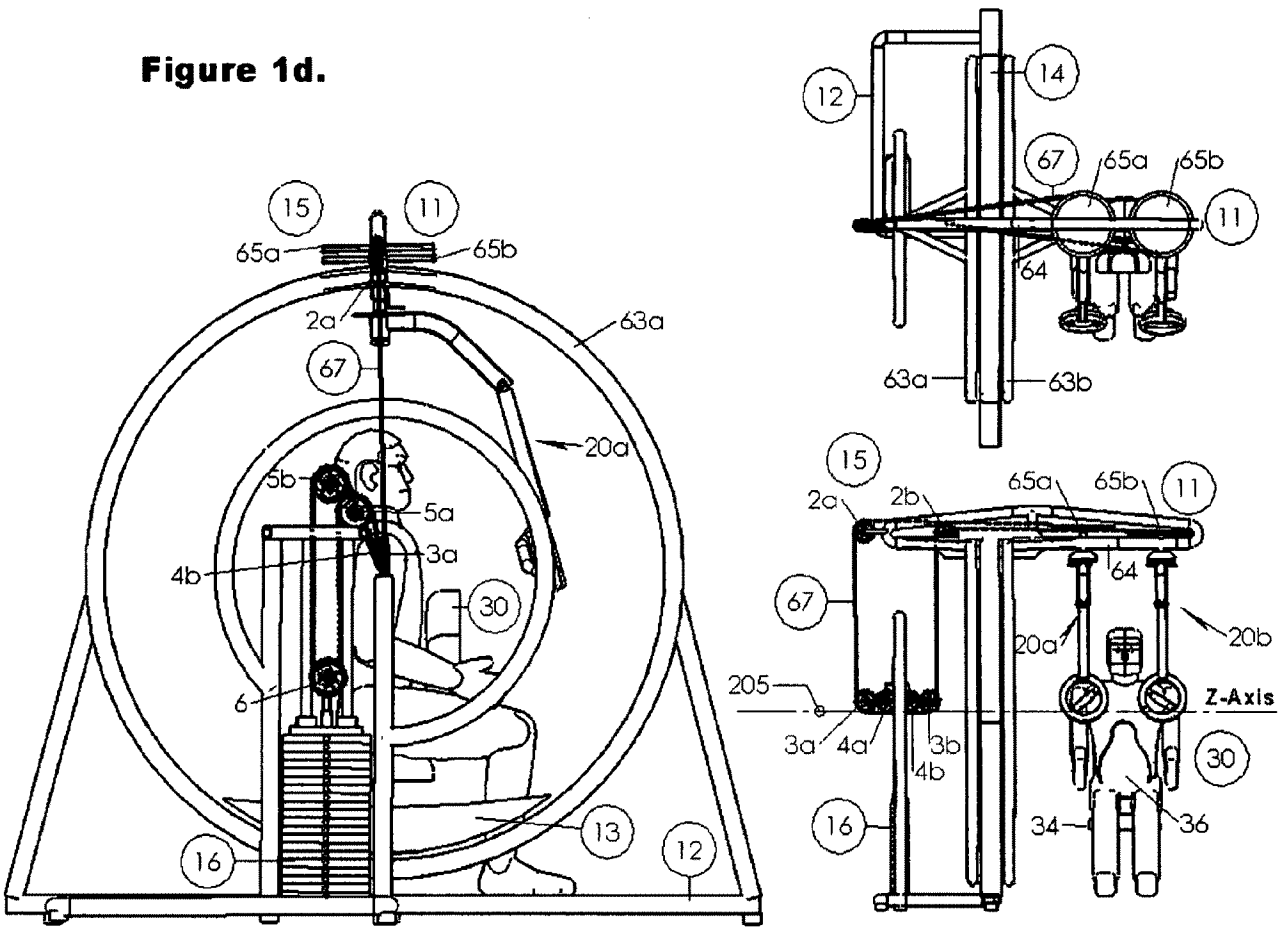
FIG. 1*d* provides (beginning in the lower left corner and proceeding clockwise) a schematic side view (from the weight stack side), a schematic overhead view, and a schematic front view of the preferred z-axis embodiment of the invention in relation to a seated person positioned for use of the z-axis embodiment.
Figure 1E:
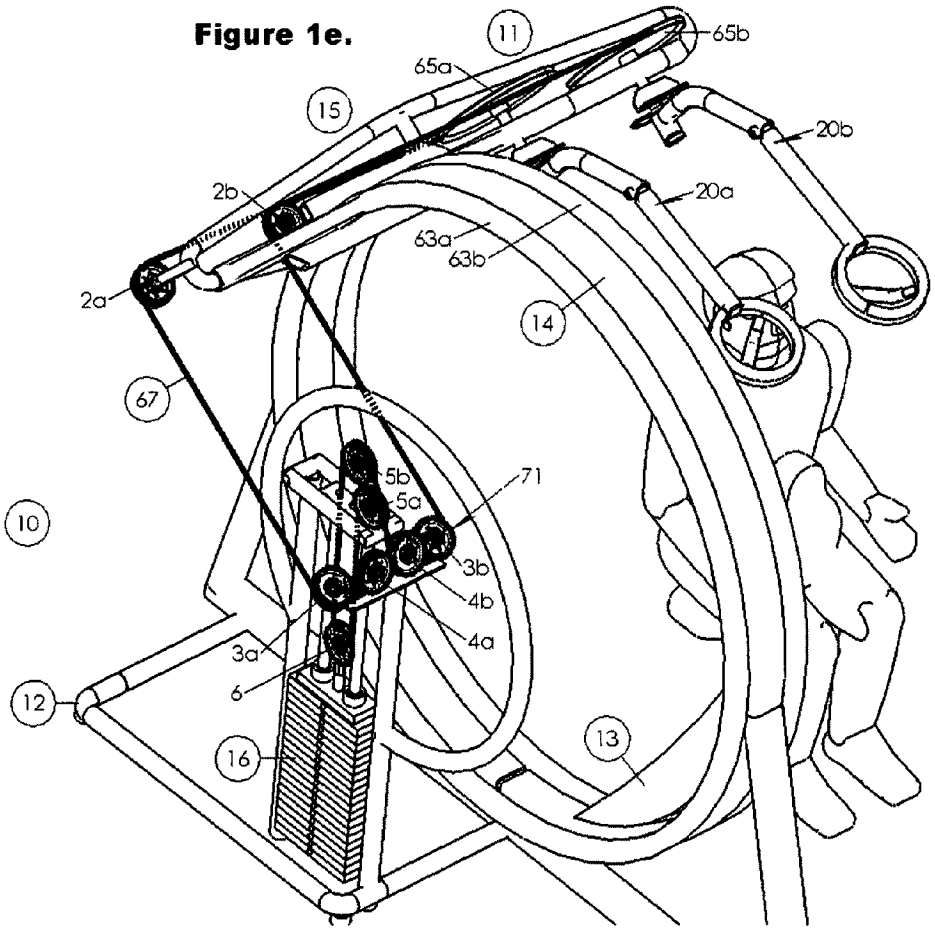
FIG. 1*e* provides a second schematic perspective view illustrating the preferred z-axis embodiment of the invention in relation to a seated person positioned for use of the z-axis embodiment, and provides further insight into flexible linkage routing.
Figure 1F:
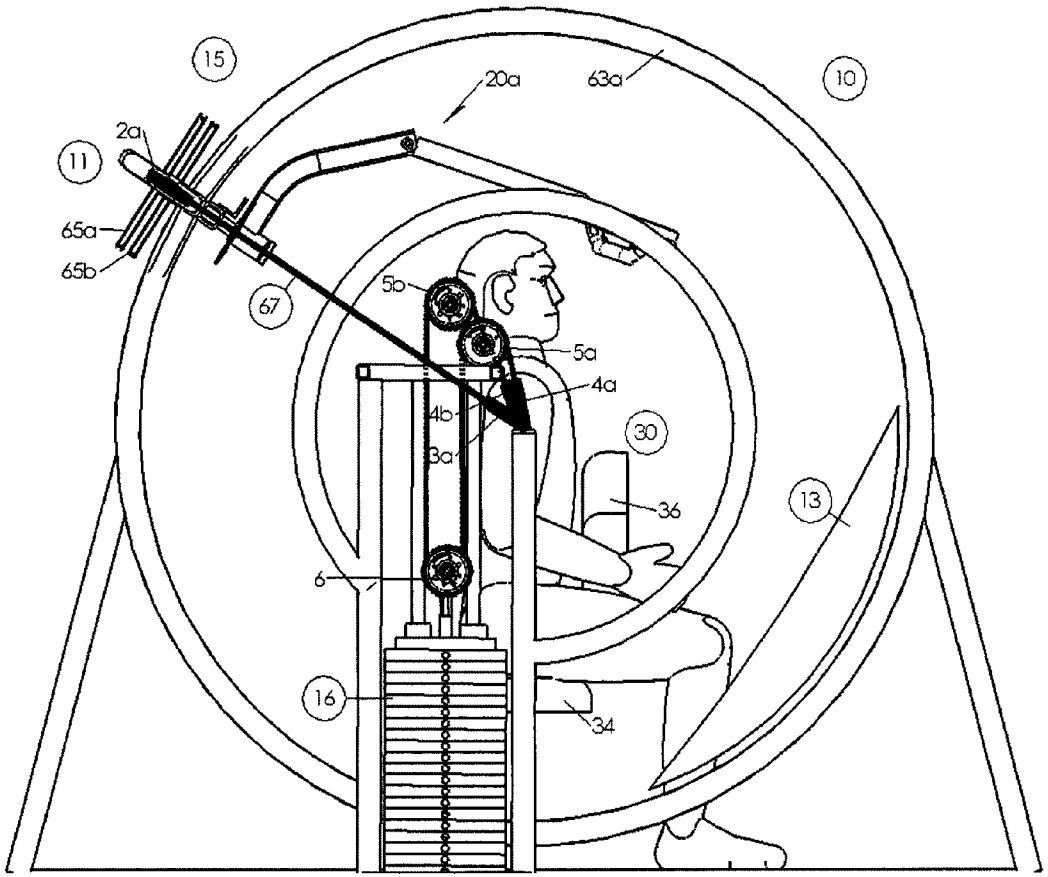
FIG. 1*f* provides a third schematic perspective view illustrating the preferred z-axis embodiment of the invention in relation to a seated person positioned for use of the z-axis embodiment, and provides further insight into flexible linkage routing.
Figure 1H:
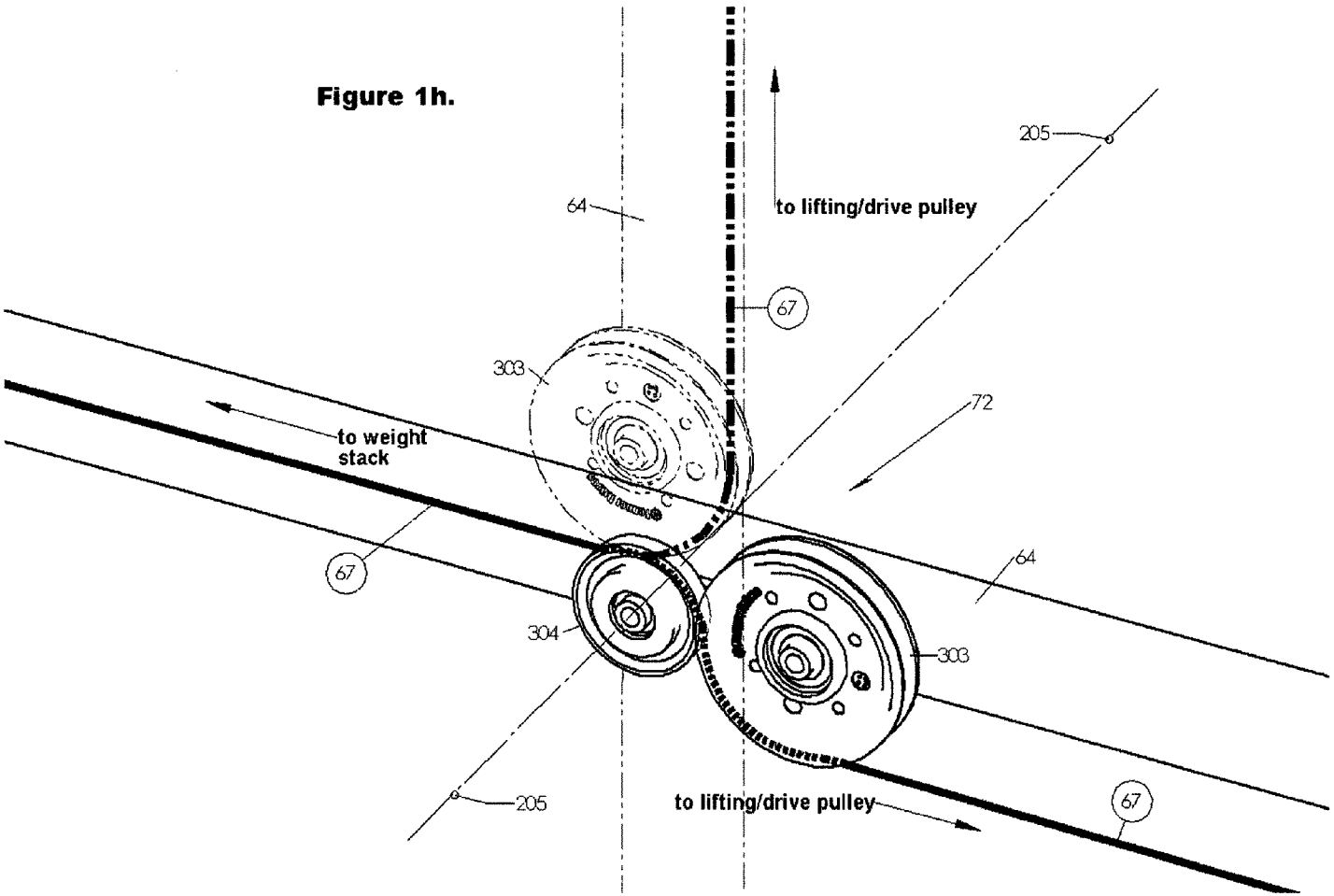
FIG. 1*h* provides a schematic perspective view illustrating an alternative fixed sagittal plane tensioning pulley system mounted on a generic boom.

The flexible linkage differential selectorized resistance mechanism 70 just described employs a flexible linkage tangent pivot tensioning pulley system 71 for maintaining equal tension in the flexible linkage 67 when revolving assembly 15 is moved. FIG. 1*h* shows an alternative fixed plane tensioning pulley system 72 which provides mechanical results that are identical to and interchangeable with the tangent pivot tensioning pulley system 71. That is, the fixed plane tensioning pulley system 72 maintains equal tension in the flexible linkage 67 at any angle of the overhead or drive assembly 11 in relation to the horizontal surface. In detail, FIG. 1*h*. shows the basic pulley arrangement for the fixed plane tensioning pulley system 72. The fixed plane tension pulley 303 is mounted on boom 64 of the given multi-axis device and in a plane perpendicular to the revolving axis 205 of the device, with center of rotation of fixed plane tension pulley offset from revolving axis 205. The fixed plane tension pulley system 72 may include one or more reserve pulleys 304. In the drawing, one reserve pulley 304 is employed mounted in concentric alignment with revolving axis 205 of the device. This arrangement provides constant tension in the flexible linkage 67 during operation.

Figure 17A:
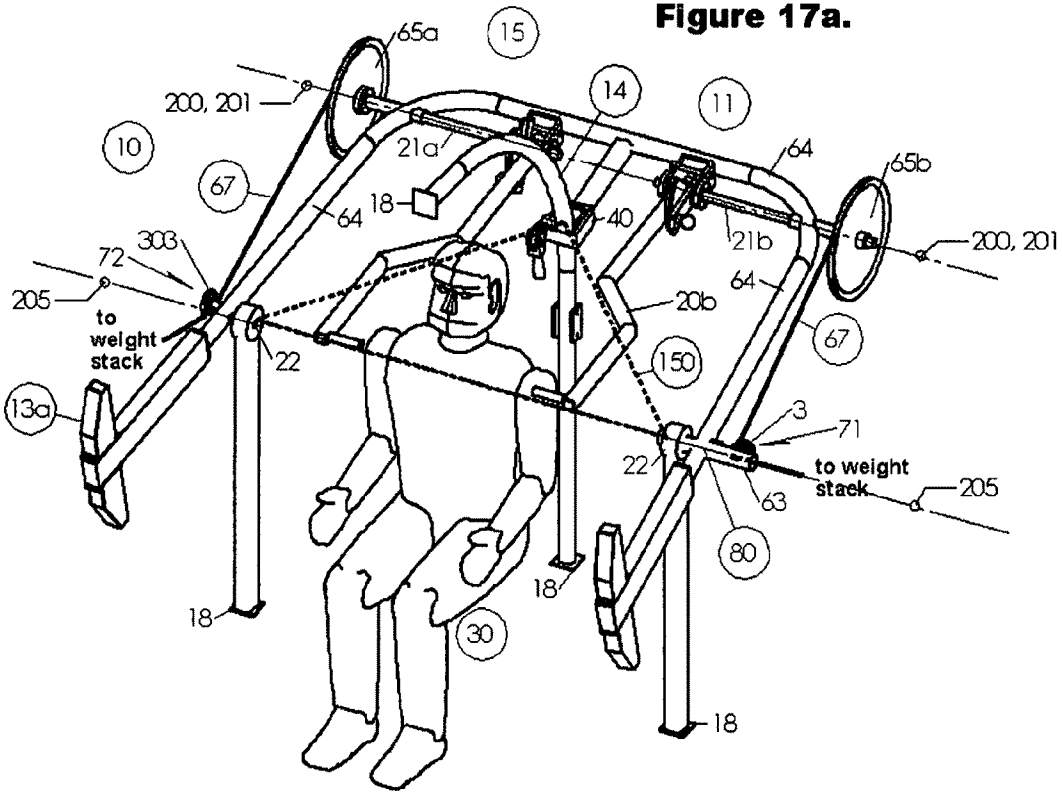
FIG. 17*a* provides a schematic perspective view illustrating a center pivot design for a multi-axis compound shoulder resistance exercise embodiment of the present invention.

The flexible linkage tensioning mechanisms described maintain equal tension and prevent slack in the flexible linkage system, and can be used on all flexible linkage embodiments. FIGS. 17*a*. and 17*b*. show a compound embodiment of the present invention employing the tangent pivot tension pulley system 71 on the left side of the machine, and the fixed plane tension pulley system 72 on the right side of the machine. Note that the revolving arc 63 on the left side of the machine can accommodate a flexible linkage 67 (from the drive pulley 65*b*) routed in either direction along revolving axis 205, that is, away from the user station 30 (as illustrated), or said flexible linkage can be routed toward the user station 30, and through the boom 64 and bearing 22.

Any machine employing the flexible linkage differential mechanism 70 could be equipped with a dual weight stack system. When two weight stacks are employed, drive pulleys 65*a*, 65*b* are each operationally linked to one of the two corresponding independent resistance mechanisms (weight stacks), and a differential mechanism is obviated.

There are two phases of operation of this line of strength training equipment: static adjustment, and exercise. During the static adjustment phase of operation of the preferred embodiment, a user sits in the user station/seat 30, adjusts seat to correct position, and chooses appropriate resistance by placing a pin (not shown) in the selectorized weight stack 16. Then the user adjusts the rotational starting angle of the user interface assemblies 20*a*, 20*b*. To do this, the user interface assemblies 20*a*, 20*b* are rotationally detached from user interface drive shafts 21*a*, 21*b* by releasing or disengaging said spring pin and index plate mechanism. The user interface assembly 20*a*, 20*b* is then rotated about the user interface drive shaft 21*a*, 21*b* and finally, reattached or re-engaged at desired angle by reengaging spring pin-index plate mechanism. Adjustment of the angle of the user interface assemblies 20*a*, 20*b* permits extending or limiting range of motion of exercise in any given plane. It also permits the approximate 90 to 180 degree rotational change in angle of the user interface assemblies 20*a*, 20*b* required for changing from pushing isolated shoulder resistance exercise to pulling isolated shoulder resistance exercise. This rotational adjustment method for user interfaces can be used on all embodiments.

The last part of static adjustment phase is selection of the plane of exercise. To accomplish this, a revolving arc locking mechanism 40 is provided on most embodiments as illustrated in, e.g., FIG. 14.A.1. Said revolving arc locking mechanism 40 may be comprised by a radially aligned spring loaded pin that can be engaged in radially aligned, corresponding holes, or it may comprise a frictional brake or clamp, or equivalent, capable of maintaining a substantially fixed position of the revolving assembly 15 in relation to the stationary arcuate guide 14 when locking mechanism 40 is actuated or locked; but permits free revolution of revolving assembly 15 in relation to arcuate guide 14 when locking mechanism 40 is unlocked or disengaged. Said revolving arc locking mechanism 40 may be hand- or foot-actuated by the user, and may be mounted on arcuate guide 14 and/or base 12, and/or it can be mounted on any part of revolving assembly 15.

Revolving arc locking mechanism 40 is actuated in order to lock (or disengeagably fix) the angular position of the revolving assembly 15 (and therefore, impart stationary support to axes of rotation 200 and 201 of user interface assemblies 20*a*, 20*b*), thereby "locking-in" a unique and specific plane of motion for exercise. When revolving arc locking mechanism 40 is released, revolving arcs 63*a*, 63*b* (and the revolving assembly 15) glide/roll/revolve on rollers 62 about revolving axis 205, and can be freely moved or revolved to any point along the arcuate guide 14. Subsequently, revolving assembly 15 can be locked in any new position along arcuate guide 14 by once again actuating revolving arc locking mechanism 40 in new position of revolving assembly 15, so that axes of rotation 200, 201 of user interface assemblies 20*a*, 20*b* are oriented at a different angle in relation to the horizontal surface or floor, providing a different unique angular plane of exercise for the user. In this way, the user can quickly select (and exercise in) any and all of the infinite radial planes of resisted motion provided by the specific embodiment of the present invention. This type of revolving arc locking mechanism 40 can be employed on all embodiments.

Fixed adjustments made to working components prior to exercise are called static adjustments, whereas dynamic changes made during exercise are called dynamic adjustments. Dynamic adjustments include dynamic changes in dimension, position, or functional properties of any part of the device during operation. For instance, user interface levers 23*a*, 23*b* and/or user interface assemblies 20*a*, 20*b* can be adjustable in length by the use of telescoping elements in order to accommodate variable length of the arms of different users, as well as to dynamically accommodate the changes in length of a user's extremity during a repetition of exercise on any embodiment. Another dynamic adjustment mechanism is the revolving user interface handle 28*a*, 28*b* illustrated in FIGS. 1*i*.1-4. This mechanism can provide static or dynamic angular adjustment of the handhold of a user in any embodiment.

The circular portion of the handles 28*a*, 28*b*, may contain a bearing, rollers, sliding telescoping components, or equivalent, providing rotational motion about a first pivot axis 210 that is generally collinear with the circular axis of the handle 28*a*, 28*b*. A second pivot axis 211 is provided at a right angle to first pivot axis 210, in the preferred embodiment. Second pivot axis 211 provides axial motion to the circular handles 28*a*, 28*b* like a doorknob on compound and z-axis user interfaces FIG. 1*i*.1., but provides rotational motion like a hinge in x-axis and y-axis embodiments, FIGS. 1*i*.2-4. Said second pivot axis 211 may be positioned anywhere along the breadth of the circular portion of handles 28*a*, 28*b*. The axis 211 may or may not intersect said first pivot axis 210, and thereby can provide symmetric or asymmetric rotational motion of the circular handles 28*a*, 28*b*.

Figure 1I:
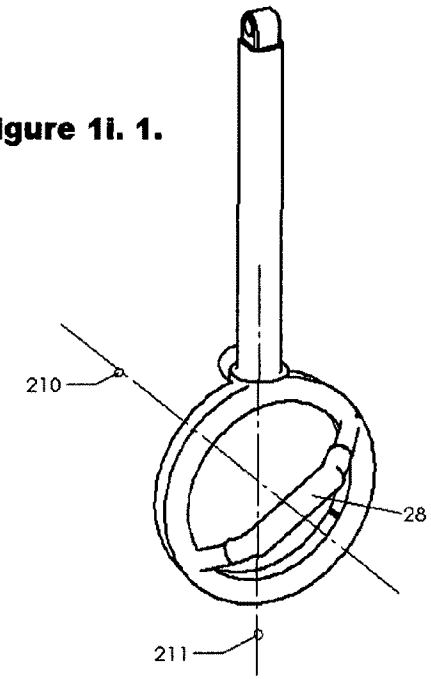
Figure 1I:
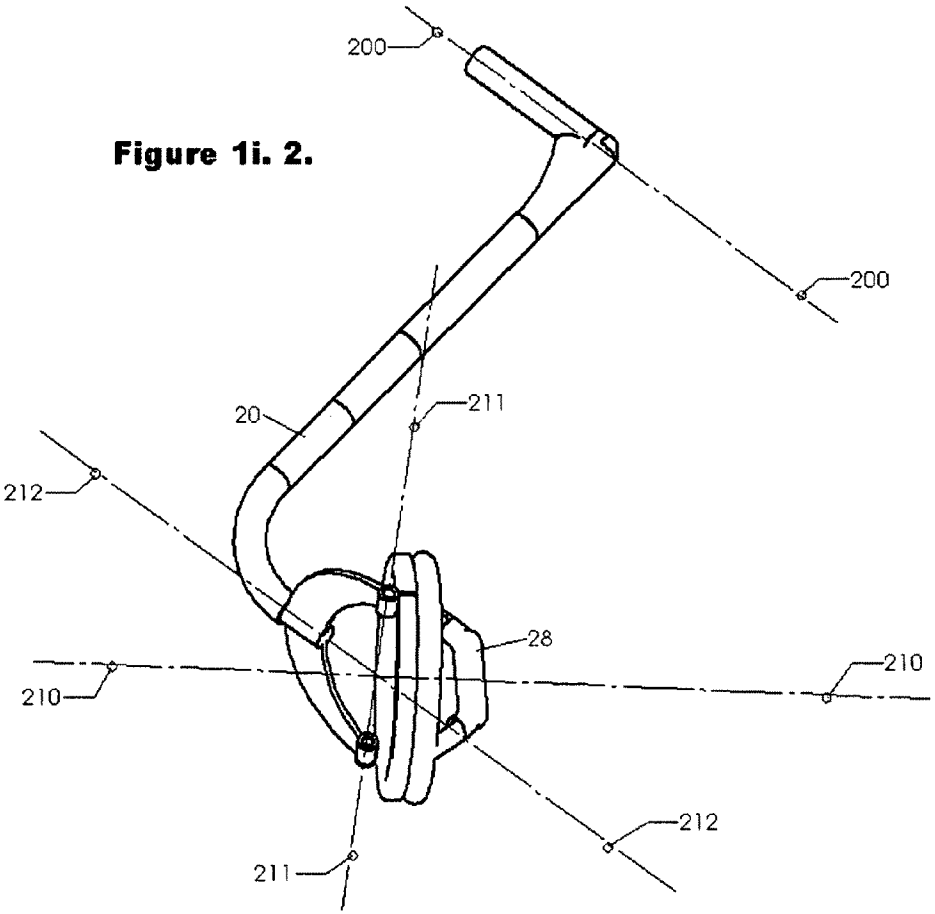
Figure 1I:
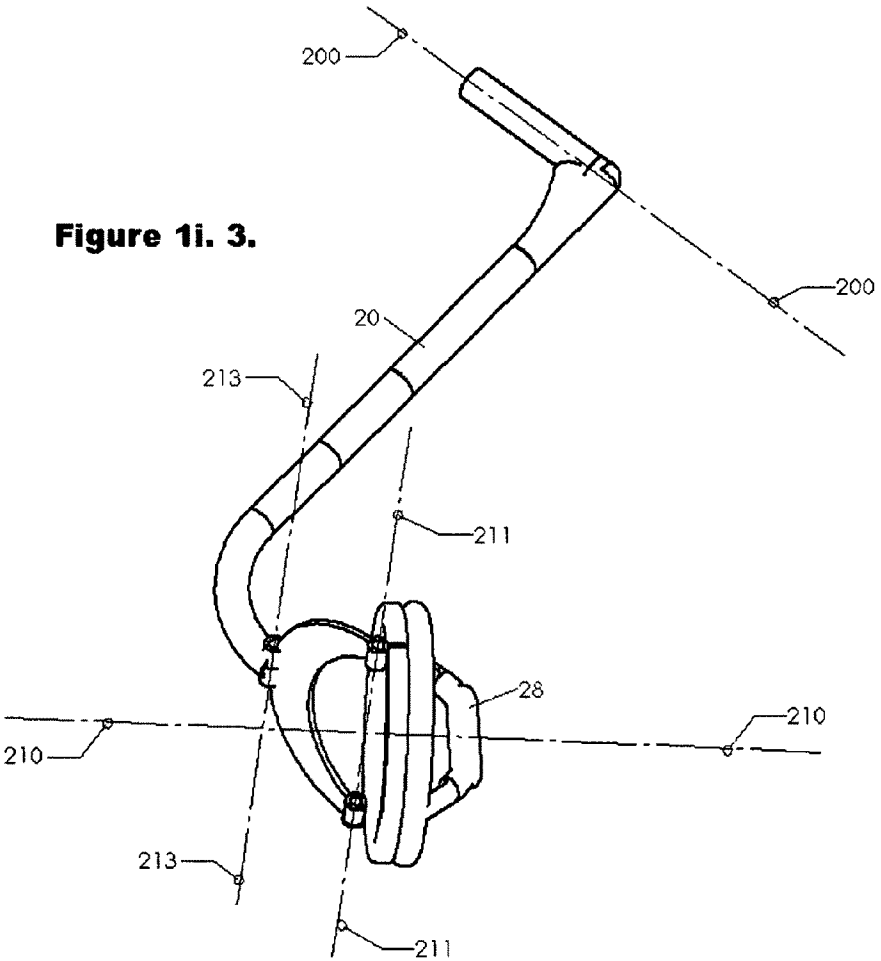
Figure 1I:
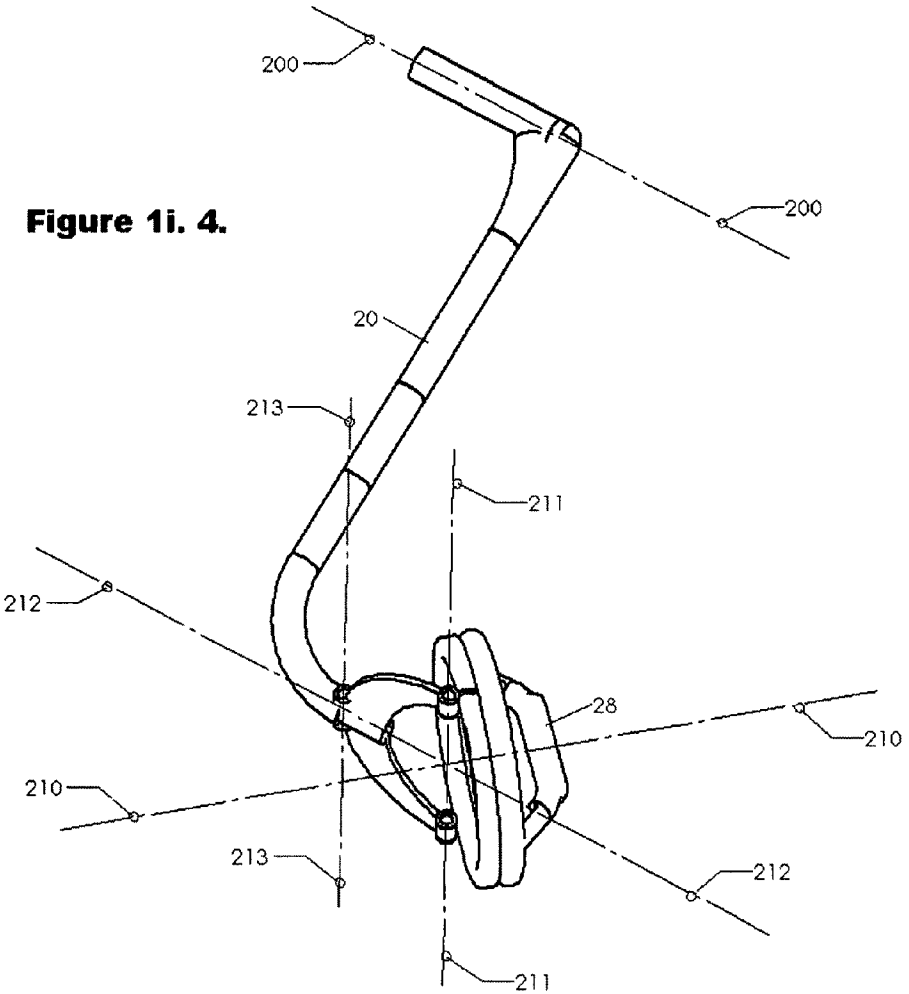

A third pivot axis 212 may be provided which is transverse or parallel to said second pivot axis 211. A fourth pivot axis 213 may be provided at right angle to third pivot axis 212. The alignment of said third 212 and fourth 213 pivot axes may be as shown in FIG. 1*i*.3., with third pivot axis 212 aligned as a door handle, and fourth pivot axis 213 aligned as a hinge, or vice versa. A minimum of one or two pivot axes must be provided to give adequate static and/or dynamic, natural biomechanical adjustment of handle position while exercising in all planes on any given embodiment, depending on the embodiment on which the handle is employed.

Said third 212 and/or fourth 213 pivot axes may be excluded if pivoting is provided about said first pivot axis 210 and said second pivot axis 211. Said first pivot axis 210 may be excluded if pivoting is provided about said second 211 and third 212 pivot axes. That is, the combination of pivot axis one 210 and two 211, or the combination of pivot axis two 211 and three 212 are the preferred configurations, but three or even all four of said pivot axes may be employed together. When two, three, or all four are employed, said pivot axis two 211, and/or pivot axis three 212, and/or pivot axis four 213 can be an axis about which a static adjustment can be made. This enables the handle to be statically or dynamically positioned in any direction (e.g. the handle may be rotated and/or locked in a forward-facing or backward-facing position), or it may be positioned in any static or dynamic incremental angle that is advantageous or comfortable for the user. Generally, the revolving handles 28*a*, 28*b* are always free to move dynamically during exercise about pivot axis one 210 no matter how few or how many other handle pivot axes are employed.

These pivoting mechanisms provide a constant angle of the handhold if the user maintains constant position of the hand, wrist, arm, and shoulder; or they can provide user-defined, dynamic variable angular positioning of the handholds. It should also be noted that the handles 28*a*, 28*b* are offset toward the user out of the plane of the circular portion of the revolving handle apparatus 28*a*, 28*b*. This gives clearance to the hands, arms, and body of the user from the user interface assemblies during exercise in all embodiments.

Offset configuration of the handles is most advantageous in embodiments in which the forearm of the user is not perpendicular but approximately parallel to the user interface lever 23*a*, 23*b* and/or user interface assembly 20*a*, 20*b*, especially in y-axis and x-axis embodiments. In these embodiments, the forearm would collide with the circular portion of the handles 28*a*, 28*b* during exercise if the handhold was not offset. The revolving handles and their design enhance the biomechanical function of all of these machines and are integral to the inventive concept represented by this line of devices.

Figure 1J:
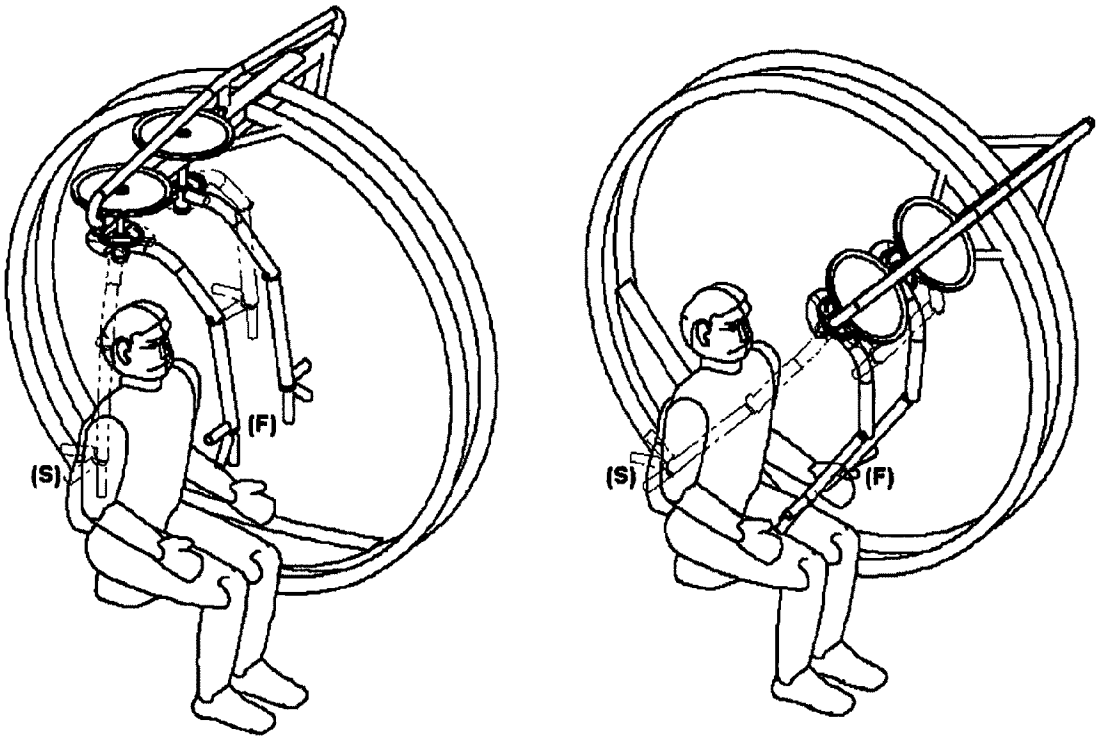
FIG. 1*j* provides a pair of schematic perspective views illustrating the preferred z-axis embodiment of the invention in use for multiple plane pushing exercises, with said views each illustrating a seated person positioned for use of the z-axis embodiment, with said views having their respective user interface assemblies in different positions, and further illustrating start (S) and finish (F) exercise positions for said user interface assemblies.

During the exercise phase of operation, referring to FIG. 1*j*., for "pushing" isolated shoulder resistance exercise, the user sits in the user station/seat 30 in the conventional way with his back against the vertical back 36 of seat 30, and the user interface assemblies 20*a*, 20*b* are locked in start position (S) lateral to the user (as in a butterfly exercise). To perform pushing exercise (in any plane), the user pushes the user interface assemblies 20*a*, 20*b* through the arc and plane of motion to the finish position (F) in the front of the user. In the case of vertical upward pushing exercise, the user interface assemblies 20*a*, 20*b* are locked in start position at the sides of the user and pushed upward through the arc and plane of motion to the finish position over user's head.

Figure 1K:
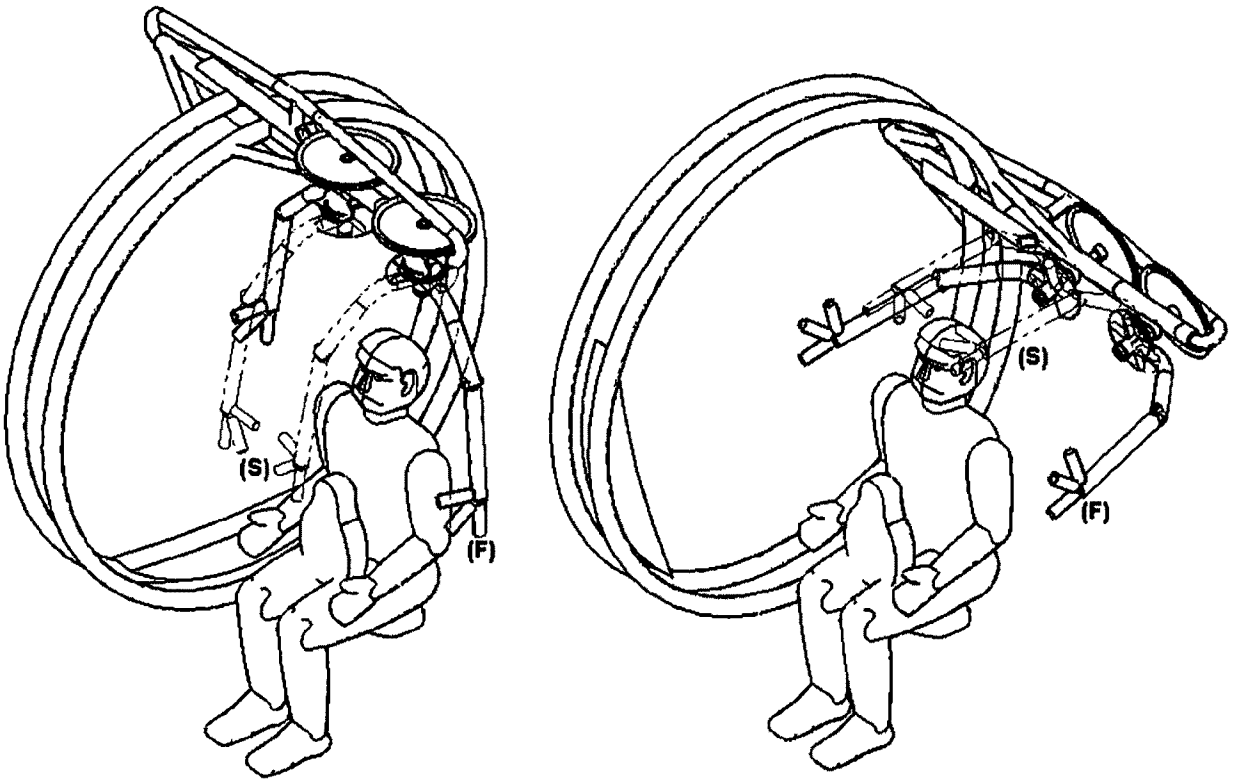
FIG. 1*k* provides a pair of schematic perspective views illustrating the preferred z-axis embodiment of the invention in use for multiple plane pulling exercises, with said views each illustrating a seated person positioned for use of the z-axis embodiment, with said views having their respective user interface assemblies in different positions, and further illustrating start (S) and finish (F) exercise positions for said user interface assemblies.

Referring to FIG. 1*k*., for "pulling" isolated shoulder resistance exercise, the user sits in the user station/seat 30 with chest against the vertical back 36 of seat 30 (i.e. facing the opposite direction with respect to pushing exercise), and the user interface assemblies 20*a*, 20*b* are locked in start position (S) in front of the user (as in a rear deltoid exercise). To perform pulling exercise (in any plane), the user pulls the user interface assemblies 20*a*, 20*b* through the arc and plane of motion to the finish position (F) at the corresponding sides of the user. In the case of vertical downward pulling exercise, the user interface assemblies 20*a*, 20*b* are locked in start position over user's head and pulled down through the arc and plane of motion to the finish position at the corresponding sides of the user. These general instructions for pushing and pulling exercises can be implemented for all isolated and compound resistance embodiments.

2. Z-Axis/Multi-Axis Exercise Device—Employing Differential Drive

Figure 2:
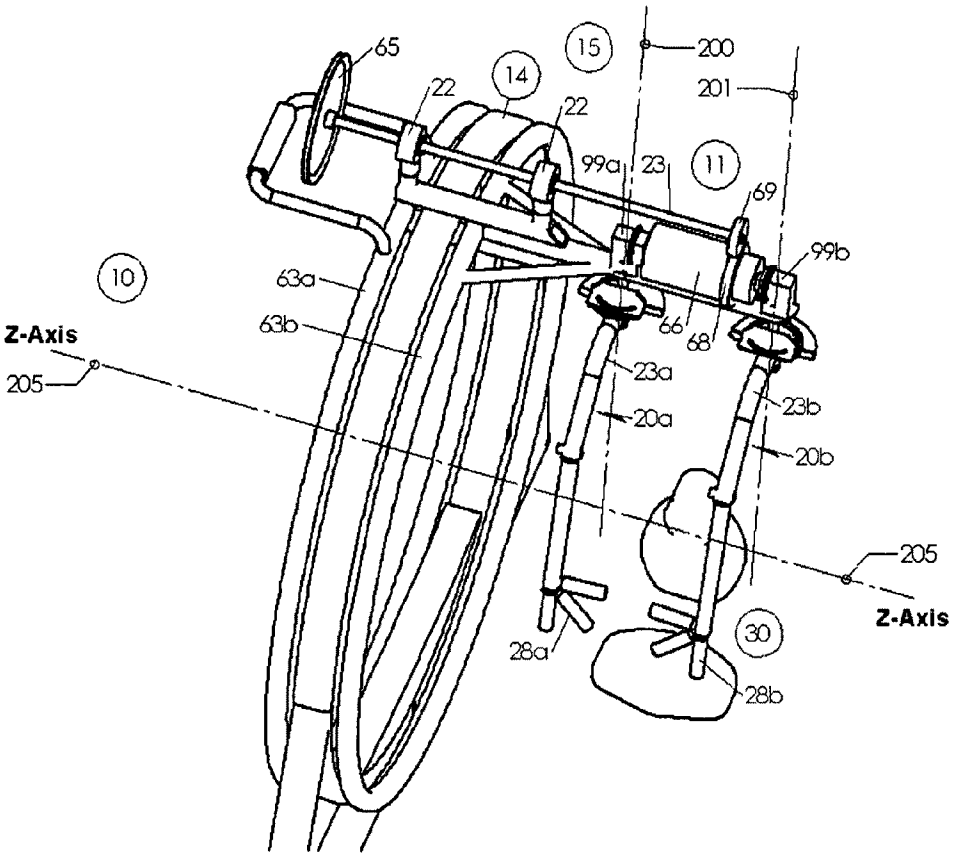

FIG. 2. shows a z-axis/multi-axis exercise device employing a differential drive 66 instead of a flexible linkage differential pulley system as is used in the preferred embodiment. In this embodiment, independent, differential movement and resistance of right and left user interfaces is provided by direct drive differential gearing or equivalent. This mechanism is in the model of gearing and differential assemblies described for the proximal pivoting assembly in U.S. Pat. No. 7,341,546, Gautier 2008.

This embodiment employs arcuate guide 14, revolving assembly 15, and revolving arc locking mechanism 40 similar to those in the preferred embodiment. The user moves similar user interface assemblies 20*a*, 20*b* as those in the preferred embodiment. Right and left user interface assemblies 20*a*, 20*b* drive right and left angle-gearing components 99*a*, 99*b* which comprise a right-angle gearbox as illustrated, and/or open gearing (such as bevel or miter gears), and/or variable-moment-direction drive components (such as a flexible shaft, universal joint, or equivalent). Right and left angle-gearing components 99*a*, 99*b* drive input shafts on corresponding right and left sides of differential drive 66. Through the internal mechanics of differential gearing, the right and left user-generated moments of exercise are combined to drive the differential gear drive 66, and its housing. Ring gear 68 is substantially, concentrically mounted (in this embodiment) on housing of differential 66, and therefore, user-generated moment of exercise drives differential gear drive housing and ring gear 68. Said ring gear 68 in turn meshes with and drives a take-off gear 69 (or pinion). Said take-off gear 69 is substantially, concentrically mounted on an offset shaft 23. Offset shaft 23 is mounted on overhead or drive assembly 11 by way of bearings 22. Offset shaft 23 conveys the combined right and left user-generated moments of exercise to lifting or drive pulley 65 which is substantially and concentrically mounted on the opposite end of offset shaft 23 in relation to take-off gear 69. Lifting or drive pulley 65 winds a flexible linkage which may be routed through a tangent pivot tensioning system 71 as in the preferred embodiment, or a fixed plane pulley tensioning system 72 (as illustrated in FIG. 1*b*., 17*a*., and 17*b*.), or other tensioning system, and ultimately to a weight stack 16 or other resistance mechanism.

The axis of rotation of user interface drive shafts 200, 201 on either side of differential drive 66 can be adjustable to a different angle of exercise, especially within (but not limited to being within) a parallel or coplanar plane in relation to the plane of exercise, through the use of a gearbox, and/or open gearing, and/or a variable-moment-direction drive component, such as a flexible shaft, universal joint, or equivalent.

General Description of Multi-Axis Exercise Device Concept

The design of the preferred embodiment can be used as a model for related, equally innovative strength training devices for providing exercise through many other axes of infinite radial planes of motion. Certain structural and functional elements described are common among the different possible exercise units, mechanical designs, and functional embodiments of this multiple axis resistance exercise device concept. The generalized description of the present invention (i.e. the multiple axis resistance exercise device concept) is: An exercise machine comprised by a substantial arcuate guide centered on an axis of shoulder motion, which arcuate guide supports the revolving functional components of the device (in the preferred embodiment, said arcuate guide is centered on the circumduction axis of shoulder rotation of the seated user, but said arcuate guide may be centered on other relevant axes, depending on the particular multiple axis exercise embodiment); a revolving circular carrier or carrier (revolving arc) which is concentrically mounted on, and freely revolvable and positionable along arcuate guide; said carrier carries a user interface drive assembly from which extends rigid user interface arm(s); said rigid user interface arms are coupled to a resistance mechanism via direct drive and/or flexible linkage(s); therefore, said rigid interface arms are positionable along arcuate guide by way of carrier, and said rigid interface arms are pivotally moveable against resistance.

The fundamental differences between this line of equipment and others are: (1) the axis(es) of rotation of the user interface(s) employed by each machine in this series of exercise devices is trans-locatable, or the axis of rotation of exercise on each single-plane resistance exercise machine is one of a unique group of axes of motion (providing a unique group of radial, parallel, or coplanar planes of motion/exercise); (2) the axis(es) of rotation of the user interface(s) employed by each machine in this series of exercise devices intersect(s) and or is (are) coaxial with the active axis of rotation of the corresponding joint trained during exercise, as described in Gautier 2008; (3) the revolving axis of the revolving assembly in each embodiment may be coaxial with any axis of shoulder motion, but preferentially coaxial with one of the primary Cartesian axes of shoulder motion in most of these embodiments; and (4) each machine in this line provides an exponential or infinite number of planes of resisted motion; or each single-plane resistance machine in a given single-plane device line provides one of a multitude of unique radial or parallel/coplanar planes of exercise about a unique axis of joint motion.

The most important exceptions to the rule that the rotational axis of exercise (i.e. the rotational axis of the user interface) always intersects the corresponding shoulder joint of the user, are the cases of devices that provide axes of exercise that are parallel and/or collinear to the active axis of joint motion and of exercise. The first exception is when the axis of rotation of the user interface is parallel to the revolving axis of the revolving assembly in the case of the compound embodiment. The second exception to the rule that the rotational axis of the user interface intersects the shoulder joint of the user is when the axis of rotation of the user interface passes through some other joint, such as the elbow joint in the biceps/triceps multi-axis exercise device embodiment.

Specifications for Other Multi-Axis Exercise Concept Devices

Figure 3A:
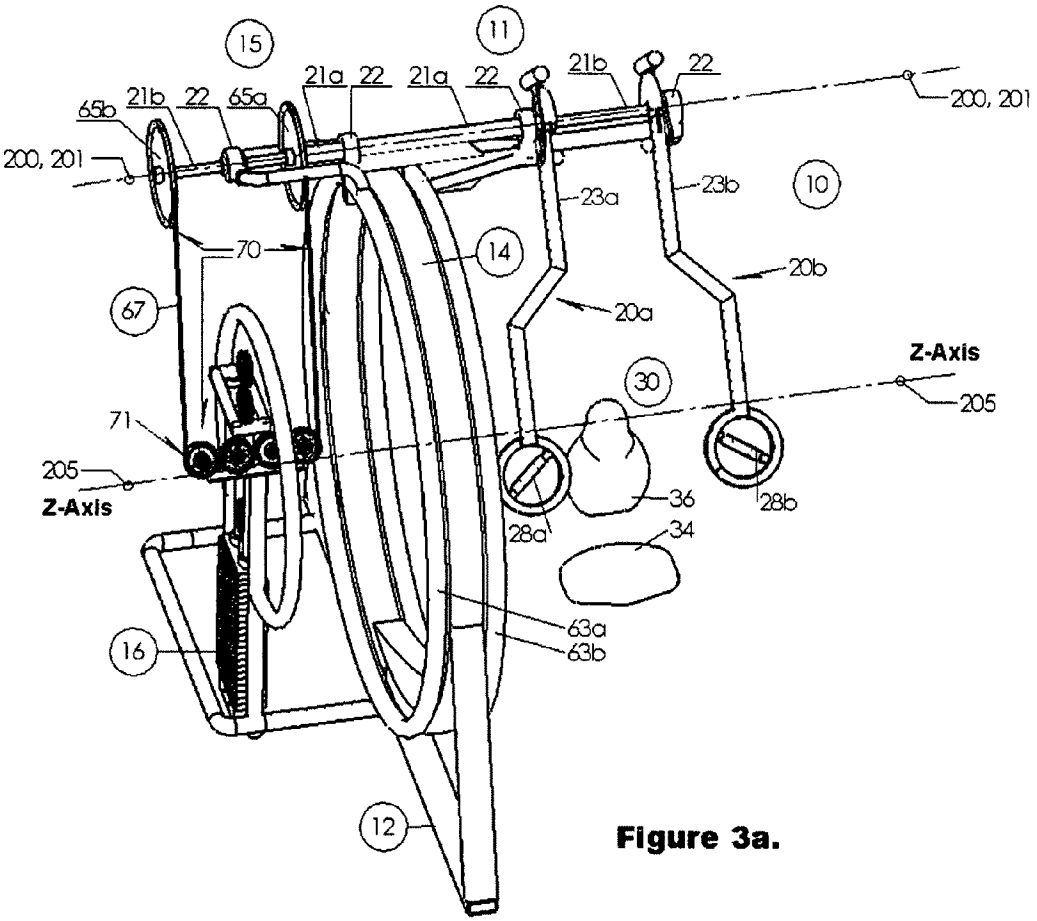
FIG. 3*a* provides a schematic perspective view illustrating a concentric drive compound selectorized multi-axis embodiment where the z-axis of the shoulder motion of a user is collinear with the revolving axis of the revolving assembly of the device.
Figure 3B:
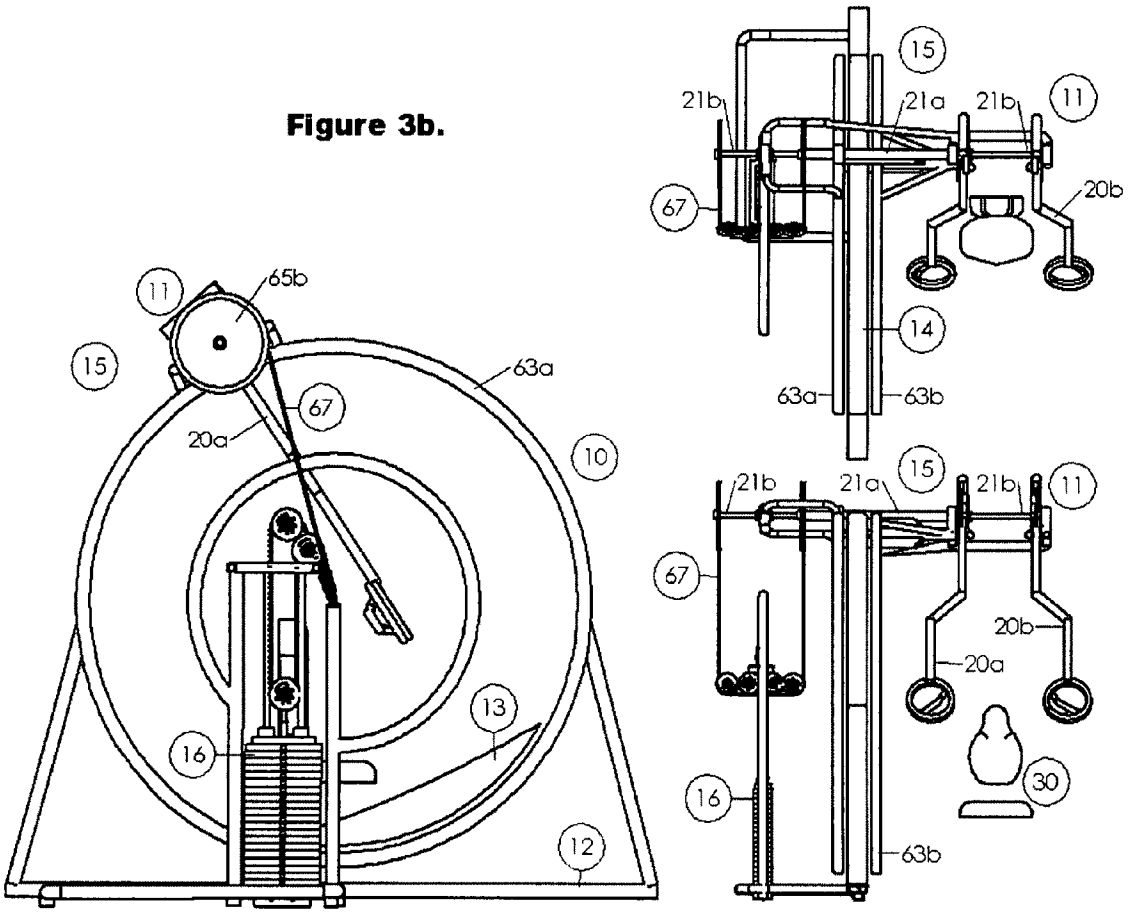
FIG. 3*b* provides (beginning in the lower left corner and proceeding clockwise) a schematic side view (from the weight stack side), a schematic overhead view, and a schematic front view of the compound selectorized multi-axis embodiment illustrated in FIG. 3*a*.

3. Compound Shoulder Multi-Axis Exercise Machines—Employing Concentric Drive Shafts, Flexible Linkage Differential, and Selectorized Resistance Compound shoulder exercise is characterized by simultaneous movement of both the shoulder and the elbow joint. In conventional compound shoulder movement, either the shoulder is flexed while the elbow is extended (i.e. pressing or pushing movement), or conversely, the shoulder is extended while the elbow is flexed (i.e. rowing or pulling movement). Typical examples of compound shoulder resistance exercise devices are shoulder press and rowing machines. In the compound embodiment of the present invention illustrated in FIGS. 3*a*-*b*., the z-axis of shoulder motion of a user positioned in the user station is collinear with the revolving axis 205 of the revolving assembly 15 of the device. The axes of rotation of the right and left user interfaces 200, 201 in this embodiment are parallel to the z-axis of shoulder movement, to the revolving axis 205, and approximately parallel to the active axis of rotation of the shoulder during exercise, by the model of exercise machine design exemplified in Gautier 2008. Gautier 2008 describes a multiplane exercise machine employing a user interface functionally connected to a drive (linked to resistance mechanism); said drive slides along an arcuate guide; and said drive can be detachably attached at any point along said arcuate guide in order to provide exercise at any point along said arcuate guide's length.

This compound shoulder resistance device employs the following common components from the preferred embodiment: (1) wide diameter arcuate guide 14, (2) wide diameter revolving assembly 15, (3) revolving arc locking mechanism 40, (4) tangent pivot tension pulley, (5) selectorized resistance (weight stack 16), and (6) flexible linkage differential pulley mechanism 70. The difference in this compound embodiment and the preferred embodiment is apparent in the overhead assembly 11. In this embodiment, right and left user interface assemblies 20*a*, 20*b* provide compound resistance, with independent, concentric user interface drive shafts. User interface assemblies 20*a*, 20*b* are comprised by right and left: lifting or drive pulleys 65*a*, 65*b*, user interface levers 23*a*, 23*b*, user interface drive shafts 21*a*, 21*b*, user interface handles 28*a*, 28*b*, and user interface spring pins and index plates for adjusting starting angle and range of motion of user interface assemblies 20*a*, 20*b*—as described in the preferred embodiment.

In this embodiment, the user pushes or pulls user interface handles 28*a*, 28*b* of user interface assemblies 20*a*, 20*b* toward or away from the shoulders of the user in a compound shoulder motion. The user thereby generates force on the right and left user interface handles 28*a*, 28*b* which drive corresponding user interface levers 23*a*, 23*b*. User interface levers 23*a*, 23*b* are attached to and drive corresponding user interface drive shafts 21*a*, 21*b*. User interface drive shafts 21*a*, 21*b* are mounted parallel to revolving axis 205 by way of bearings 22 mounted on boom 64 of overhead assembly 11. Right user interface drive shaft 21*a* is made of steel tubing or the like, with inner diameter greater than outer diameter of left user interface drive shaft 21*b*. Left user interface drive shaft 21*b* passes concentrically through right user interface drive shaft 21*a*. User interface drive shafts 21*a*, 21*b* are mounted independently (by way of bearings 22 on boom 64), are driven independently, and revolve independently. The axis of rotation of user interface drive shafts 200, 201 can be adjustable to a different angle of exercise, especially within (but not limited to being within) a parallel or coplanar plane in relation to the plane of exercise, through the use of a gearbox, and/or open gearing, and/or a variable-moment-direction drive component, such as a flexible shaft, universal joint, or equivalent.

When actuated by a user, each right and/or left user interface assembly 20*a*, 20*b* conveys a corresponding right and/or left user-generated moment to the opposite side of the machine by way of corresponding right and/or left concentric user interface drive shafts 21*a*, 21*b*, which independently drive the concentrically mounted corresponding overhead or drive pulley 65*a*, 65*b*. Said corresponding drive pulleys 65*a*, 65*b* wind flexible linkage 67, which is routed through similar flexible linkage differential mechanism 70 described in the preferred embodiment. Adjustments on the machine are made in a similar way to adjustments made on the preferred embodiment. The user may make embodiment-specific adjustments as well (e.g. in rotational angle of revolving handles).

During the exercise phase of operation, for "pushing or pressing" compound shoulder resistance exercise, the user sits in the user station/seat 30 in the conventional way with his back against the vertical back 36 of seat 30, and the user interface assemblies 20*a*, 20*b* are locked in starting position (by way of a similar mechanism for locking the user interface at a given starting angle described in the preferred embodiment) at the shoulders of the user, as in a press exercise. To perform pushing exercise (in any plane), the user pushes the user interface assemblies 20*a*, 20*b* through the arc and plane of motion to the front of the user. In the case of vertical upward pushing exercise, the user interface assemblies 20*a*, 20*b* are locked in starting position at the shoulders of the user and pushed upward through the arc and plane of motion over user's head.

For "pulling or rowing" compound shoulder resistance exercise, the user sits in the user station/seat 30 with chest against the vertical back 36 of seat 30 (i.e. facing the opposite direction with respect to pushing exercise), and the user interface assemblies 20*a*, 20*b* are locked in starting position in front of the user at some user-selected distance (as in a rowing exercise). To perform pulling exercise (in any plane), the user pulls the user interface assemblies 20*a*, 20*b* through the arc and plane of motion back to the corresponding shoulders of the user. In the case of vertical downward pulling exercise, the user interface assemblies 20*a*, 20*b* are locked in starting position over user's head and pulled down through the arc and plane of motion to the corresponding shoulders of the user.

These general instructions for pushing and pulling exercises can be implemented for all isolated and compound resistance embodiments.

Figure 3C:
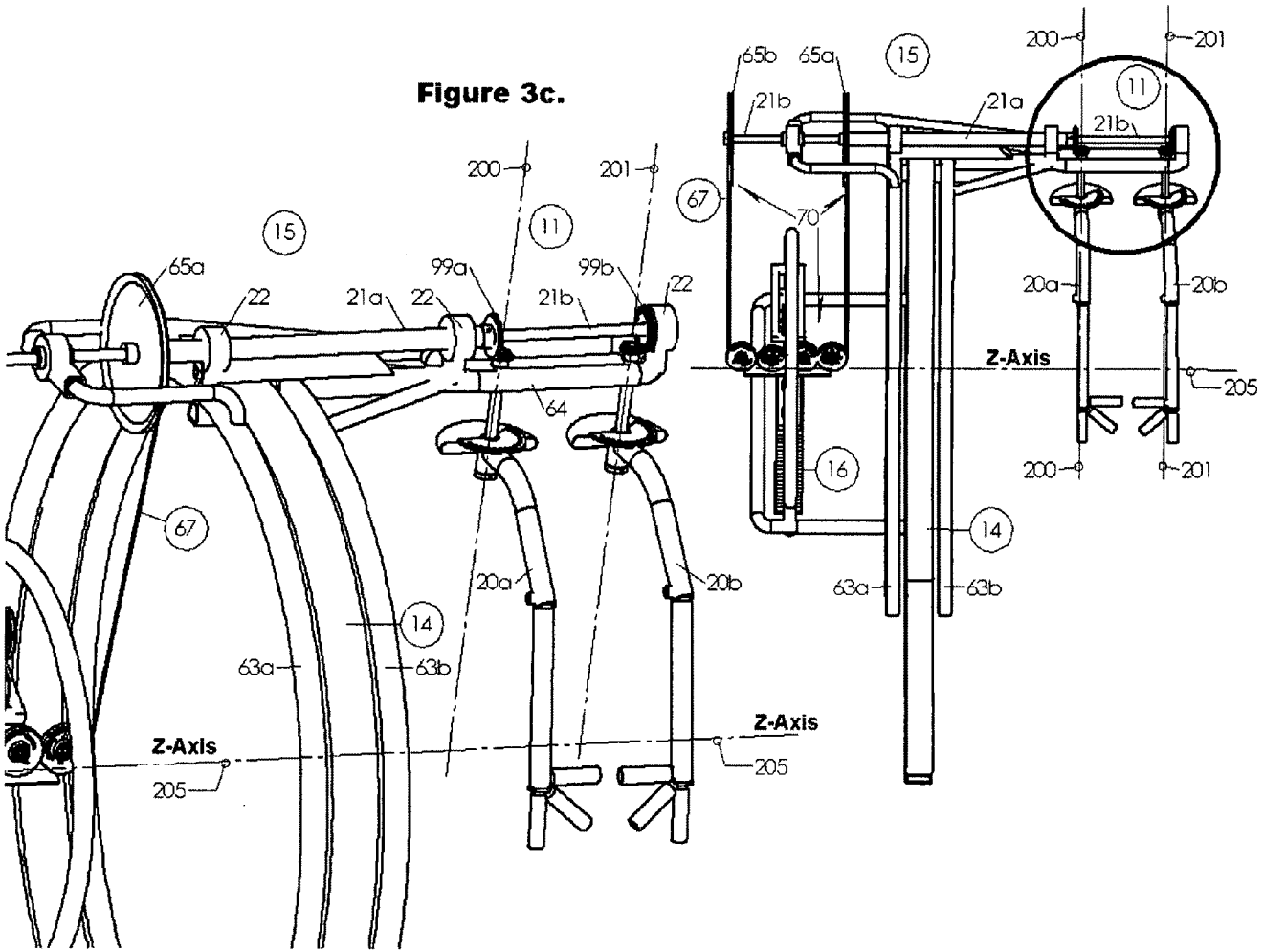
FIG. 3*c* provides (beginning in the lower left corner and proceeding clockwise) a schematic perspective view and a schematic overhead view of the z-axis embodiment of the present invention employing the concentric drive mechanism in FIG. 3*a*.

FIG. 3*c*. illustrates the concentric shaft drive mechanism implemented with a z-axis isolated multi-axis resistance device. This device employs similar and analogous components previously described, including arcuate guide 14, revolving assembly 15, angle-gearing components 99*a*, 99*b*, z-axis user interface assemblies 20*a*, 20*b*, and flexible linkage or other resistance mechanism. This device employs concentric drive shafts 21*a*, 21*b*, similar to those described for the compound concentric drive mechanism.

4. Compound Shoulder Multi-Axis Exercise Device—Employing Differential Drive

Figure 4:
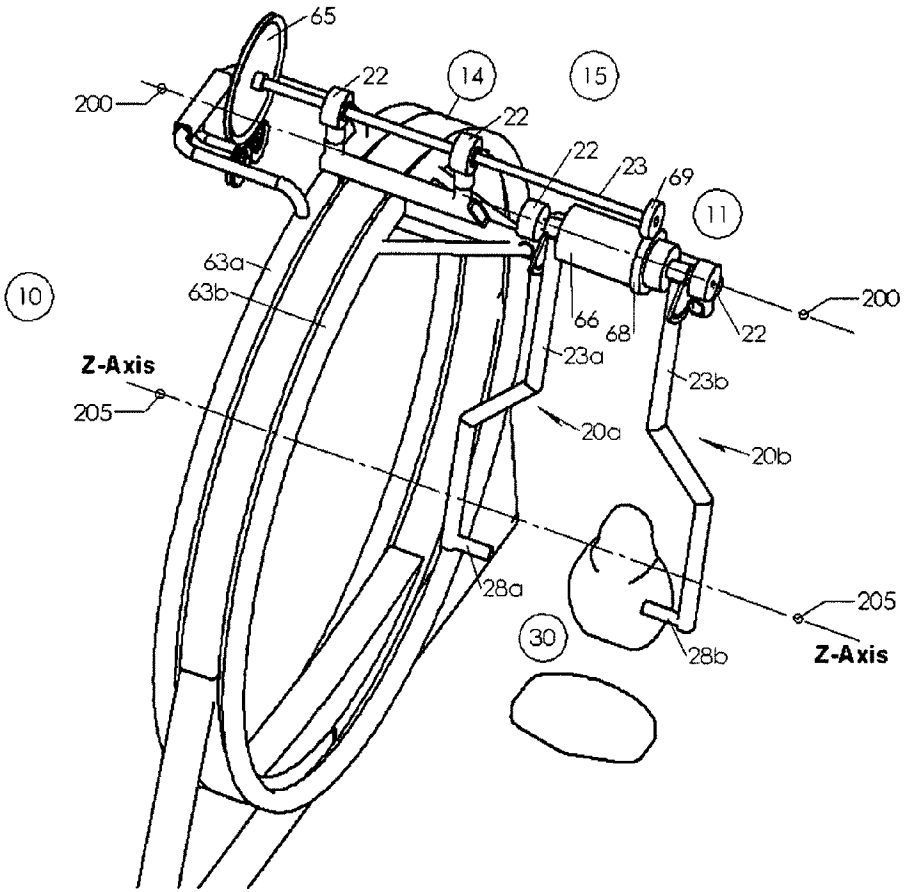

FIG. 4. shows a compound multi-axis exercise device employing a differential gear drive 66 instead of a flexible linkage differential pulley system as is employed in the compound concentric drive embodiment. In the present embodiment, independent, differential movement and resistance of right and left user interfaces is provided by direct drive differential gearing or equivalent.

This embodiment employs similar arcuate guide 14, revolving assembly 15, and revolving arc locking mechanism 40 as in the preferred embodiment. User interface levers 23*a*, 23*b* are similar to those in the compound concentric drive embodiment. Said right and left user interface levers 23*a*, 23*b* drive input shafts on opposing right and left sides of differential drive 66. Through the internal mechanics of differential gearing, the right and left user-generated moments of exercise are combined to drive the differential gear drive 66, and its housing. Ring gear 68 is substantially, concentrically mounted on housing of differential drive 66 (in this embodiment), and therefore, the combined user-generated moment of exercise drives differential gear drive housing and ring gear 68. Said ring gear 68 in turn meshes with and drives a take-off gear 69 (or pinion). Said take-off gear 69 is substantially, concentrically mounted on an offset shaft 23. Offset shaft 23 is mounted on overhead assembly 11 by way of bearings 22. Offset shaft 23 conveys the combined right and left user-generated moments of exercise to lifting pulley 65 which is mounted on the opposite end of offset shaft 23 in relation to take-off gear 69. Lifting pulley 65 winds a flexible linkage which may be routed through a tangent pivot tensioning pulley system 71 as in the preferred embodiment, or a fixed sagittal plane pulley tensioning system 72, or other tensioning system, to a weight stack 16 or other resistance mechanism. The axis of rotation of user interface drive shafts 200, 201 on either side of differential drive 66 can be adjustable to a different angle of exercise, especially within (but not limited to being within) a parallel or coplanar plane in relation to the plane of exercise, through the use of a gearbox, and/or open gearing, and/or a variable-moment-direction drive component, such as a flexible shaft, universal joint, or equivalent.

5. Free Flexible Linkage/Free Cable Multi-Axis Exercise Device

Figure 5:
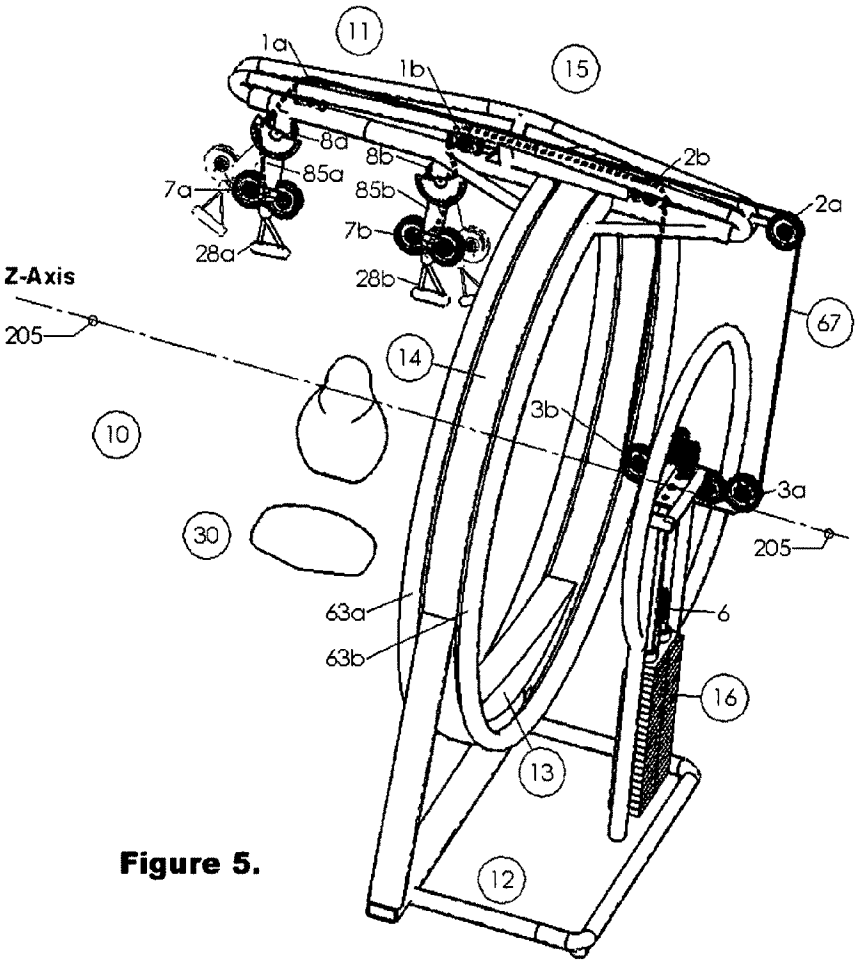
FIG. 5 provides a schematic perspective view illustrating a compound selectorized multi-axis embodiment employing a free flexible linkage such that there is no rigid user interface that is moved as a lever for actuating the resistance mechanism.

FIG. 5. shows a free flexible linkage embodiment of the present invention employing similar: (1) arcuate guide 14, (2) revolving assembly 15, (3) revolving arc locking mechanism 40, (4) selectorized resistance mechanism (weight stack 16), and (5) flexible linkage differential pulley mechanism 70 utilized in the preferred embodiment.

The difference between this and the preferred embodiment is apparent in the overhead assembly 11. In the free flexible linkage embodiment, right and left user interface assembly each comprise a user interface free handle 28*a*, 28*b* attached to the free end of a weighted flexible linkage 67. Flexible linkage 67 is routed from right and left free handles 28*a*, 28*b* through right and left centering pulley assembly 7*a*, 7*b*, through or around right and left overhead pivoting arm 85*a*, 85*b* and to right and left overhead pivot pulley 8*a*, 8*b*. From overhead pivot pulley 8*a*, 8*b*, flexible linkage 67 is routed through first right and left boom redirectioning pulleys 1*a*, 1*b* to second right and left boom redirectioning pulleys 2*a*, 2*b* and then through flexible linkage differential selectorized resistance mechanism 70 described previously in preferred embodiment. The free flexible linkage embodiment employs a free flexible linkage mechanism which differs from other embodiments in that there is no pivoting rigid arm (user interface) that is moved as a lever for actuating the resistance mechanism.

Turning to the function of the device, the user holds, pushes, and/or pulls the right and/or left free handles 28*a*, 28*b* in the opposite direction from the overhead assembly 11, regardless of the position of overhead assembly 11 on arcuate guide 14. The angle of the flexible linkage 67 (and therefore the angle of resistance force) in relation to the user can be manually adjusted in any given plane by changing the angle of the overhead pivoting arm 85*a*, 85*b*. To change angle of resistance for narrow or wide angle grip in both pushing and pulling exercise, the user disengages spring pin and index plate mechanism, moves overhead pivoting arm 85*a*, 85*b* to new angle, and then reengages spring pin and index plate mechanism (as described for selecting starting angle of user interfaces in preferred embodiment). (FIG. 7.B.3. shows a free flexible linkage embodiment with user interface handles and flexible linkages routed on either side of revolving arc. (All embodiments employing a wide diameter revolving arc (including compound and z-axis multi-axis devices) may utilize this design).

6. Radial and/or Lateral Stabilizer Mechanisms

Figure 6A:
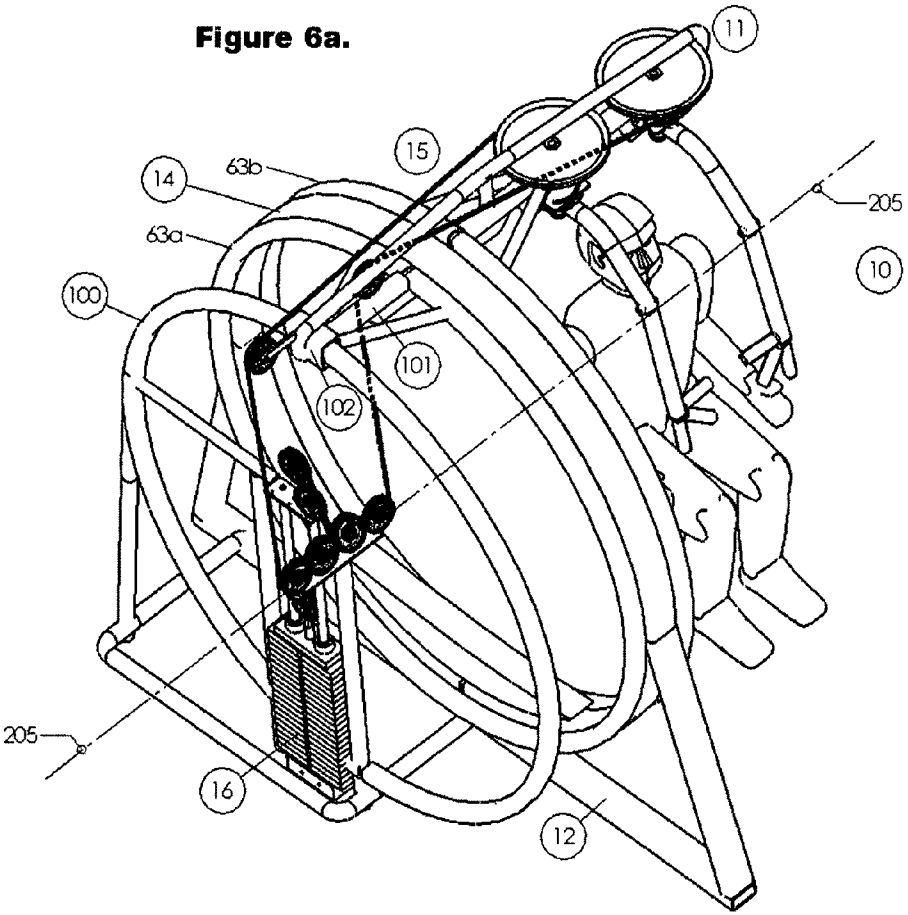
FIG. 6*a* provides a schematic perspective view illustrating the use of a horizontal outrigger boom stabilizer with an embodiment of the invention.
Figure 6B:
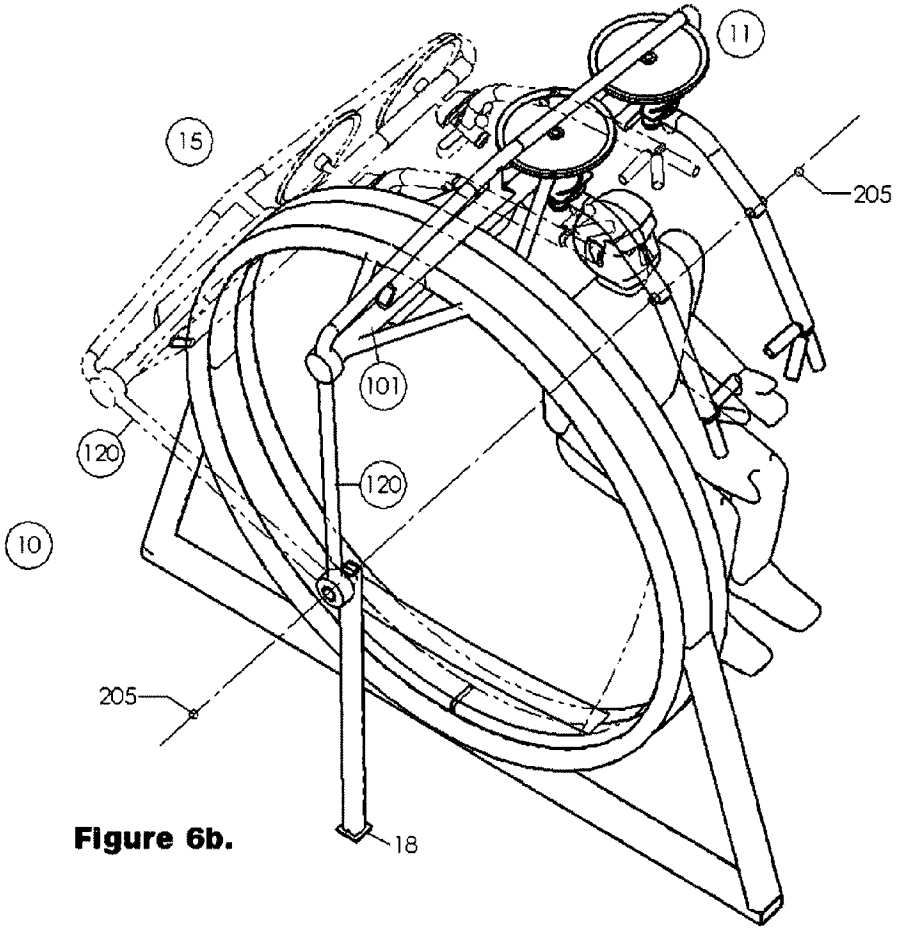
FIG. 6*b* provides a schematic perspective view illustrating the use of a radial stabilizer mechanism with an embodiment of the invention.
Figure 6C:
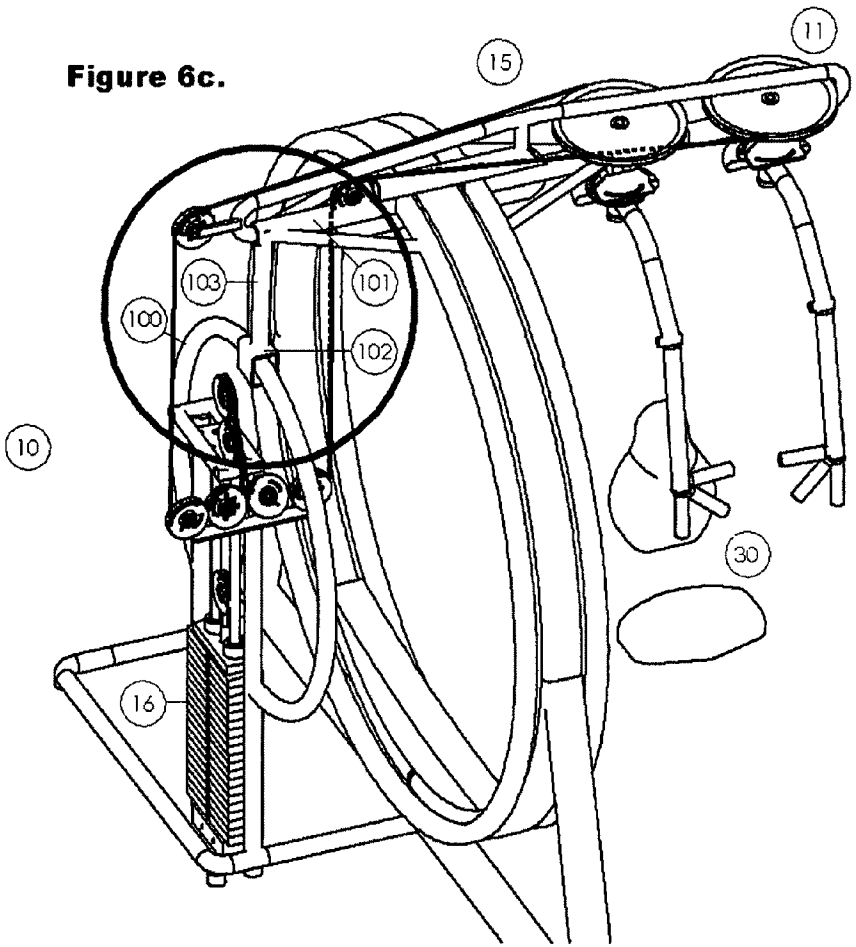
FIG. 6*c* provides a schematic perspective view illustrating the use of a short radial stabilizer mechanism with an embodiment of the invention.

FIGS. 6*a*-*c*. show three stabilizing mechanisms for providing radial and lateral stability to the wide diameter revolving arc structure. FIG. 6*a*. illustrates a horizontal outrigger boom stabilizer 101. Outrigger stabilizer 101 substantially supports on its lateral end, a roller assembly 102. Outrigger stabilizer 101 extends to a stationary, concentric and parallel arcuate guide 100. Said parallel arcuate guide 100 is substantially mounted on base 12 or on fixed structural element(s) of the device. Roller assembly 102 rolls on parallel arcuate guide 100. Roller assembly 102 acts as a mobile, radial and lateral attachment for outrigger stabilizer 101. FIG. 6*b*. shows a radial stabilizer mechanism 120 which pivots on the revolving axis 205 of the revolving assembly 15 of the device. Radial stabilizer 120 is substantially fixed, or can be pivotally fixed, to outrigger boom 101, or to revolving arc. FIG. 6*c*. illustrates a short radial stabilizer mechanism 103. The short radial stabilizer 103 is substantially fixed to and extends radially from the outrigger boom 101. Substantially fixed to the distal end of short radial stabilizer 103 is a roller assembly 102, which rolls on a stationary, concentric and parallel arcuate guide 100. Roller assembly 102 thereby represents a mobile, radial and lateral attachment for outrigger stabilizer 101.

7. Rail/Channel and Roller Embodiments

A. Single Circular Arc/Rail/Channel/Roller System;

B. Double Circular Arc/Rail/Channel/Roller System.

A. A roller channel system is employed as the conveying system for the revolving assembly in the previous embodiments, but various roller systems can be employed for a revolving arc mechanism. For example, FIG. 7.A.1*a*. shows a single revolving arc 63 that rolls concentrically on the inner surface of the stationary circular arcuate guide 14 by way of rollers 62. Rollers 62 are mounted on inner surface of arcuate guide 14 with axis of rotation parallel to the revolving axis 205 of revolving arc 63. Rolling surfaces of rollers 62 are congruent with the outer surface of the revolving arc 63. Three or more rollers 62 capture the revolving arc 63 within the circular arcuate guide 14 in this embodiment. Alternatively, rollers 62 may be mounted on outer surface of revolving arc 63, and roll in a track mounted on or formed by inner surface of arcuate guide 14. Notice the triangular pattern 150 of the rollers in the side view. Boom 64 is substantially mounted on revolving arc 63 and/or boom mounting plate 81. Revolving arc counterweight 13 counterbalances the weight of overhead assembly 11. Revolving arc 63 may incorporate spokes 82 in order to increase rigidity of the structure, as in FIG. 7.A.1*b*.

FIGS. 7.A.2.-7.A.4. show other possibilities. FIG. 7.A.2. shows a similar single revolving arc mechanism incorporating an offset center pivot mechanism. A bearing post substantially mounted at intersection of spokes 82, having cylindrical axis collinear with the revolving axis 205, and projecting laterally from spokes 82, revolves in a stationary center pivot component such as a bushing or bearing 22. Said bushing/bearing 22 is substantially mounted on a fixed structural element of the device, which provides a stationary point of rotation that is concentric but offset from the plane of the revolving arc 63 of revolving assembly 15. This offset configuration of the center pivot point triangulates forces generated during operation and provides added stability. FIG. 7.A.3. shows a single revolving arc mechanism with offset center pivot mechanism, but employs an arcuate guide 14 that is not a full circle. In this embodiment, rollers substantially mounted on arcuate guide 14 capture revolving arc 63 in the plane of revolving arc 63 and the plane of arcuate guide 14, on both inner and outer sides of the arc. Notice in this embodiment as well, there is a triangular base of support 150 for the revolving arc. Finally, FIG. 7.A.4. illustrates an embodiment utilizing single revolving arc mechanisms, one on each side of user station 30, termed bilateral revolving arcs 63*a*, 63*b*.

B. FIG. 7.B.1. illustrates a double revolving arc and roller mechanism. As in other embodiments, the revolving arc 63 is captured by rollers 62. Rollers 62 are substantially mounted within roller assembly 83(1), 83(2) on arcuate guide 14. The illustration shows this embodiment employing a radial stabilizer 120. Radial stabilizer 120 is also illustrated in FIG. 6*b*. FIG. 7.B.2. shows a double revolving arc and roller mechanism employing a free flexible linkage mechanism with an outrigger boom stabilizer 101 and offset concentric parallel arcuate guide 100, as illustrated in FIG. 6*a*. FIG. 7.B.3. shows a free flexible linkage embodiment with double revolving arc mechanism, with user interfaces mounted on either side of revolving arc. FIG. 7.B.4. shows twin double revolving arc and roller mechanisms. These revolving arcs are mounted by way of rollers on arcuate guides as in previous embodiments, but further, they are mounted concentric to each other in parallel planes on one side of the user station (unilateral revolving arc configuration). This configuration of revolving arcs provides added lateral stabilization of revolving and drive components.

8. Polygonal Structural Support

Revolving assembly embodiments have been described as being mounted on and supported by an arcuate guide that is physically arc-shaped. But the arcuate guide may be virtually arc-shaped in the present invention since roller/conveying/structural support elements may be positioned in a polygonal or linear pattern or array.

Figure 8A:
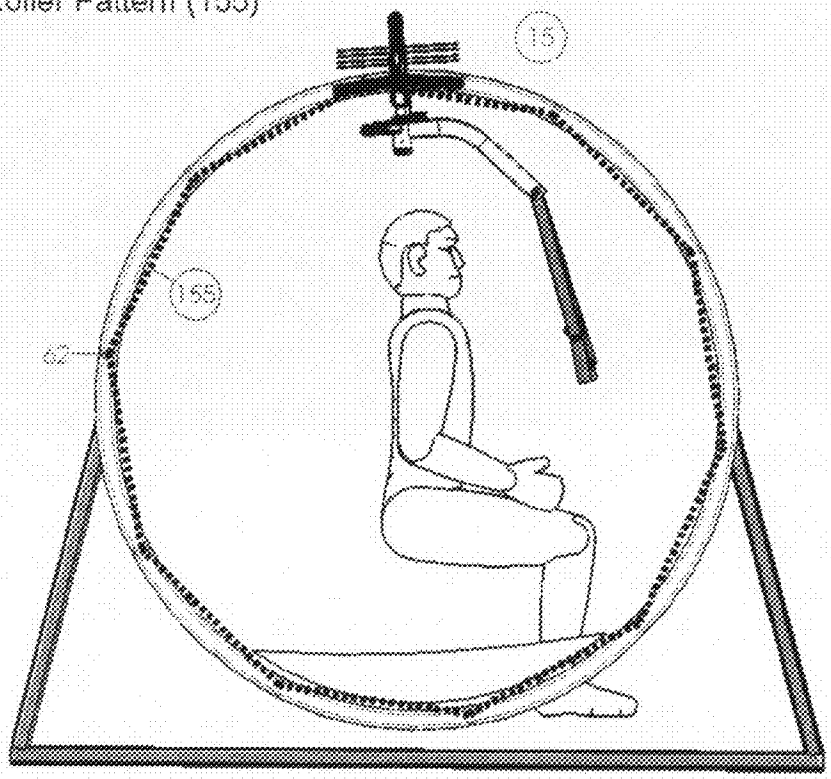
FIG. 8*a* provides a schematic side view of the preferred embodiment illustrating a decagonal array of conveying/structural support elements.
Figure 8B:
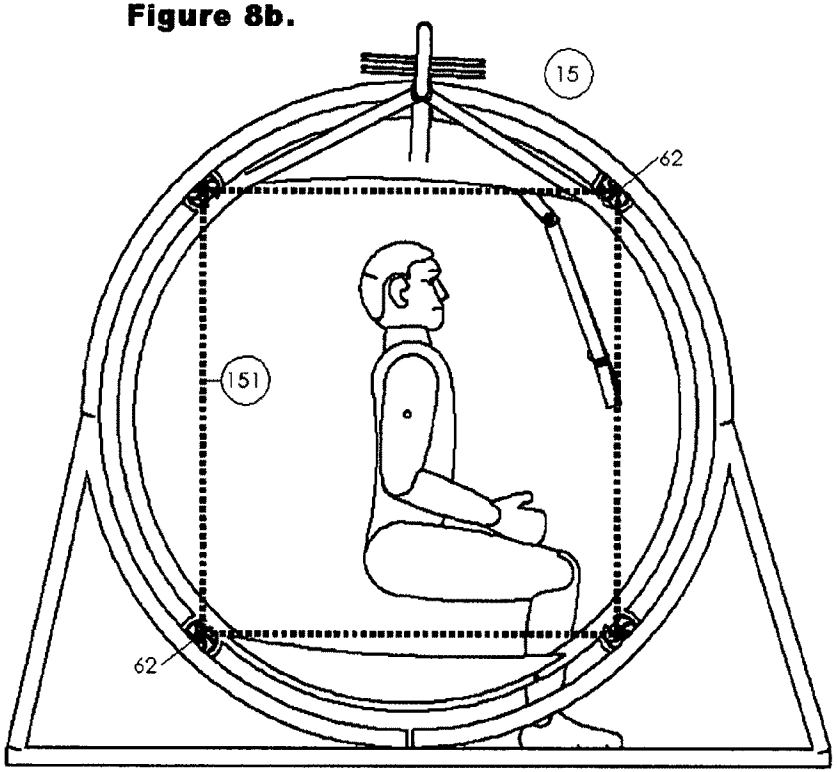
FIG. 8*b* provides a schematic side view of an embodiment illustrating an equilateral rectangular array of conveying/structural support elements.
Figure 8C:
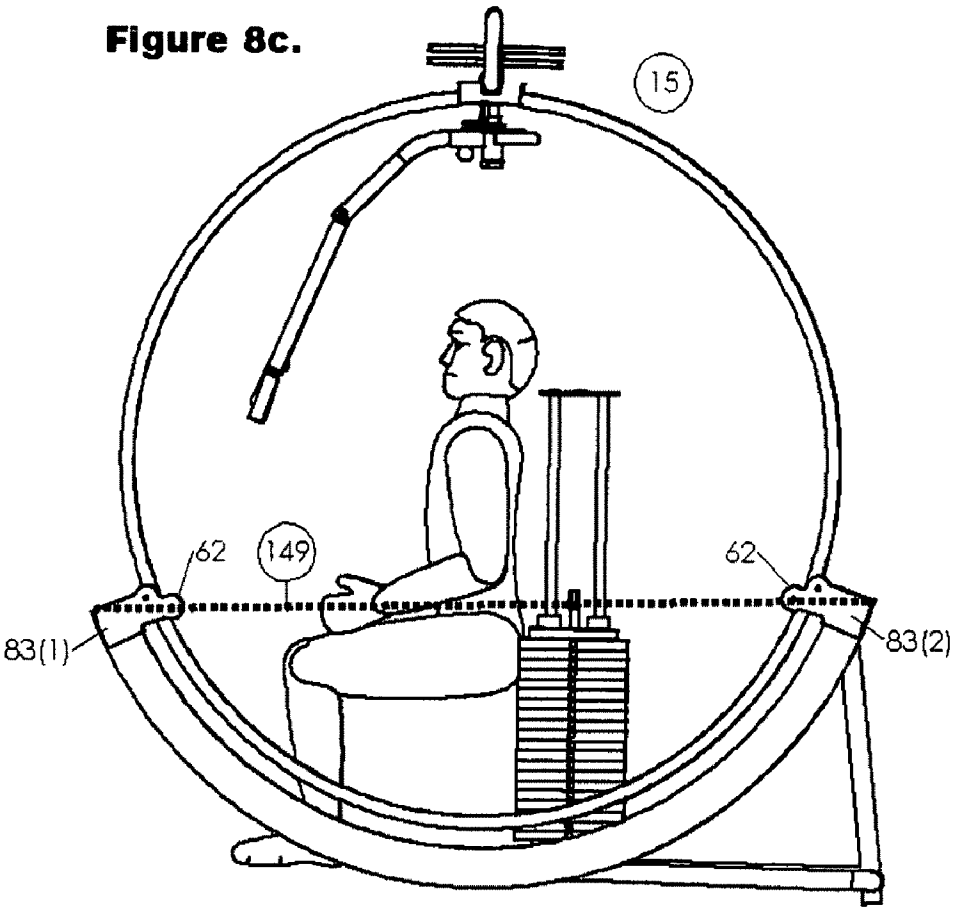
FIG. 8*c* provides a schematic side view of an embodiment having a double revolving arc mechanism with a linear array of conveying/structural support elements.

The actual shape or pattern of the arcuate guide is a polygonal construct of conveying (e.g. roller-bearing) components with the number of sides equal to the number of components in the array. FIG. 8*a*. shows the preferred embodiment from a side view with a decagonal array 155 of conveying/structural support elements—rollers 62 in this case. FIG. 8*b*. shows a revolving structure with a rectangular array 151 of conveying/structural support elements. FIGS. 7.A.1*a*. and 7.A.3. show revolving structures with triangular arrays 150 of conveying/structural support elements. If only two roller-bearing components or assemblies are employed, the pattern forms a line segment. FIG. 8*c*. shows a double revolving arc mechanism with a linear array of conveying/structural support elements composed of rollers 62 comprising roller assemblies 83(1), 83(2).

Figure 16A:
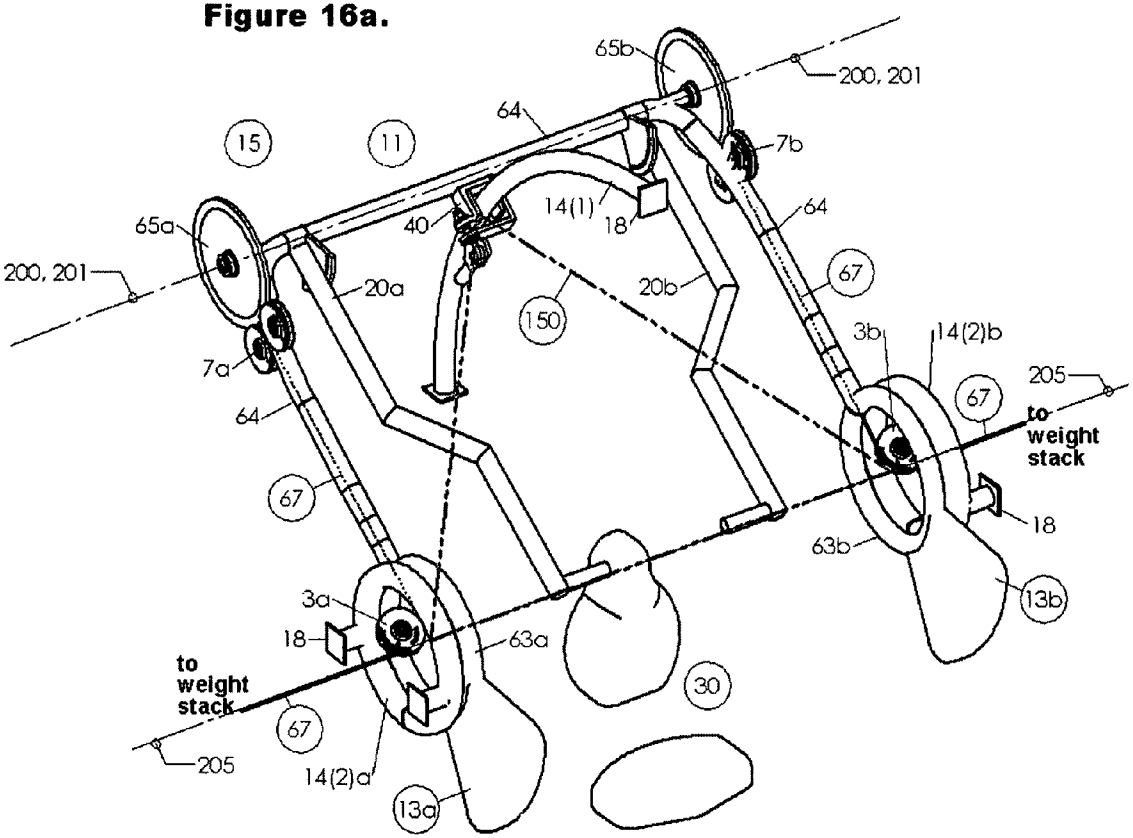
FIG. 16*a* provides a schematic perspective view of a multi-axis narrow diameter revolving arc compound shoulder resistance exercise embodiment of the present invention.

Polygonal structural support may also be provided by pivoting components such as bushings, and by locking mechanisms. FIGS. 16*a*. and 17*a*. illustrate triangular polygonal support 150 provided by pivoting components (e.g. bearings/bushings 22) in combination with locking mechanisms 40. FIGS. 19*a-d*. show polygonal structural supporting elements (triangular 150 and decagonal 155) at right angles to one another. Polygonal support for functional components provides maximal structural strength, particularly when triangulated structures are implemented.

9. Compound Lower Body Multi-Axis Exercise Device

Figure 9:
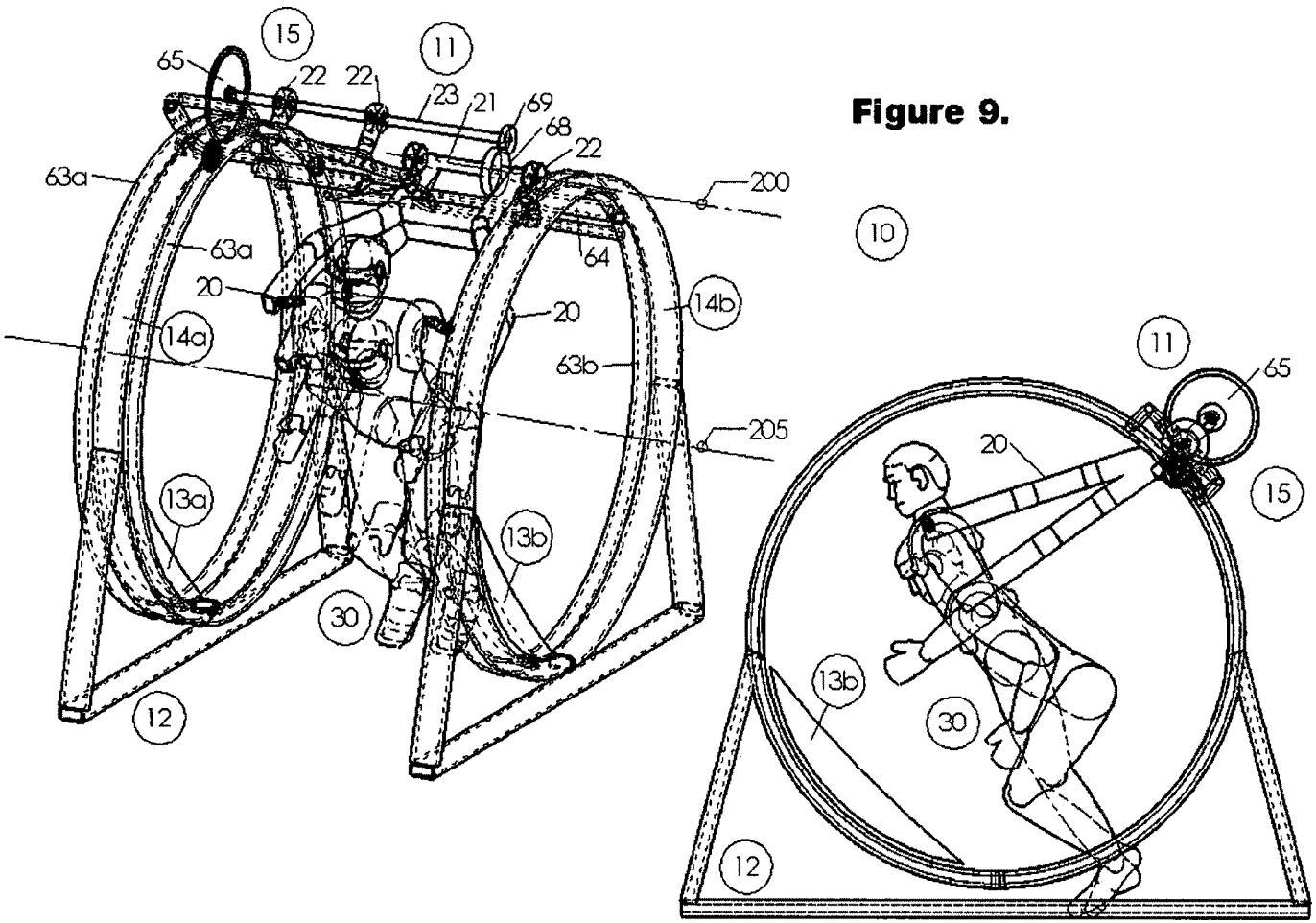
FIG. 9 provides (beginning on the left and proceeding to the right) schematic perspective and side views of a compound lower body exercise embodiment of the present invention.

FIG. 9. shows a compound lower body exercise embodiment of the present invention. The revolving axis 205 of the revolving assembly 15 is parallel to the z-axis of hip joint motion (analogous and parallel to the z-axis of shoulder motion) of a user positioned in the user station 30. The axis of rotation of the user interface 200 in this embodiment is approximately parallel to the z-axis of hip joints of the user as well. Referring to FIG. 9. in detail, the compound lower body machine employs similar arcuate guides 14*a*, 14*b*, and revolving assembly 15 utilized in the preferred embodiment. The difference in this device and the preferred embodiment is apparent in the overhead assembly 11 and revolving arcs 63, which are dependent, co-revolving and fixed to one another by boom 64, concentric/parallel/bilateral, and designated right and left 63*a*, 63*b*. Each right and left revolving arc 63*a*, 63*b* is mounted on each corresponding right and left arcuate guide 14*a*, 14*b* on either side of user station 30 (i.e. bilaterally) by way of rollers, as in previous embodiments. Overhead assembly 11 is substantially fixed to bilateral revolving arcs 63*a*, 63*b* by way of boom 64. Bilateral revolving arcs 63*a*, 63*b*, revolving arc counter weights 13*a*, 13*b*, boom 64, and overhead assembly 11 together revolve as a unit about revolving axis 205 and are termed revolving assembly 15. The overhead assembly 11 on this embodiment includes a user interface assembly 20 for compound lower body exercise, and consists of a lever capable of accommodating the upper body/shoulders of the user. User interface assembly 20 includes a single user interface drive shaft 21.

FIG. 9. also shows a user actuating the user interface assembly 20 by extending hips and knees. User interface assembly 20 drives ring gear 68, which is concentrically fixed on user interface drive shaft 21. Said ring gear 68 meshes with and drives offset gear 69 and offset shaft 23. Offset shaft drives drive pulley 65, which is concentrically mounted on opposite end of offset shaft 23 in relation to offset gear 69. Drive pulley 65 winds flexible linkage which is routed through tension pulley system previously described and ultimately to resistance mechanism/weight stack 16. The compound lower body embodiment can be implemented utilizing bilateral revolving arcs as illustrated, or with similar unilateral revolving arc/assembly described in preferred embodiment.

10. Y-Axis/Multi-Axis Exercise Machine

Figure 10A:
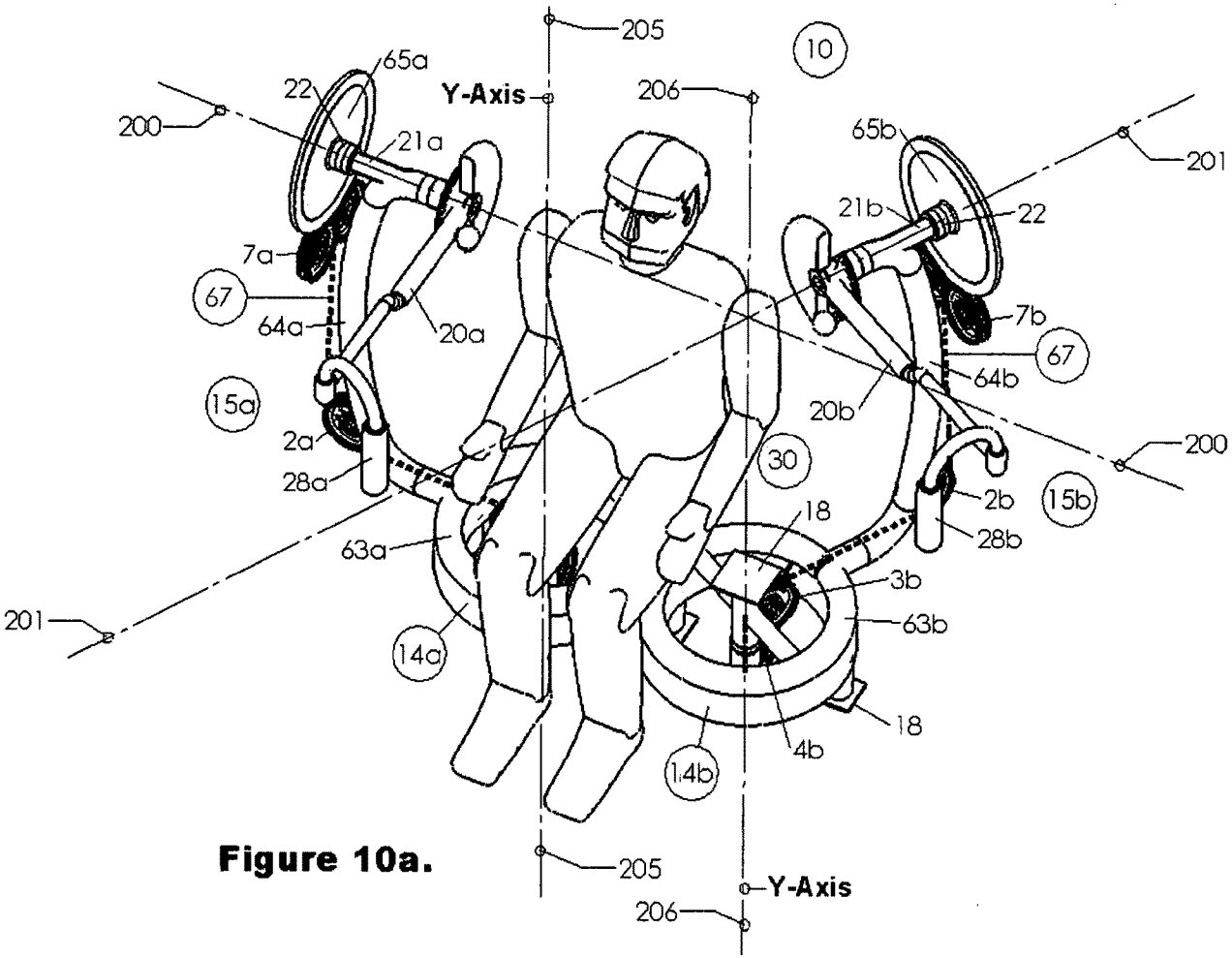
FIG. 10*a* provides a schematic perspective illustration of a y-axis embodiment of the present invention.
Figure 10B:
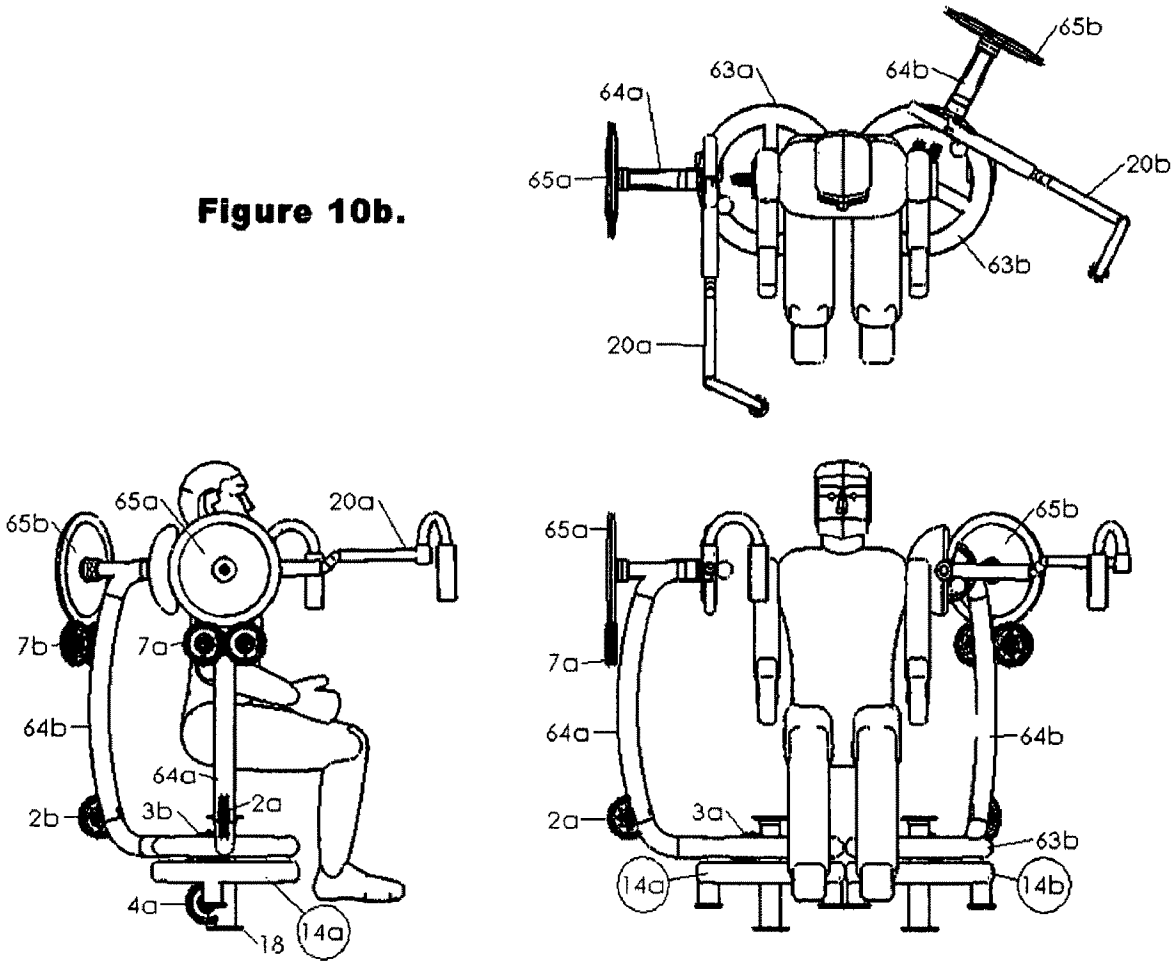
FIG. 10*b* provides (beginning in the lower left corner and proceeding clockwise) schematic side, top and frontal views of the y-axis embodiment the present invention.
Figure 10C:
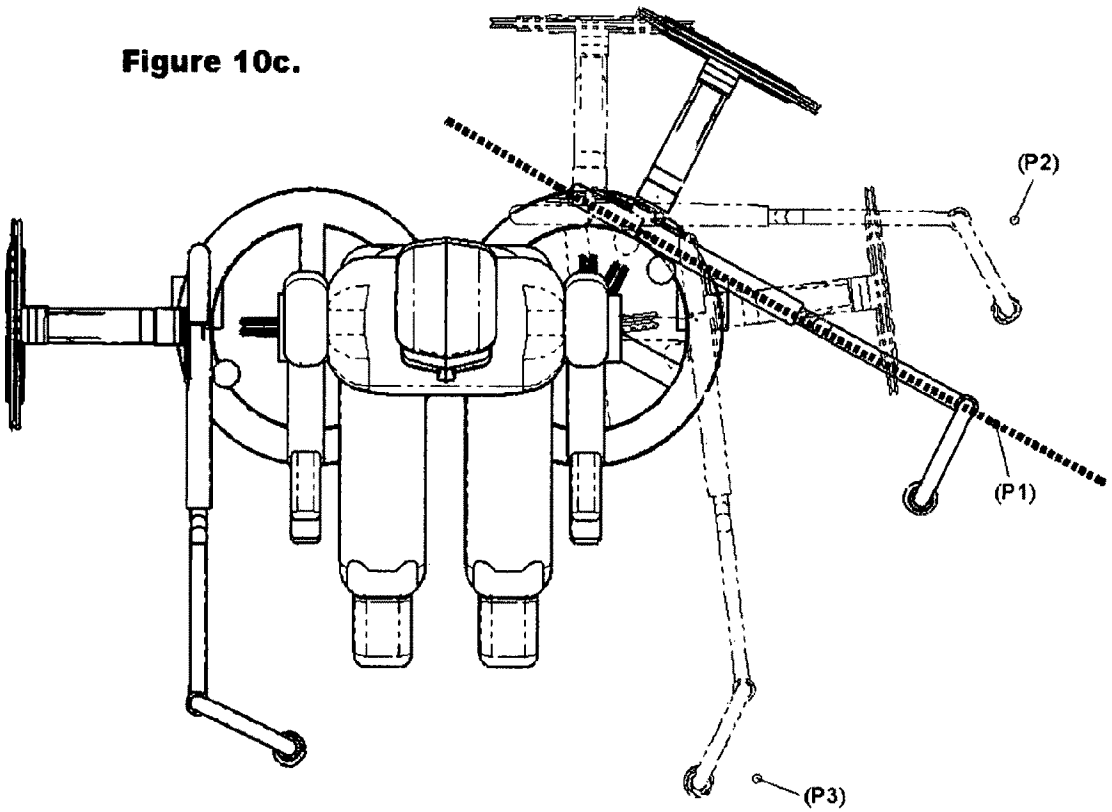
FIG. 10*c* provides a schematic top view of the y-axis embodiment of the present invention illustrates some of the potential number of planes of exercise that are possible on this device (in edge-on orientation).

FIGS. 10*a-e*. are illustrations of the y-axis embodiment of the present invention. The embodiment is named for the right and left shoulder y-axis of a user positioned in the user station 30 of the device, which said right and left y-axis of the user are aligned in (or approximately in) a collinear relationship with the corresponding right and left revolving axis 205, 206 of the device. The right and left axes of rotation of the user interfaces 200, 201 intersect the corresponding shoulder joints of the user during operation, and are perpendicular to the corresponding right and left revolving axes 205, 206. This embodiment provides isolated shoulder resistance exercise in any of the infinite radial planes of motion passing through the y-axis of shoulder movement. FIG. 10*c*. illustrates some of the potential planes of exercise that are possible on this device (in edge-on orientation).

Figure 10D:
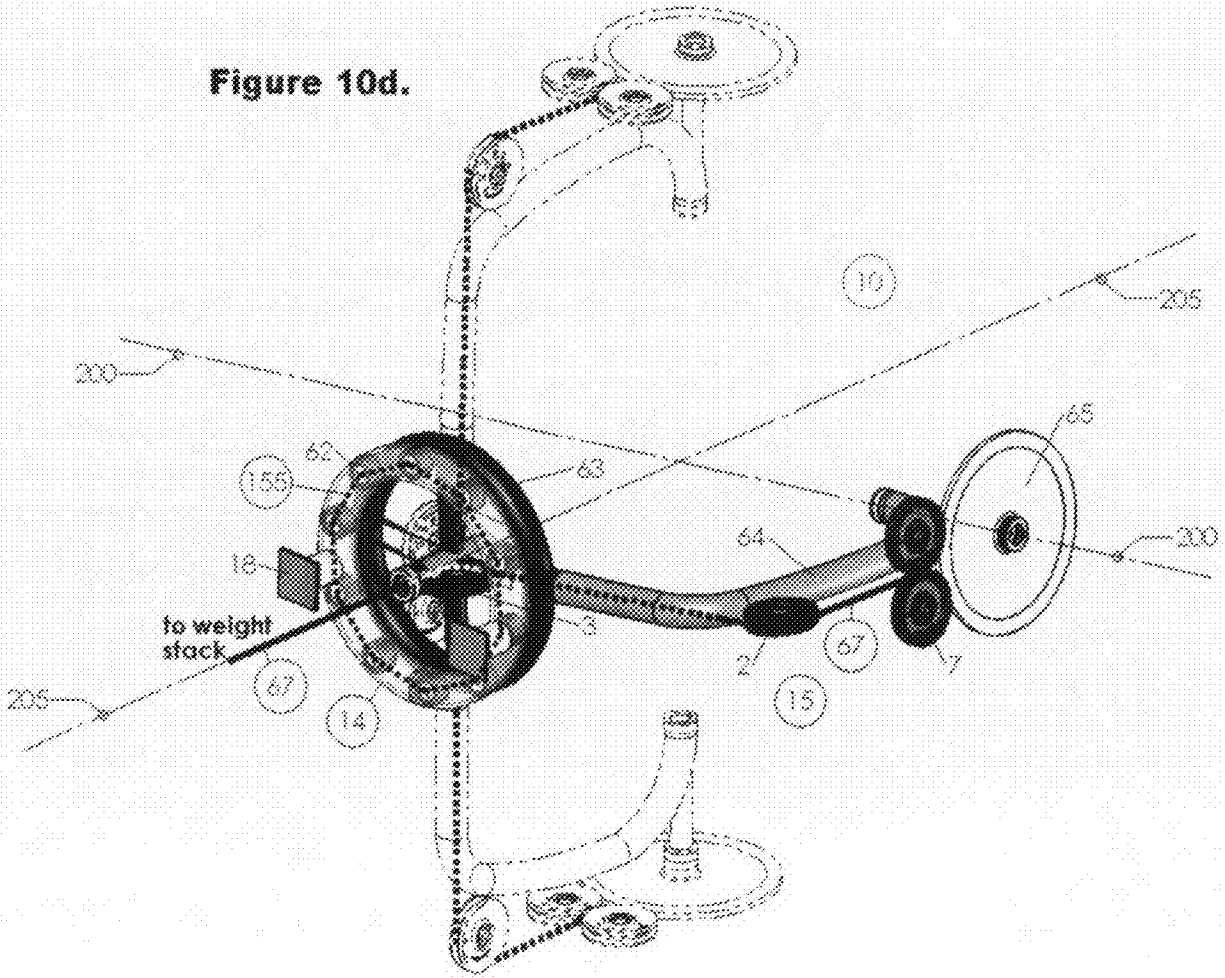
FIG. 10*d* provides a schematic bottom perspective view of the left revolving assembly structure of the y-axis embodiment of the present invention, providing a detailed view of the narrow diameter revolving arc roller system with decagonal roller pattern and a range of positions of the revolving assembly.
Figure 10E:
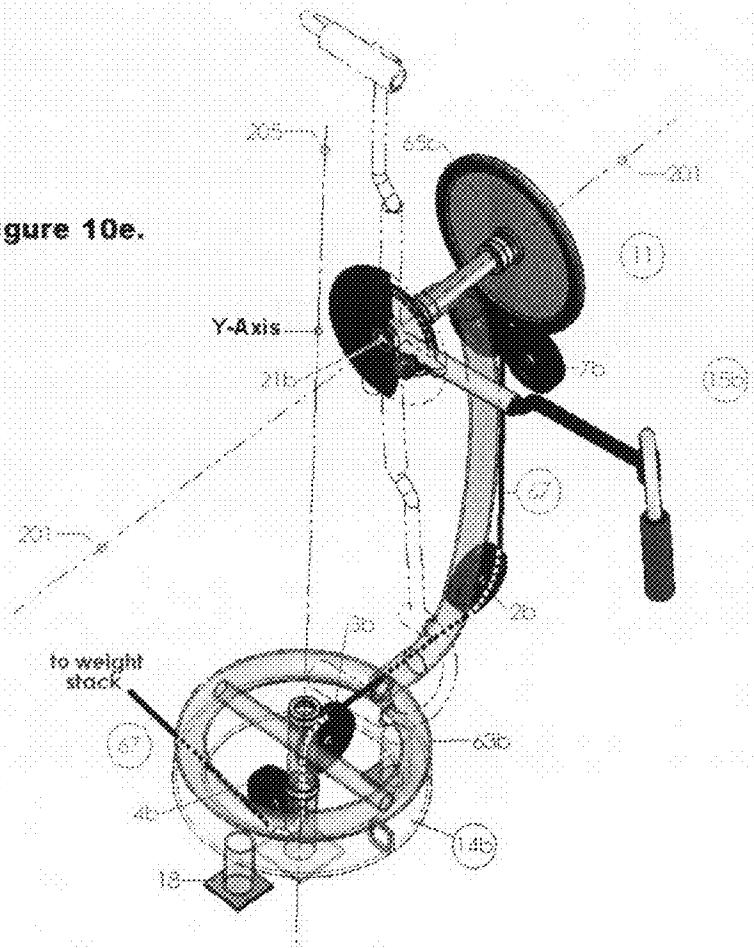
FIG. 10*e* provides a schematic perspective view of the left revolving assembly structure of the y-axis embodiment of the present invention, providing a detailed view of the flexible linkage tensioning/routing mechanism and the range of the user interface.

Unlike those previously described, this is a nonconcentric, bilateral, independent revolving arc mechanism (but can be implemented with revolving arcs/assemblies that revolve dependently in relation to one another). The y-axis embodiment employs two mirror image nonconcentric revolving assembly structures 15*a*, 15*b* mounted on base 12 and/or fixed structural elements of the frame. Left revolving assembly structure 15*b* is illustrated in FIGS. 10*d-e*. By employing two independent mirror image revolving assemblies 15*a*, 15*b*, independent adjustment of the plane of exercise is made possible for right and left user interfaces. Because of the narrow width of the diameter of the revolving arcs 63*a*, 63*b* in this embodiment, this is referred to as a narrow diameter revolving arc assembly.

Turning to FIG. 10*a-b*. in detail, number 10 designates the exercise machine in accordance with the present invention. The apparatus 10 comprises a base adapted to rest on a supporting surface, as in previously embodiments. A pair of horizontal supports which also serve the function of stationary right and left arcuate guides 14*a*, 14*b* are secured to the base, and/or to fixed structural element(s), and/or to the floor at fixed points 18. Fixed points 18 are represented in the drawings as square pads or plates and represent structural points that are one of substantially grounded or substantially fixed to the base or a stationary structural element of the frame of the device. Fixed points 18 in the drawings are fixed in space and in relation to each other. A resistance mechanism, such as a weight stack 16, is also secured to the base. Weight stack 16 is operationally connected via a flexible linkage 67 (routed through pulleys) to a pair of user interface assemblies 20*a*, 20*b*, providing resistance to motion thereof. Mounted on the base and/or on the arcuate guide 14*a*, 14*b* is a user station/seat 30, as described in previous embodiments.

Turning to the active or working portions of the y-axis embodiment, the exercise machine 10 comprises a right and left stationary arcuate guide 14*a*, 14*b*, the centerlines of which are collinear with the y-axis of motion of the corresponding right and left shoulder(s) of a user seated in the user station 30, and said centerlines are termed the right and left revolving axes 205, 206 of revolving assemblies 15*a*, 15*b*. The stationary arcuate guides 14*a*, 14*b* are the structural supports for the revolving functional components of the device (i.e. the revolving assemblies 15*a*, 15*b*). The y-axis right and left revolving assemblies 15*a*, 15*b* are comprised by right and left: (1) revolving arcs 63*a*, 63*b*, (2) booms 64*a*, 64*b*, (3) user interface assemblies 20*a*, 20*b*, and (4) flexible linkage differential system 70. Revolving arcs 63, are independent, coplanar (or virtually coplanar), and designated right and left 63*a*, 63*b*. Revolving arcs 63*a*, 63*b* are mounted concentrically on corresponding right and left arcuate guides 14*a*, 14*b*. Therefore, revolving arcs 63*a*, 63*b* are concentric with (and revolve about) the corresponding right and left revolving axes 205 and 206, and are therefore concentric with the y-axis of the positioned user's corresponding right and left shoulder(s).

Arcuate guides 14*a*, 14*b* are made from metal tubing or channel having cross-sectional or inner dimensions and shape congruent with the cross-sectional, surface, and/or outer dimensions and shape of rollers 62. Rollers 62 are mounted on the planar side(s) of the revolving arcs 63*a*, 63*b* in a polygonal and/or circular pattern, as illustrated in FIG. 10*d*. Said polygonal and/or circular pattern has diameter similar to the diameter of arcuate guides 14*a*, 14*b*.

Centerlines of rotation of rollers 62 are oriented parallel to the revolving axes 205 and 206 as illustrated in FIG. 10*d*., but centerlines of rollers 62 may be oriented radially (or otherwise) in relation to revolving axes 205, 206. Rollers 62 roll within the confines of congruent inner surfaces of channel of arcuate guides 14*a*, 14*b*. Thereby, when revolving arcs 63*a*, 63*b* are in functional position as illustrated, arcuate guides 14*a*, 14*b* provide a "gliding path" along or over which revolving arcs 63*a*, 63*b* and entire revolving assembly 15*a*, 15*b* glide, roll, or revolve about the corresponding revolving axes 205, 206.

User interface assemblies 20 provide isolated shoulder resistance, in planes radial to the y-axis, and are designated right and left 20*a*, 20*b*. Right and left user interface assemblies 20*a*, 20*b* are comprised by corresponding right and left: (1) lifting or drive pulleys 65*a*, 65*b*, (2) user interface drive shafts 21*a*, 21*b*, (3) handles 28*a*, 28*b*, and (5) user interface spring pin and index plates as described.

Boom 64*a*, 64*b* is substantially fixed to revolving arc 63*a*, 63*b*. User interface assembly 20*a*, 20*b* is mounted on distal end of boom 64*a*, 64*b*. Boom 64*a*, 64*b* holds bearings 22 that provide rotational freedom to user interface assembly 20*a*, 20*b* about axes 200 and 201, but otherwise fix user interface assemblies 20*a*, 20*b* and axis of rotation 200 and 201: (1) in relation to boom 64*a*, 64*b* (but user interface assemblies 20*a*, 20*b* and their axes of rotation 200 and 201 can be adjustable (as with a flexible shaft, universal joint or equivalent) in relation to boom 64*a*, 64*b* in this and other embodiments), and (2) at right angle to y-axis of shoulder of a user (regardless of the angle of rotation of revolving assembly 15*a*, 15*b* about revolving axis 205, 206 (i.e. regardless of plane of exercise)). Because revolving assemblies 15*a*, 15*b* move independently in the y-axis embodiment, user interface axes of rotation 200, 201 may not be, and usually are not symmetrically aligned when the machine is in use.

Figure 13A:
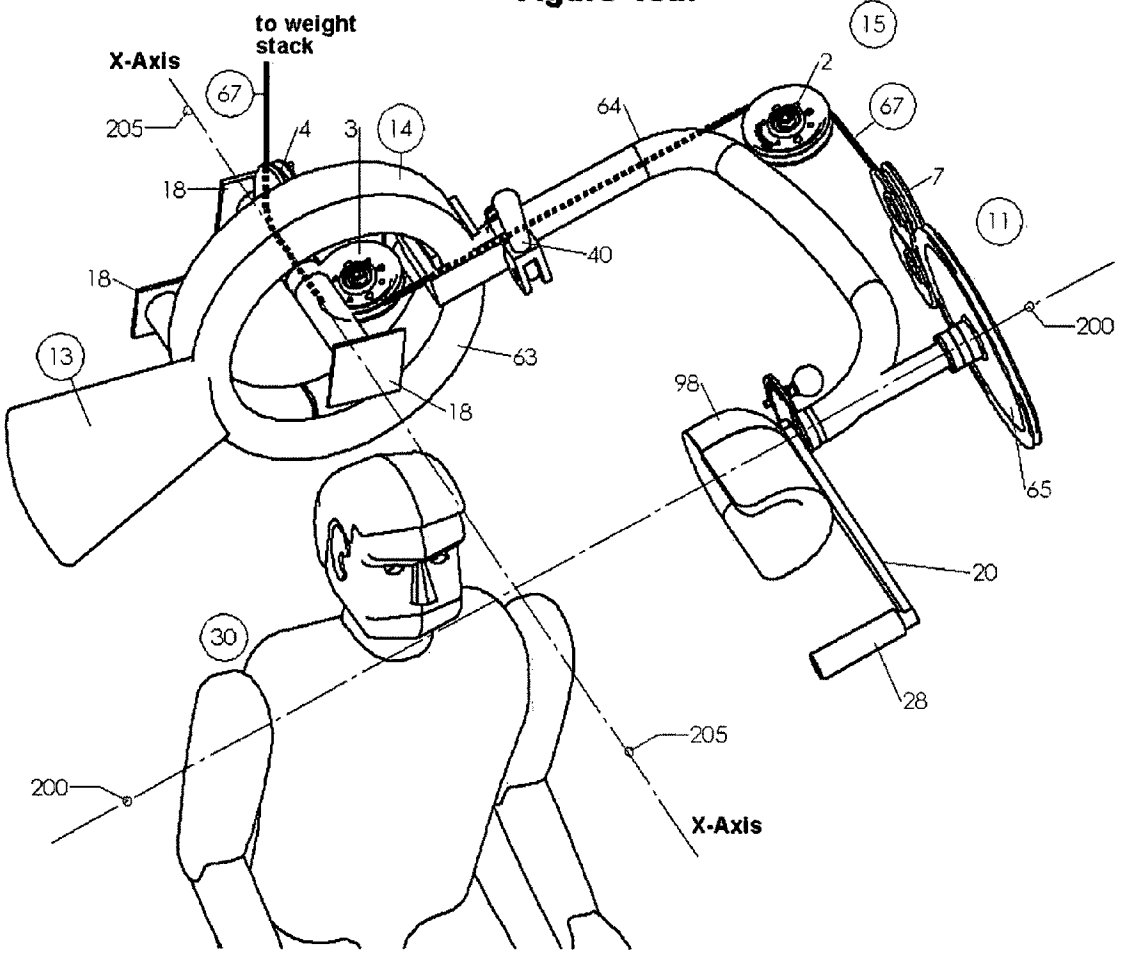
FIG. 13*a* provides a schematic perspective view of a narrow diameter revolving arc shoulder rotation multi-axis resistance exercise embodiment of the present invention.
Figure 13B:
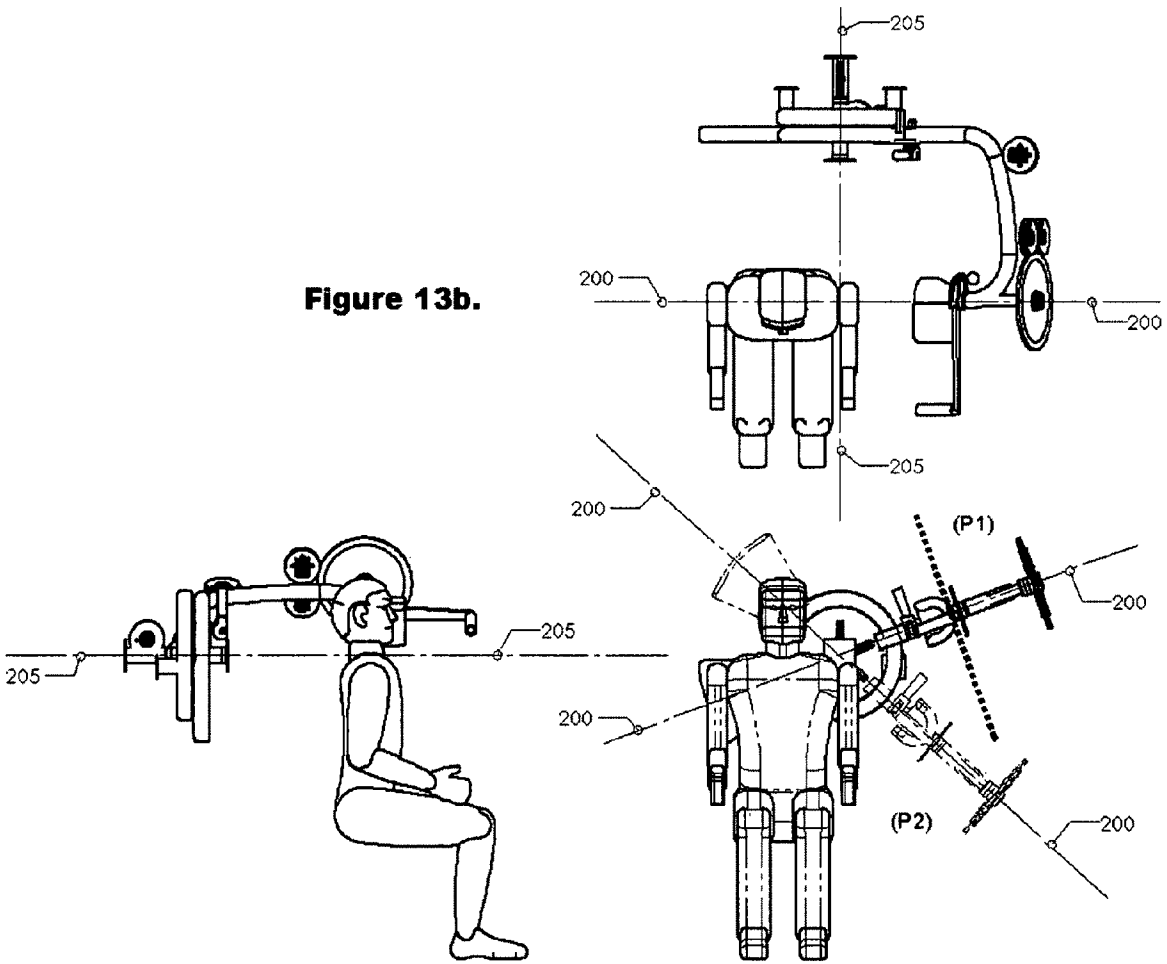
FIG. 13*b* provides (beginning in the lower left corner and proceeding clockwise) schematic side, top and frontal views of the shoulder rotation multi-axis resistance exercise embodiment of FIG. 13*a*.
Figure 13C:
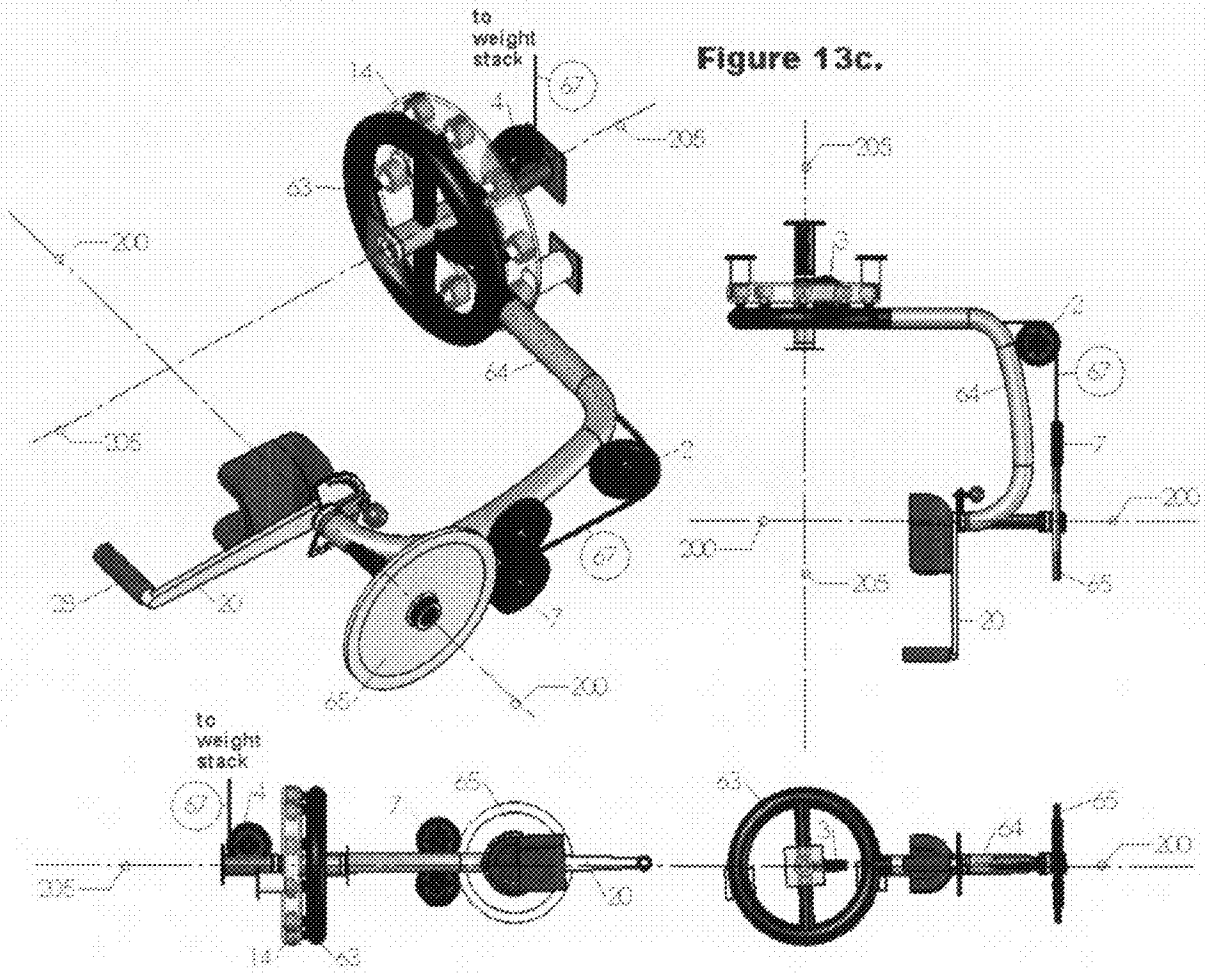
FIG. 13*c* provides (beginning in the upper left corner and proceeding clockwise) a schematic perspective view, top view, back view, and side view providing further detail with regard to user interface range in the shoulder rotation multi-axis resistance exercise embodiment of FIG. 13*a*.
Figure 13D:
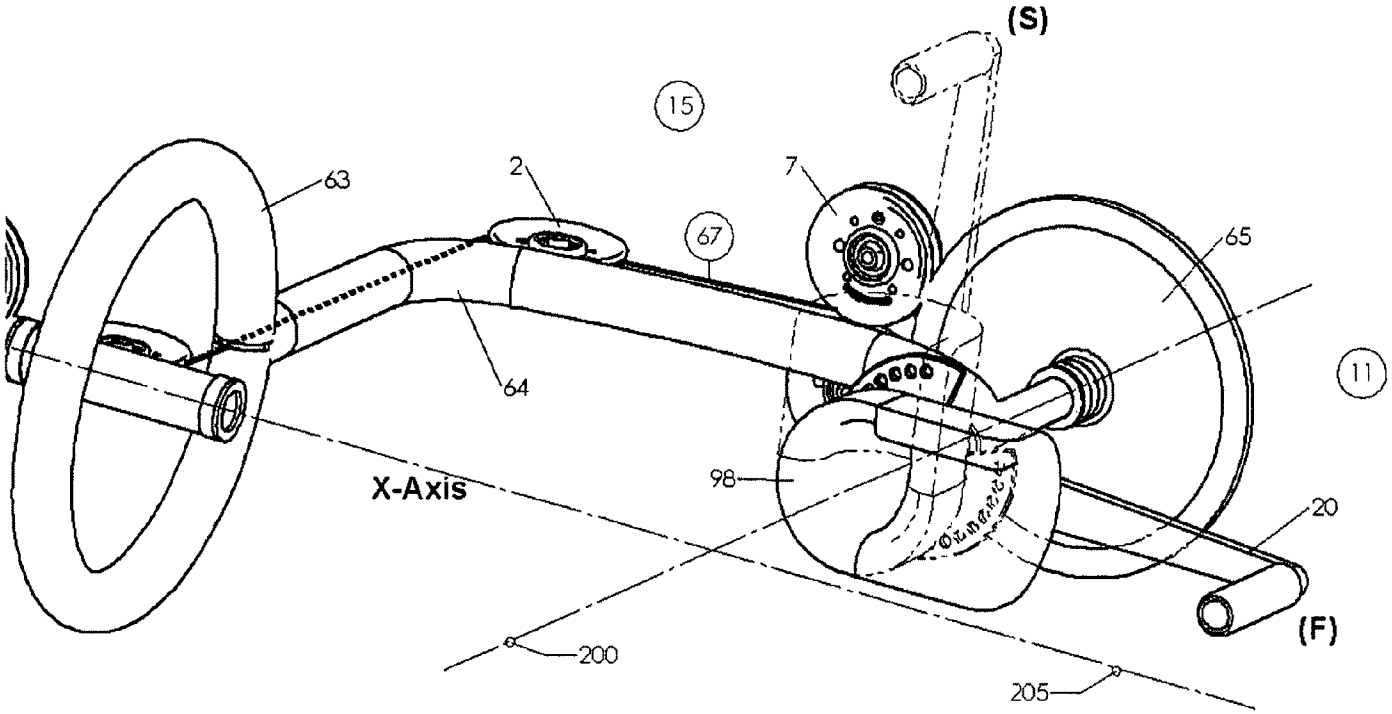
FIG. 13*d* provides a schematic perspective view showing a start (S) and finish (F) position for the shoulder rotation multi-axis resistance exercise embodiment of FIG. 13*a*.

As described, revolving assemblies 15*a*, 15*b* may revolve independently, but also may be statically fixed (i.e. by a locking mechanism 40 as illustrated in FIG. 13*a*.) or dynamically fixed (i.e. fixed during exercise by the user) in mirror image or asymmetric planes of exercise. The well-known spring pin and index plate assembly mechanism is employed to lock user interface assemblies 20*a*, 20*b* to user interface drive shafts 21*a*, 21*b* (in order to extend or limit range of motion) in the same way as the preferred and other embodiments.

Referring to FIGS. 10*a* and *e*., when a user moves or rotates right and left user interface assemblies 20*a*, 20*b* about right and left user interface axis of rotation 200 and 201, this rotates right and left user interface drive shafts 21*a*, 21*b*. Right and left user interface drive shafts 21*a*, 21*b* are attached to and drive corresponding right and left lifting or drive pulleys 65*a*, 65*b*. Lifting or drive pulleys 65*a*, 65*b* each wind a flexible linkage 67. Flexible linkage 67 is routed from right and left lifting or drive pulleys 65*a*, 65*b* through corresponding right and left centering pulley assemblies 7*a*, 7*b* to right and left boom redirectioning pulleys 2*a*, 2*b*, and then to tensioning pulleys 3*a*, 3*b*. Tensioning pulleys 3*a*, 3*b* revolve in two planes, as described in previous embodiments. First, as do all passive pulleys on these embodiments, tensioning pulleys 3*a*, 3*b* revolve independently about their conventional circular centerline or axis when flexible linkage 67 is wound or unwound from above by lifting pulleys 65*a*, 65*b*. Second, right and left tensioning pulleys 3*a*, 3*b* revolve (in a perpendicular plane) about a tangent line to the arc of said right and left tensioning pulleys 3*a*, 3*b*, said tangent lines are collinear with the corresponding right and left revolving axis 205, 206. Further, tensioning pulleys 3*a*, 3*b* freely revolve about revolving axis 205, 206 in an equal-angular relationship simultaneously with the corresponding right and left revolving assembly 15*a*, 15*b*. Therefore, right and left tensioning pulleys 3*a*, 3*b* always maintain a fixed geometric relationship with the corresponding right and left revolving assembly 15*a*, 15*b*. This relationship is maintained by the tension of the flexible linkage 67 stretched between the fixed, boom redirectioning pulleys 2*a*, 2*b* and the tensioning pulleys 3*a*, 3*b*. This tangent pivot tensioning pulley mechanism 71 maintains equal tension in the flexible linkage at all times, regardless of the angle of the revolving assembly 15*a*, 15*b* in relation to the user. This permits movement of revolving assembly 15*a*, 15*b* from one angle or plane of exercise to another, without the need to make an adjustment for slack in the flexible linkage 67.

After exiting the tensioning pulleys 3*a*, 3*b*, the flexible linkage 67 is then reeved through the fixed, revolving axis redirectioning pulleys 4*a*, 4*b*. The same flexible linkage differential mechanism described in previous embodiments may be employed on the y-axis device. The configuration of pulleys described in previous embodiments can provide full and equal, independent resistance to each of the user interfaces 20*a*, 20*b* when actuated by a user, in any plane of exercise, in this y-axis embodiment. This type of flexible linkage differential mechanism can be employed on all embodiments providing independent bilateral user interfaces and flexible linkage resistance. (Any machine employing the flexible linkage differential mechanism, including this y-axis embodiment, could be equipped with a dual weight stack system as described previously).

There are two phases of operation of this line of strength training equipment: adjustment, and exercise. During adjustment phase of operation of the y-axis embodiment, a user sits in the user station 30, adjusts seat 30 to correct position, and chooses appropriate resistance by placing a pin (not shown) in the selectorized weight stack 16. Then the user adjusts the rotational angle of the user interface assemblies 20*a*, 20*b* in the same way as previous embodiments.

The last part of adjustment phase is selection of the plane of exercise. To accomplish this, a revolving arc locking mechanism 40 may be provided as illustrated in FIG. 13*a*. Said revolving arc locking mechanism 40 may be comprised by a radially aligned spring loaded pin that can be engaged in radially aligned, corresponding holes, or it may comprise a frictional brake or clamp, or equivalent, as in FIG. 13*a*., capable of maintaining a substantially fixed position of the revolving assembly 15 in relation to the stationary arcuate guide 14 when locking mechanism 40 is actuated or locked; but permits free revolution of revolving assembly 15 in relation to arcuate guide 14 when locking mechanism 40 is unlocked. Said revolving arc locking mechanism 40 may be hand- or foot-actuated by the user, and may be mounted on base, and/or arcuate guide 14, and/or it can be mounted on any part of revolving assembly 15. Revolving arc locking mechanism 40 is actuated in order to lock (or disengagably fix) the angular position of the revolving assembly 15*a*, 15*b* (and therefore, impart stationary support to axes of rotation 200 and 201 of user interface assemblies 20*a*, 20*b*), thereby "locking-in" a unique and specific plane of motion for exercise. When revolving arc locking mechanism 40 is released, revolving arcs 63*a*, 63*b* (and the revolving assembly 15*a*, 15*b*) glide/roll/revolve on rollers 62 about revolving axis 205, 206 and can be freely moved or revolved to any point along the arcuate guide 14*a*, 14*b*.

Subsequently, revolving assembly 15*a*, 15*b* can be locked in any new position along arcuate guide 14*a*, 14*b* by once again actuating revolving arc locking mechanism 40 in new position of revolving assembly 15*a*, 15*b*, so that axes of rotation 200, 201 of user interface assemblies 20*a*, 20*b*, are oriented at a different angle in relation to the user, providing a different unique angular plane of exercise for the user. In this way, the user can quickly select (and exercise in) any and all of the infinite radial planes of resisted motion provided by the specific embodiment of the present invention. This type of revolving arc locking mechanism 40 can be employed on all embodiments. Revolving arc locking mechanism 40 may not be employed, or employed and not engaged during exercise in order to provide dynamically variable planes of exercise.

During the exercise phase of operation, for upward "pushing" y-axis isolated shoulder resistance exercise, the user sits in user station/seat 30, with the user interface assemblies 20*a*, 20*b* locked in starting position to the side of the user (as in a forward shoulder raise exercise). To perform pushing exercise (in any plane), the user pushes the user interface assemblies 20*a*, 20*b* through the arc and plane of motion to position above the user.

For downward "pulling" y-axis isolated shoulder resistance exercise, the user sits in the user station/seat 30, and the user interface assemblies 20*a*, 20*b* are locked in starting position above the user (as in a lat pull exercise). To perform pulling exercise (in any plane), the user pulls the user interface assemblies 20*a*, 20*b* through the arc and plane of motion to the corresponding sides of the user.

11. Diagonal Multi-Axis Exercise Device

Figure 11A:
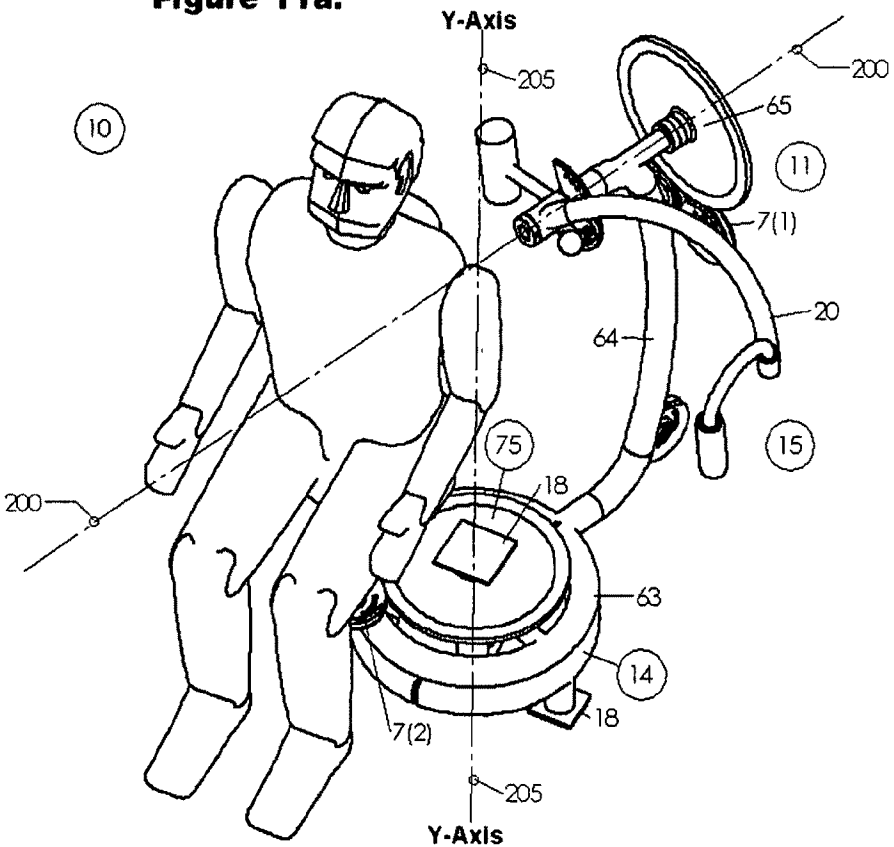
FIG. 11*a* provides a schematic perspective view of the diagonal motion shoulder resistance selectorized multi-axis exercise embodiment of the present invention.
Figure 11B:
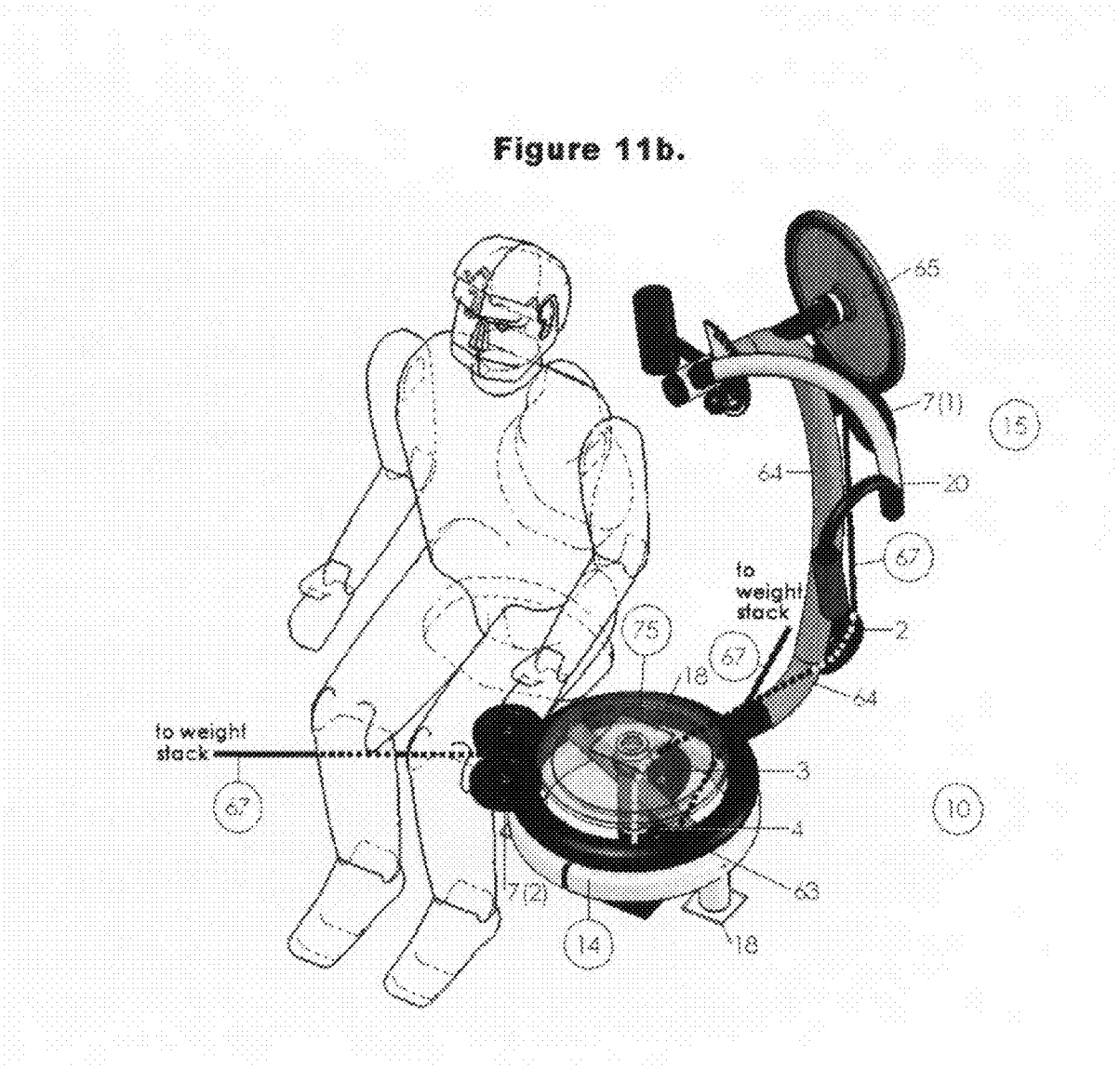
FIG. 11*b* provides a schematic perspective view of the diagonal motion shoulder resistance selectorized multi-axis exercise embodiment of the present invention, providing further detail with respect thereto.
Figure 11C:
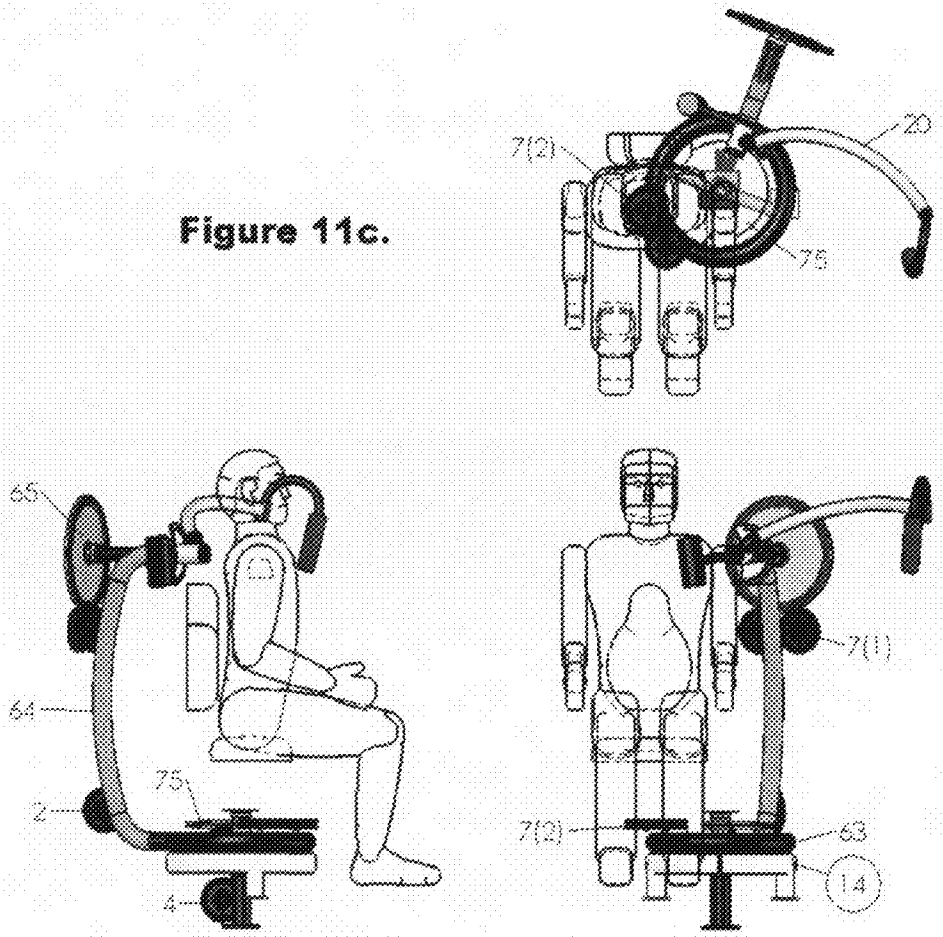
FIG. 11*c* provides (beginning in the lower left corner and proceeding clockwise) schematic side, top and frontal views of the diagonal motion shoulder resistance selectorized multi-axis exercise embodiment of the present invention.

FIG. 11*a-c*. shows the diagonal shoulder resistance multi-axis exercise device. This embodiment incorporates a revolving assembly 15 similar to the y-axis device. When a user sits in the user station 30, the y-axis of the user's shoulder is aligned in (or approximately in) a collinear relationship with the revolving axis 205 of the device. The axis of rotation of the user interface 200 intersects the shoulder joint of the user during operation, and is perpendicular to the revolving axis 206. This embodiment provides isolated shoulder resistance exercise in any of the infinite radial planes of motion passing through the y-axis of shoulder movement, but can provide full and equal resistance through a horizontal plane of motion, or any diagonal pattern of shoulder motion as well.

This is a unilateral revolving structure machine, including the following y-axis device components: (1) arcuate guide 14*b*, (2) revolving assembly 15*b*, (3) revolving arc locking mechanism 40, and (4) flexible linkage differential pulley mechanism 70 utilized in the y-axis and preferred embodiments. User interface assembly 20, provides isolated vertical plane shoulder resistance, in planes radial to y-axis of shoulder motion. The primary difference between the diagonal multi-axis device and the y-axis device (or other embodiments) is that, in addition to providing conventional resistance to movement of the user interface assembly 20 in its vertical plane of movement, this diagonal machine provides resistance to motion in the plane of motion of the revolving arc 63 as well, by employing a second drive pulley—the revolving assembly drive pulley 75—mounted on revolving arc 63, and or any part of revolving assembly 15. Revolving assembly drive pulley 75 is concentrically fixed on revolving axis 205—fixed to revolving arc 63 and/or other component (s) of revolving assembly 15. Revolving assembly drive pulley 75 may be circular or cammed in shape. Drive pulleys 65 and 75 are linked by the flexible linkage 67 routed through redirectioning, tensioning, and differential pulleys, and move resistance by way of the flexible linkage differential, as in other embodiments. By providing resistance to revolution of revolving assembly 15 about revolving axis 205, in addition to resistance to revolution of user interface assembly 20 about its axis of revolution 200 (thereby providing resistance about or between two orthogonal axes of revolution), the diagonal machine can provide full and equal resultant resistance to diagonal movement of the extremity of a user in any plane (from vertical to horizontal) of diagonal motion in relation to the user's body, in both forward or backward directions.

Any of these multi-axis devices (including those employing two independent revolving assemblies—or particularly those employing a single unilateral revolving assembly) may employ a user interface drive pulley 65 combined with an orthogonal revolving assembly drive pulley 75 linked by a differential mechanism, by the model of this diagonal embodiment. This model of orthogonal pulleys linked by a flexible linkage differential or other mechanism, provides full resultant resistance in any angular (i.e. diagonal) plane between the orthogonal planes of the the drive pulleys. This mechanism can also be provided with dual weight stacks, one linked to each drive pulley 65, 75.

12. X-Axis/Multi-Axis Exercise Device

FIGS. 12*a-e*. illustrate the x-axis embodiment of the present invention. The embodiment is named for the right and left shoulder x-axis of a user seated in the user station 30 of the device, which said right and left x-axis is aligned in (or approximately in) a collinear relationship with the corresponding right and left revolving axis 205, 206 of the device. The right and left axes of rotation of the user interfaces 200, 201 intersect the corresponding shoulder joints of the user during operation, and are perpendicular to the corresponding right and left revolving axes 205, 206. This embodiment provides isolated shoulder resistance exercise in any of the infinite radial planes of motion passing through the x-axis of shoulder movement.

Like the y-axis embodiment previously described, this is a non-concentric, bilateral, independent revolving arc mechanism (but can be implemented with revolving arcs/assemblies that revolve dependently). FIGS. 12*d-f*. illustrate the potential number of angular planes of exercise (in edge-on orientation) that are possible on this device. The x-axis embodiment employs two mirror image non-concentric, revolving assembly structures 15*a*, 15*b* mounted on the base of the device and/or mounted on fixed structural elements of the frame at fixed points 18. Revolving assembly structures 15*a*, 15*b* employ similar linkages to those detailed in the y-axis embodiment. By employing two independent mirror image revolving assemblies 15*a*, 15*b*, independent adjustment of the plane of exercise is made possible for right and left user interfaces.

Figure 12A:
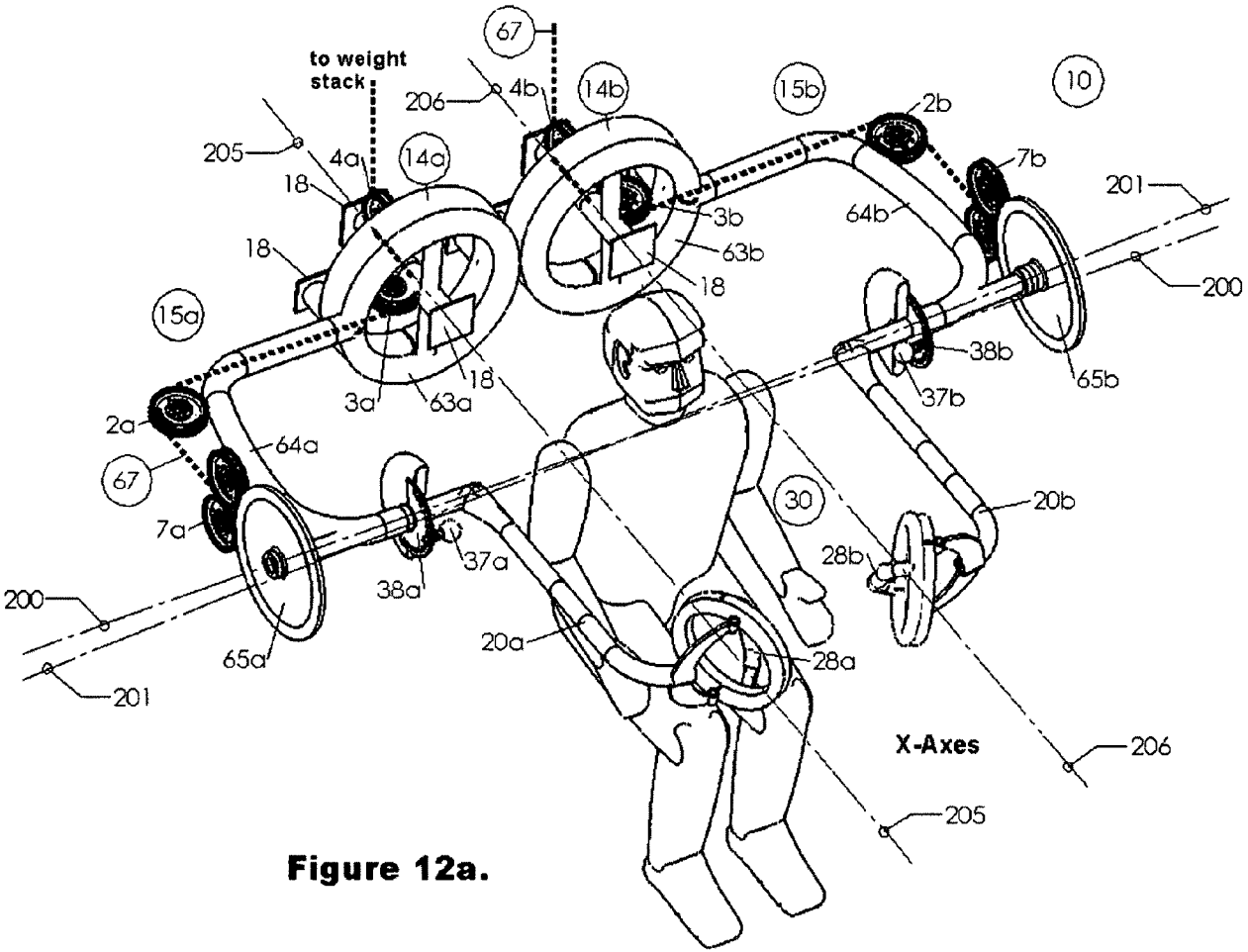
FIG. 12*a* provides a schematic perspective view illustrating the X-axis isolated shoulder resistance selectorized multi-axis exercise embodiment of the present invention.
Figure 12B:
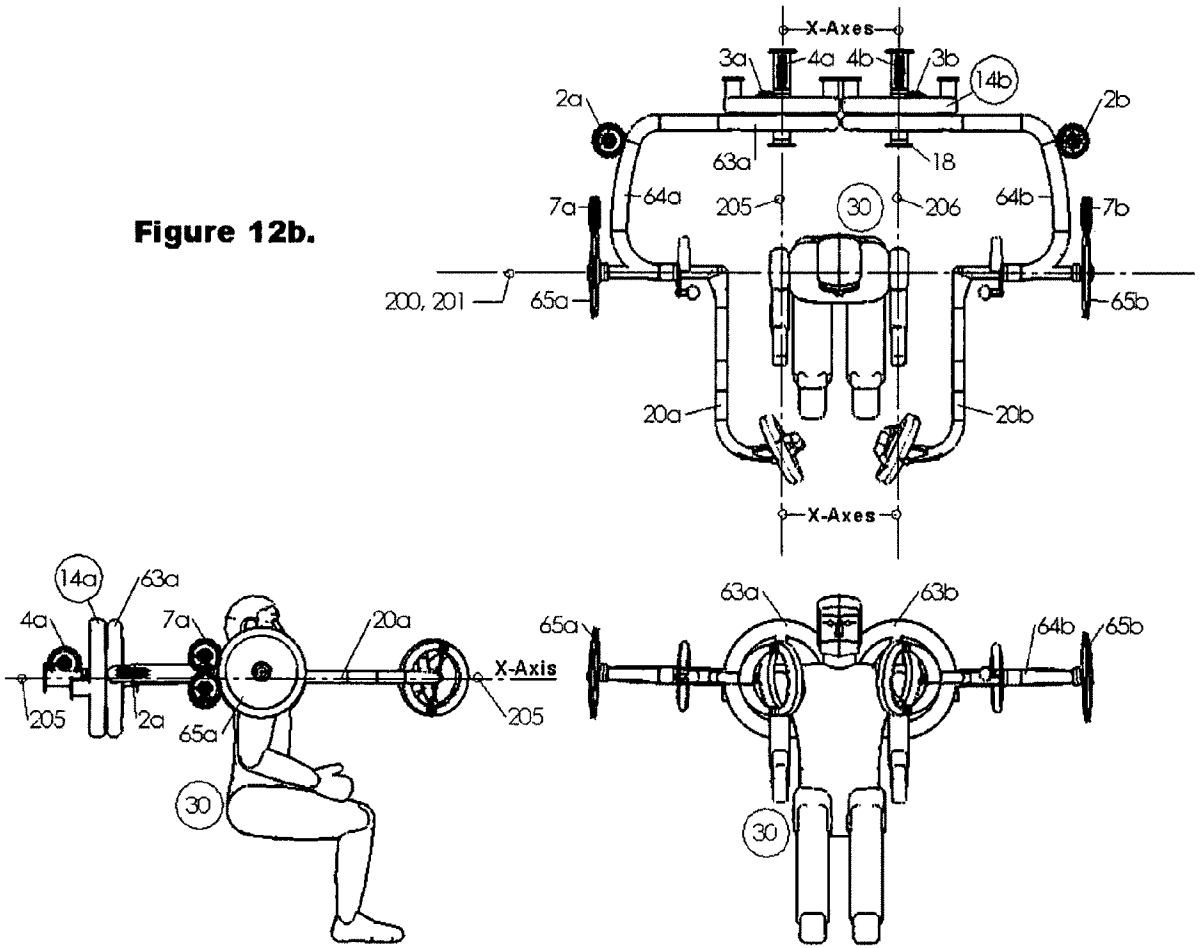
FIG. 12*b* provides (beginning in the lower left corner and proceeding clockwise) schematic side, top and frontal views of the X-axis isolated shoulder resistance selectorized multi-axis exercise embodiment of the present invention.
Figure 12C:
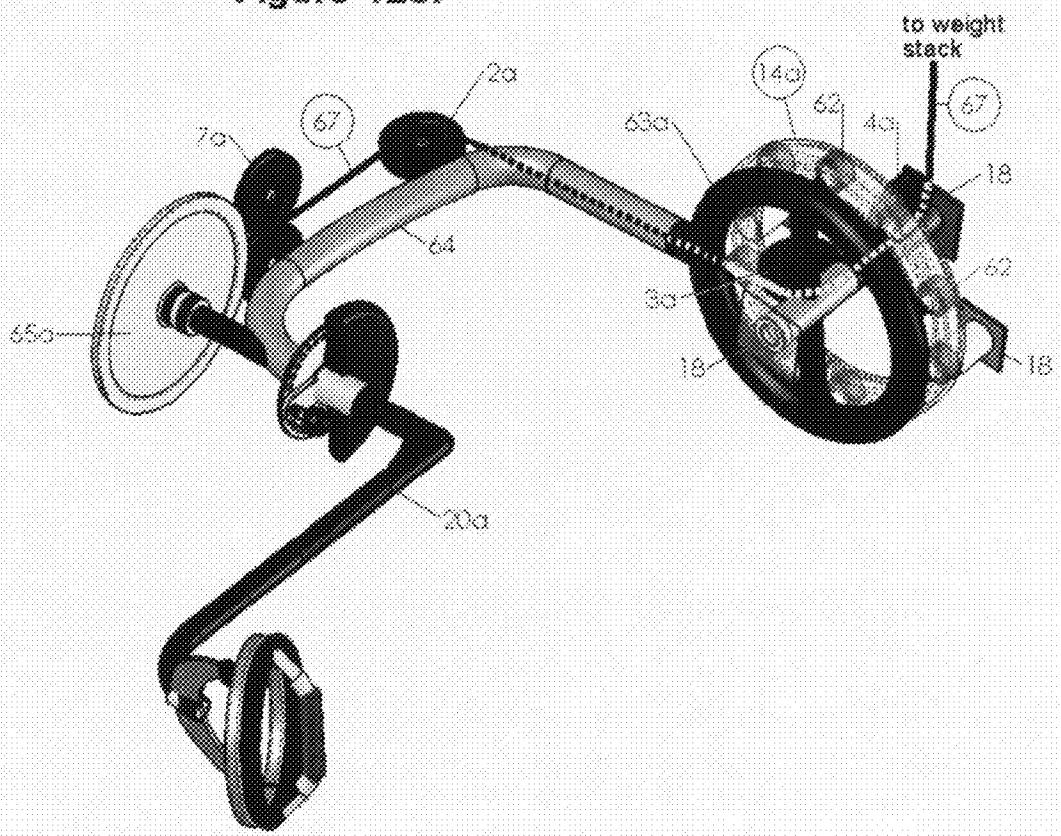
FIG. 12*c* provides a schematic perspective view illustrating the right side decagonal roller pattern of the revolving assembly/roller assembly of the X-axis isolated shoulder resistance selectorized multi-axis exercise embodiment of the present invention.
Figure 12D:
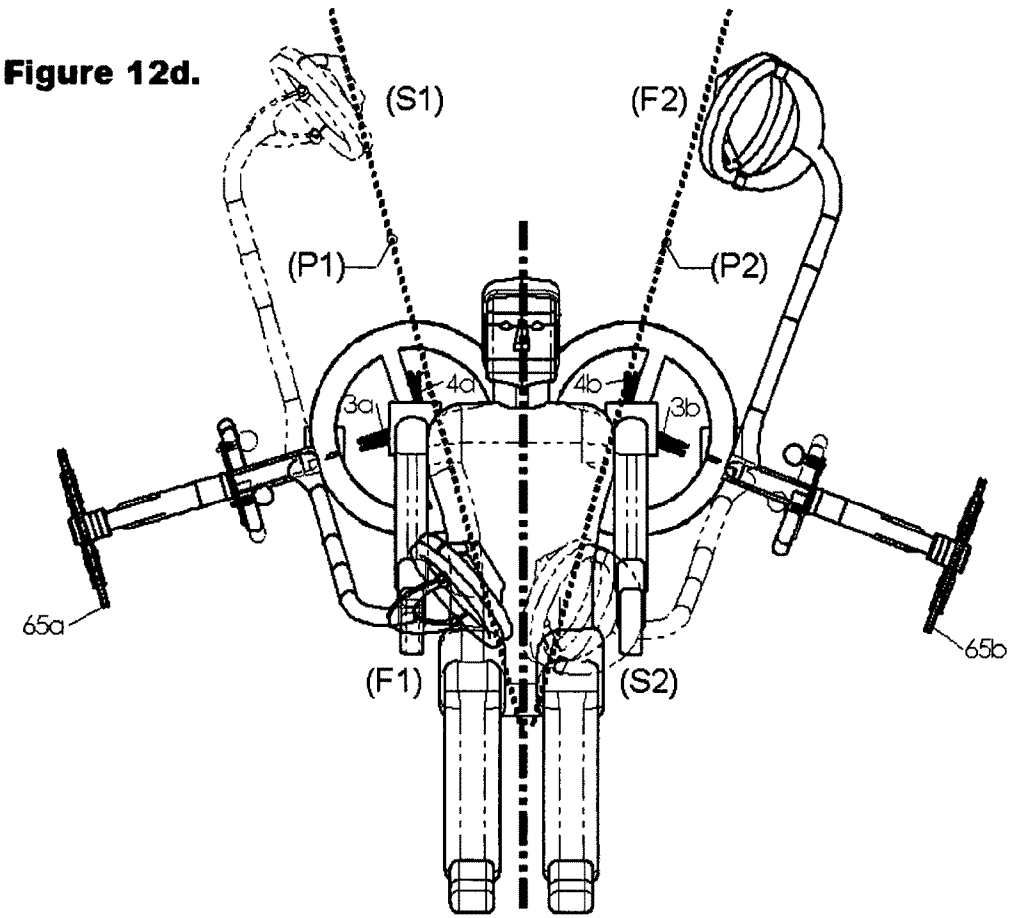
FIG. 12*d* provides a schematic front view of the X-axis isolated shoulder resistance selectorized multi-axis exercise embodiment of the present invention, providing further detail with regard to planes of motion.
Figure 12E:
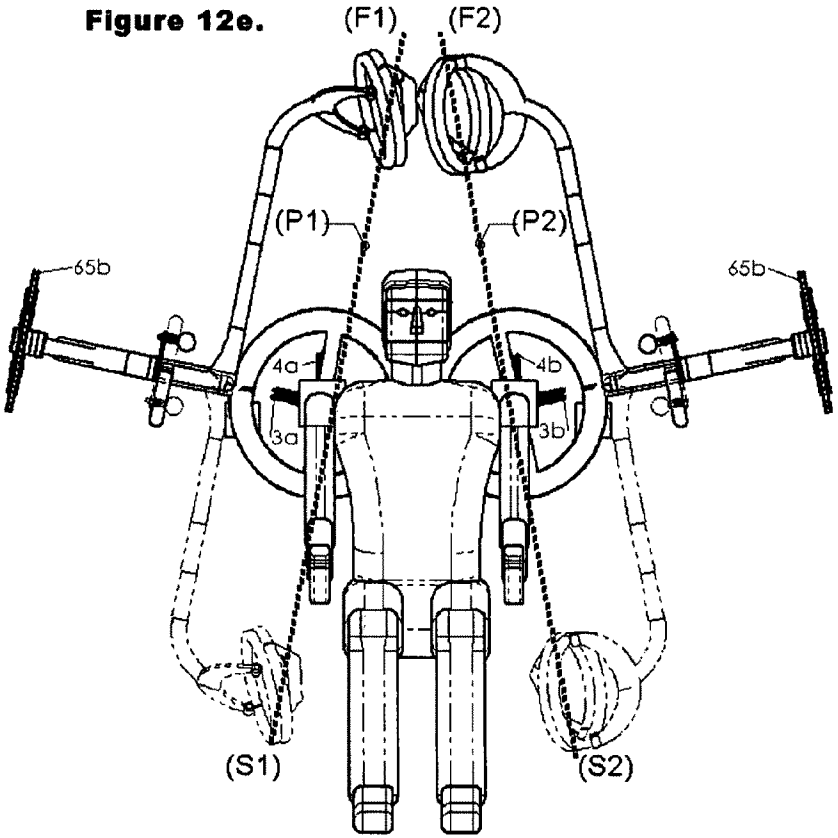
FIG. 12*e* provides a second schematic front view of the X-axis isolated shoulder resistance selectorized multi-axis exercise embodiment of the present invention, providing further detail with regard to planes of motion.
Figure 12F:
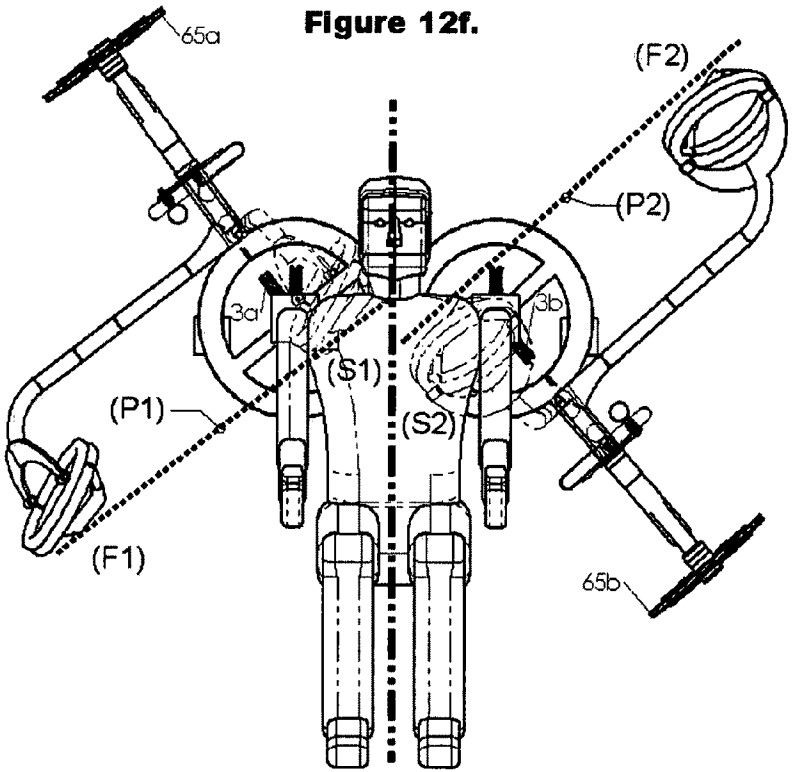
FIG. 12*f* provides a third schematic front view of the X-axis isolated shoulder resistance selectorized multi-axis exercise embodiment of the present invention, providing further detail with regard to planes of motion.

Turning to FIG. 12*a-b*. in detail, number 10 designates the exercise machine in accordance with the present invention. The apparatus 10 comprises similar or identical: (1) user station/seat 30, (2) user interface assemblies 20*a*, 20*b*, arcuate guides 14*a*, 14*b*, (3) revolving arcs 63*a*, 63*b*, (4) booms 64*a*, 64*b*, (5) rollers 62, (6) revolving assemblies 15*a*, 15*b*, (7) flexible linkage differential system, (8) flexible linkage tension mechanism, (9) resistance mechanism/weight stack 16, and (10) fixed points 18, as described previously for y-axis embodiment.

The difference between the x-axis and y-axis embodiments is seen in the configuration of the revolving assemblies. The exercise machine 10 comprises a right and left stationary arcuate guide 14*a*, 14*b* (in a vertical plane orientation instead of horizontal plane orientation of arcuate guides in y-axis embodiment), the right and left centerlines of which are horizontal (instead of vertical orientation of y-axis device) and collinear with the x-axis of motion of the corresponding right and left shoulder(s) of a user positioned in the user station 30, and said centerlines are termed the right and left revolving axes 205, 206 of revolving assemblies 15*a*, 15*b*.

As described for the y-axis embodiment, x-axis revolving assemblies 15*a*, 15*b* may revolve independently, but also may be statically fixed (i.e. by a locking mechanism) or dynamically fixed (i.e. fixed during exercise by the user) in symmetric (mirror image) or asymmetric planes of exercise. Adjustments are made for, and exercise is performed on the x-axis embodiment in the same or analogous way as for the y-axis embodiment.

13. Shoulder Rotation Multi-Axis Exercise Device—Employing Revolving Arc Mechanism FIGS. 13*a-d*. show the shoulder rotation multi-axis resistance exercise embodiment. This machine provides internal/external rotational resistance at any angle of flexion-extension and/or abduction-adduction of the shoulder or upper arm of a user in relation to the horizontal surface. The x-axis of shoulder motion of a user positioned in the user station/seat 30 is collinear with the revolving axis 205 of the device. This is a unilateral revolving structure machine built on a platform similar to that utilized in the x-axis embodiment, including similar or identical: (1) arcuate guide 14, (2) revolving arc 63, (3) boom 64, (4) user interface assembly 20, (5) revolving assembly 15, (6) revolving arc locking mechanism 40, (7) flexible linkage differential pulley mechanism, (8) fixed points 18, and (9) user station/seat 30. Like other devices in this series, the axis of rotation of the user interface 200 intersects the shoulder joint of the user, and is perpendicular to the revolving axis 205.

The primary difference between the present embodiment and the x-axis embodiment is the use of a novel user interface assembly (or forearm interface member) 20, providing isolated resistance to internal/external rotation of the shoulder joint. The internal/external rotation user interface assembly 20 accommodates the elbow and forearm proximally (by way of elbow pad 98), and the hand distally (by way of user interface handle 28). The elbow pad 98 supports the elbow in approximately 90 degrees of flexion, and aligns the axis of internal/external rotation of the shoulder joint in collinear relationship with the user interface axis of rotation 200, at any angle of flexion-extension and or abduction-adduction of the shoulder joint. (This embodiment can provide compound resistance by incorporation of the revolving axis drive pulley 75, as described for the diagonal shoulder resistance embodiment).

14. Center-Pivot Boom Design

A. Shoulder Rotation Multi-Axis Exercise Device

B. Y-Axis/Multi-Axis Exercise Device

A. An alternative method of providing revolving motion on any of these devices is through the use of a center-pivot design. FIGS. 14.A.1-2. show a version of the shoulder rotation multi-axis embodiment as in FIG. 13*a*., with the exception that a length of standard tubing—a crossmember of t-junction 80—is the tubular revolving arc 63. Revolving arc 63, like other revolving arcs described, is concentric with the axis of revolution 205 of the revolving assembly 15, and is mounted by way of bearings on fixed structural element(s) of the device. As in all embodiments, this revolving arc 63 meets the criteria that a drive component may be embedded within said revolving arc 63. That is, the opening within the revolving arc 63 can accommodate either drive component(s) that may be fixed within, or drive component(s) that may pass through said revolving arc 63, effectively providing support, and or shielding, and or space for, and or permitting passage of drive element(s). In this case, the drive components are a flexible linkage/cable 67 (which passes through) and tangent pivot tension pulley 3 (which is embedded or fixed within revolving arc 63).

A fixed structural arc that is concentric with the revolving axis 205 of the machine is employed as arcuate guide 14, providing a continuous structural connection point to position revolving assembly 15 by way of locking mechanism 40, in any of an infinite number of selectable positions, thereby providing an infinite number of planes of exercise. This design depends on at least one pivot component, race bearings 22, centered on the revolving axis 205 to carry revolving arc 63 of the t-junction 80. Boom 64 depends/extends radially from revolving arc 63 at t-junction 80. (Stationary races of race bearings 22 could be considered arcuate guides for revolving arc 63 of t-junction 80 in this embodiment).

The t-junction 80 design lends itself to embedding of drive components (such as the tangent pivot tension pulley 3 and flexible linkage 67) within stationary and revolving tubular structural elements, streamlining exposed drive components and enhancing safety of the embodiment. Note that the triangular polygonal array 150, composed of pivoting (i.e. race bearings 22) and locking components (locking mechanism 40), provides multipoint structural support in this embodiment.

B. FIG. 14.B.1-2. shows the y-axis/multi-axis exercise device concept implemented utilizing the center-pivot boom design. The t-junction center pivot mechanism is shown along with polygonal array 150 providing triangular multipoint conveying/structural support. This embodiment employs a right and left arcuate guide 14*a*, 14*b* to which revolving assembly may be repositionably attached by way of locking mechanism 40 as in FIG. 14.A.1-2. As in previous embodiments, functional components in drawings are substantially attached to base or fixed structural elements of the device at fixed points 18.

15. Biceps/Triceps Multi-Axis Exercise Device—Center Pivot Design

Figure 15A:
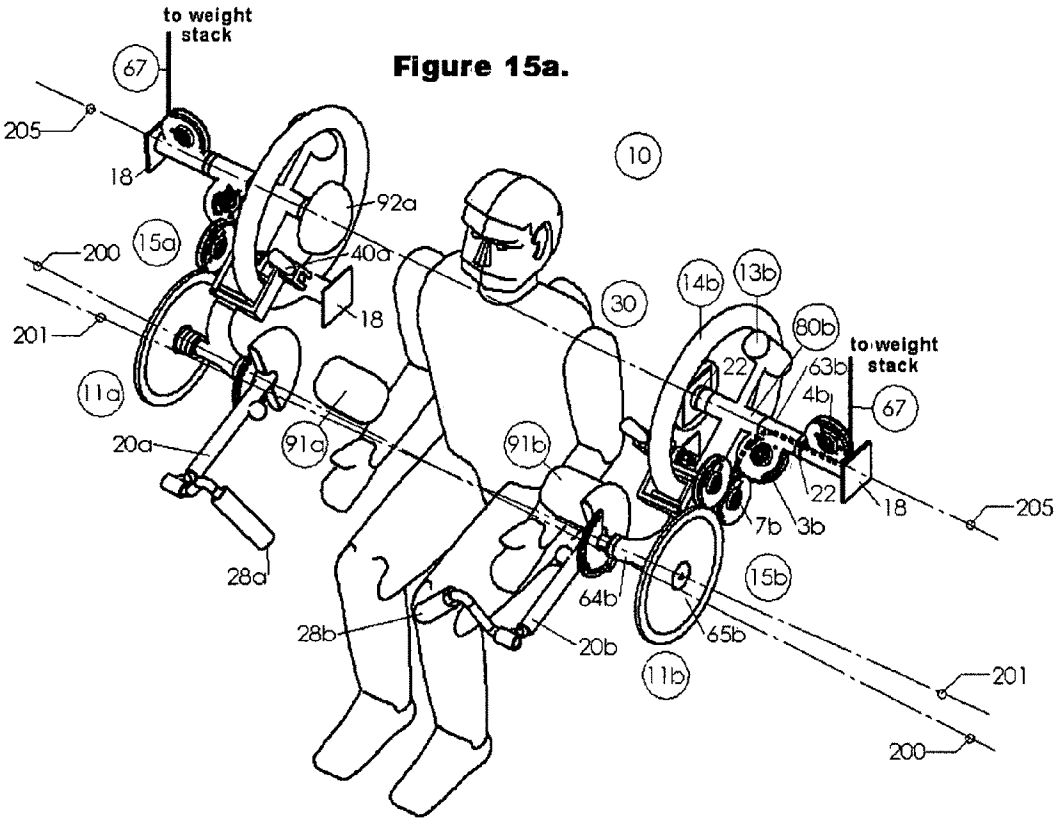
FIG. 15*a* provides a schematic perspective view of a center pivot design for a bicep/tricep selectorized multi-axis resistance exercise embodiment of the present invention.
Figure 15B:
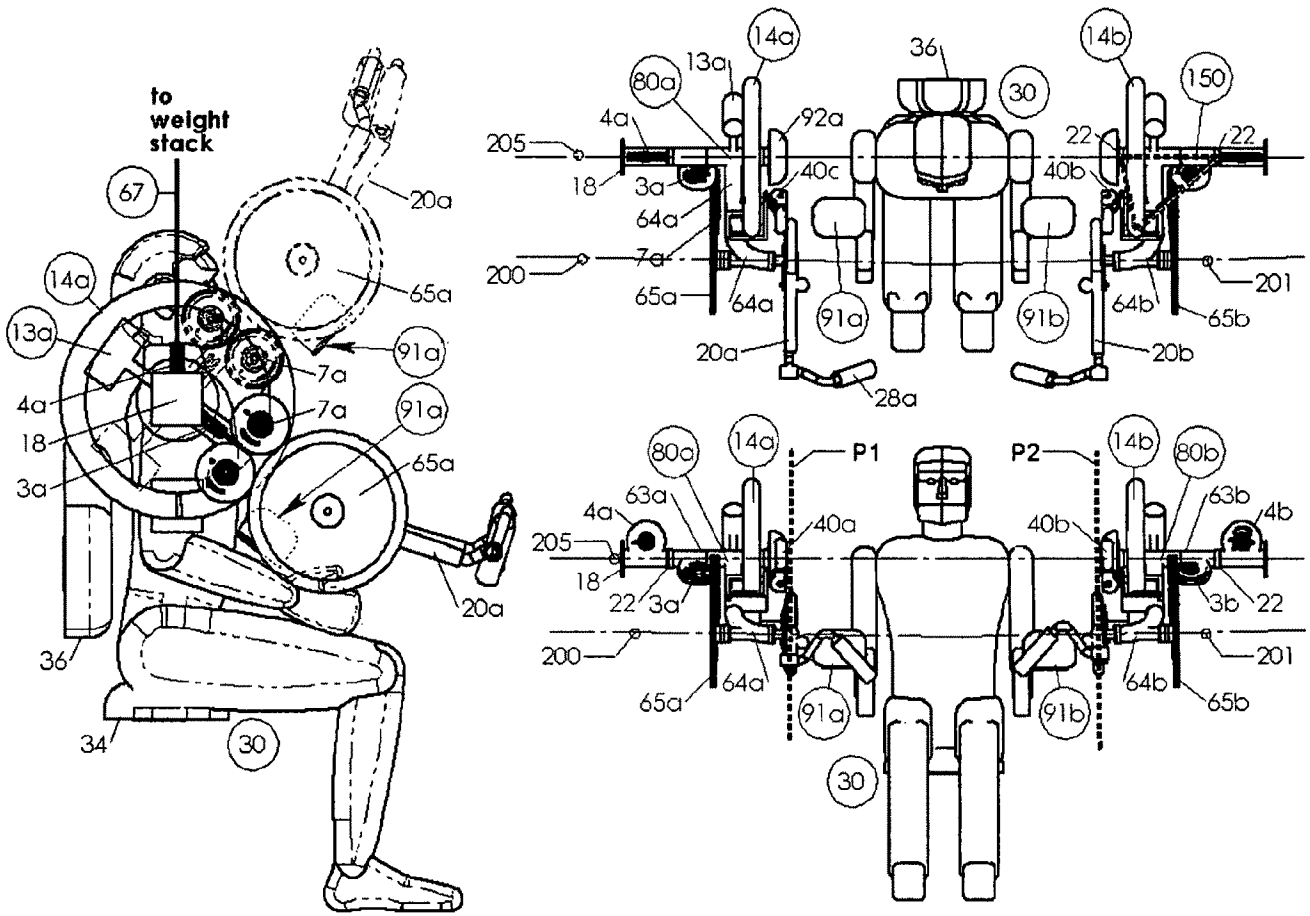
FIG. 15*b* provides (beginning in the lower left corner and proceeding clockwise) schematic side, top and frontal views of the center pivot design for a bicep/tricep selectorized multi-axis resistance exercise embodiment of FIG. 15*a*.
Figure 15C:
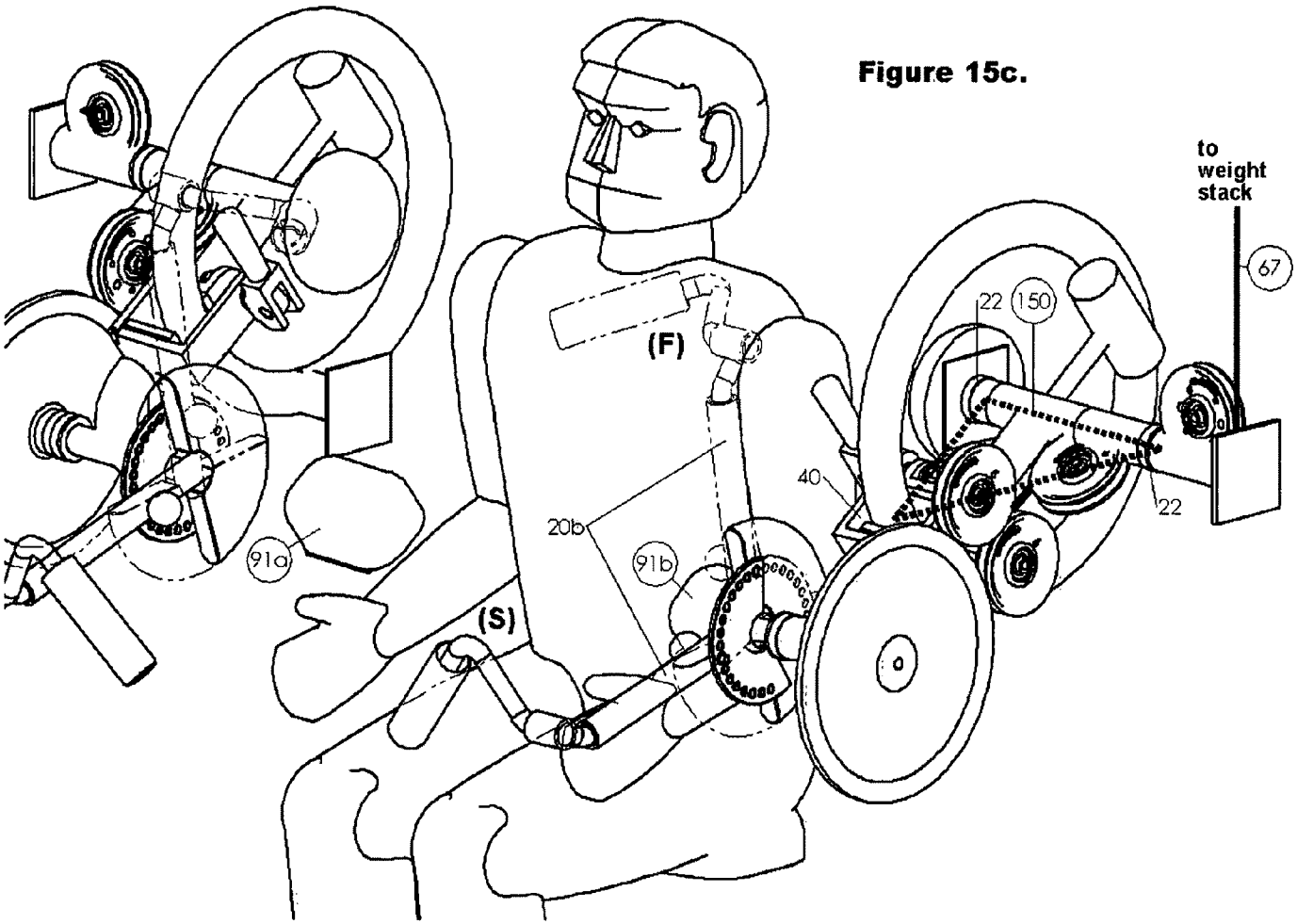
FIG. 15*c* provides a schematic perspective view of the center pivot design for a bicep/tricep selectorized multi-axis resistance exercise embodiment of FIG. 15*a*, with further detail related to user interface range, including possible start (S) and finish (F) positions.

FIG. 15*a*-*b*. is the biceps/triceps multi-axis resistance exercise device. This embodiment provides flexion or extension resistance exercise for the elbow joint at any angle of flexion-extension and/or abduction-adduction of the shoulder or humerus. This embodiment employs bilateral, independent or dependent revolving assemblies that are unique in the line. Independent user interfaces can provide asymmetric, non-mirror image axes of rotation 200, 201 of user interfaces during operation, whereas dependent user interfaces generally provide fixed or dynamic symmetric, mirror-image axes of rotation of user interfaces during exercise. This device is unique in the series in that the right and left revolving axes 205, 206 of the right and left revolving assemblies 15*a*, 15*b* are approximately collinear with the corresponding right and left z-axis of the shoulder joints of the user, and the user interface axes of rotation 200, 201 pass through the elbow joints of the user and are approximately parallel to revolving axis 205.

By the model of previous embodiments, this device employs: (1) arcuate guides 14*a*, 14*b*, (2) tubular revolving arcs 63*a*, 63*b*, (3) booms 64*a*, 64*b*, (4) user interface assemblies 20*a*, 20*b*, (5) revolving assemblies 15*a*, 15*b*, (6) revolving arc locking mechanisms 40*a*, 40*b*, and (7) flexible linkage differential mechanism. Substantial connection of arcuate guides 14*a*, 14*b* and other parts of the device to fixed structural elements are illustrated by fixed points 18 as in previous embodiments. User station/seat 30 is similar to that described previously as well.

Turning to FIG. 15*a*-*b*. in detail, number 10 designates the exercise machine in accordance with the present invention. The apparatus 10 comprises a base adapted to rest on a supporting surface. Arcuate guides 14*a*, 14*b* are secured to the base or to fixed structural element(s) at fixed points 18. In this center-pivot design, right and left booms 64*a*, 64*b* depend/extend radially from corresponding t-junctions 80*a*, 80*b*. The machine illustrated is a center-pivot revolving design, although this machine can interchangeably employ a revolving carrier/revolving arc mechanism.

Right and left elbow support pads 91*a*, 91*b* are adjustably fixed to corresponding right and left boom 64*a*, 64*b* by structural elements (not shown) extending from said booms 64*a*, 64*b*. Elbow support pads 91*a*, 91*b* are therefore automatically positioned to support the elbows of the user during operation, at any possible angle of the boom 64*a*, 64*b* and at any angle of forward flexion of the positioned user's shoulder joint. Note that two different positions of revolving assembly 15*a*, 15*b* are illustrated in the side view in FIG. 15*b*. The first position (solid lines) is the conventional bicep curl position illustrated in all other views of the embodiment, with the shoulders of the user supported by elbow support pads 91*a*, 91*b* forward-flexed to 45 degrees, and elbows therefore substantially supported below the horizontal plane by elbow support pads 91*a*, 91*b* during exercise. The second position (dashed lines) brings the shoulder into relatively greater forward flexion at an angle above 135 degrees supported in that position by elbow support pads 91*a*, 91*b*, with the elbows of the user substantially supported above the horizontal plane during exercise. Elbow support pads 91*a*, 91*b* provide fixed full-range-of-motion support to the elbows of the user at any angular position of the shoulders of the user. Elbow support pads 91*a*, 91*b* provide fixed full-range-of-motion support from an elbow-extended starting position for bicep curl exercise, or conversely, from an elbow-flexed starting position for tricep extensions as well.

As on other embodiments, boom 64*a*, 64*b* and corresponding revolving assembly 15*a*, 15*b* can be revolved and locked in any position along arcuate guide 14*a*, 14*b* by way of locking mechanism 40*a*, 40*b*. In order to exercise on this device, the user: (1) is positioned in the user station 30 with z-axes of right and left shoulders approximately collinear with corresponding revolving axes 205, 206, (2) adjusts right and left revolving assembly 15*a*, 15*b* to the desired angle of shoulder flexion-extension for exercise by way of corresponding right and left locking mechanism 40*a*, 40*b*, (3) places right and left elbows on corresponding right and left elbow support pads 91*a*, 91*b*, (4) grasps user interface handles 28*a*, 28*b*, and (5) pushes or pulls the user interface assembly 20*a*, 20*b* through a range of elbow motion.

By this model of machine design and of exercise, an analogous lower body exercise machine may be implemented in which: (1) the revolving axis of the machine is parallel to the axis of rotation of the user interfaces; (2) the revolving axis of the machine is concentric with the flexion/extension axis of the hip joint; and (3) the axis of rotation of the user interfaces intersect the knee joints and are collinear with the axis of flexion/extension of the knee. Further, this bicep/tricep multi-axis device (or analogous lower body device) may employ a revolving axis drive pulley 75 which can be linked to the user interface drive pulley 65 by a differential mechanism, by the model of the shoulder diagonal multi-axis device. In this unique embodiment, drive pulleys have parallel planes of rotation, as opposed to orthogonal planes of rotation as described in the shoulder diagonal multi-axis embodiment.

16. Compound Multi-Axis Exercise Device—Bilateral Narrow Diameter Revolving Arcs and Midline Arcuate Guide FIGS. 16*a-b*. show a multi-axis compound device constructed by the narrow diameter revolving arc model of the y-axis and x-axis devices. The revolving arcs in this embodiment are concentric with one another, with the revolving axis 205, and with the z-axis of shoulder movement of the user positioned in the user station 30. Although this embodiment is illustrated employing compound shoulder resistance, the design can be implemented with an isolated shoulder resistance mechanism as well.

This narrow diameter revolving arc embodiment provides the identical infinite planes of exercise and independent user interfaces as the compound concentric shaft drive mechanism described previously, and can accommodate a concentric shaft user interface drive mechanism as well. The u-shaped boom design 64 is positioned and disengageably fixed along the midline arcuate guide 14 by way of locking mechanism 40, by the model of Gautier 2008, and both straddles user station 30, and pivots on either side of user station 30. This provides multipoint structural stability through triangular polygonal support 150 to the overhead or drive assembly 11 and to the axis of rotation of the user interfaces 200, 201 when the overhead or drive assembly is locked in position along the arcuate guide 14. Adjustments and operation of the device are the same as for the compound concentric shaft device described previously.

The bilateral lifting pulley (65*a*, 65*b*) design illustrated in FIG. 16*a-b*.—showing right and left lifting pulley 65*a*, 65*b* on corresponding right and left sides of the boom 64 (i.e. bilateral lifting pulleys)—is optimal for a dual weight stack system, although a differential system may be implemented that provides full and equal, independent movement and resistance to user interface assemblies 20*a*, 20*b*, employing a single weight stack. The open revolving arc design permits/facilitates routing of flexible linkage in any direction, through the narrow diameter revolving arc 63*a*, 63*b* and through arcuate guide 14*a*, 14*b* toward the user station 30, and routed to opposite side of machine for single weight stack embodiment; or routed through revolving arc and away from the user station 30 on both sides of the machine, for a dual weight stack system. Therefore, by virtue of this revolving arc system, single or dual weight stacks can be employed. This embodiment can also be implemented with a z-axis isolated multi-axis resistance mechanism, a free flexible linkage mechanism, and other exercise mechanisms.

17. Compound Multi-Axis Exercise Device—Bilateral Center Pivot Design and Midline Arcuate Guide FIG. 17*a-b*. shows a multi-axis compound device constructed by the center pivot boom model. The revolving axis 205 of revolving assembly 15 is concentric with the z-axis of shoulder movement of the user positioned in the user station 30. Although this embodiment is illustrated employing compound shoulder resistance, the design can be implemented with isolated shoulder resistance as well. This center pivot compound exercise embodiment provides the identical infinite planes of exercise and independent user interfaces, and can accommodate a concentric shaft drive mechanism as in the compound device described previously.

In this design, a u-shaped boom 64, is positioned and disengageably fixed along a midline arcuate guide 14 by way of locking mechanism 40, in a manner similar to that of Gautier 2008. U-shaped boom 64 straddles user station 30, and is rotatable around user station 30 via its connection on either side of user station 30 to tubular revolving arcs 63. This provides multipoint stability through triangular polygonal support 150 to the overhead or drive assembly 11 and to the axis of rotation of the user interfaces 200, 201. Adjustments and operation of the device are the same as for the compound concentric shaft device described previously.

Figure 17B:
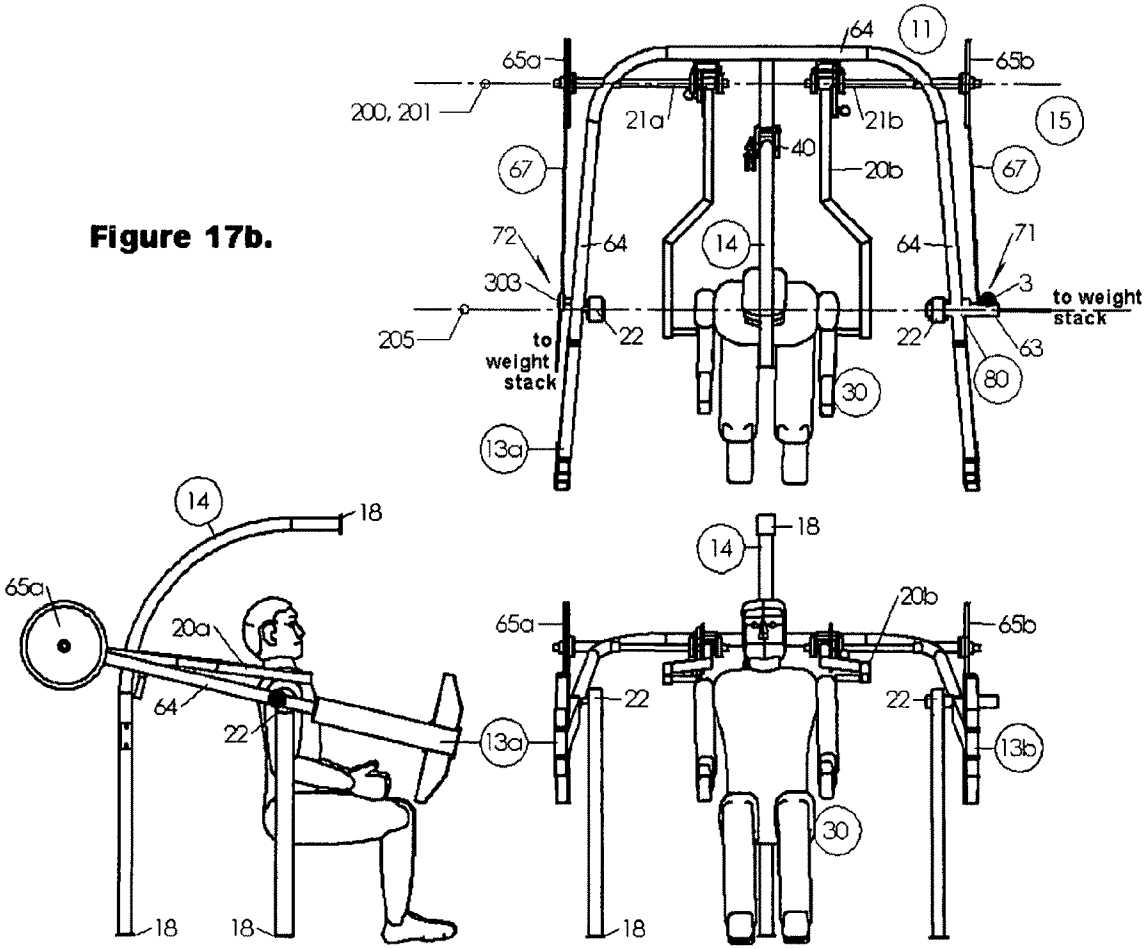
FIG. 17*b* provides (beginning in the lower left corner and proceeding clockwise) schematic side, top, and frontal views illustrating the center pivot design for a multi-axis compound shoulder resistance exercise embodiment of FIG. 17*a*.

The bilateral lifting pulley (65*a*, 65*b*) design illustrated in FIG. 17*a-b*.—showing right and left lifting pulley 65*a*, 65*b* on corresponding right and left sides of the boom 64 (i.e. bilateral lifting pulleys)—is optimal for a dual weight stack system, although a differential system may be implemented that provides full and equal, independent movement and resistance to user interface assemblies 20*a*, 20*b*, employing a single weight stack. The open revolving arc design permits/facilitates routing of flexible linkage in any direction, through the tubular revolving arc 63 and through bearing 22 toward the user station 30, and routed to opposite side of machine for a flexible linkage differential/single weight stack embodiment; or routed through tubular revolving arc 63 and away from the user station 30 (as illustrated) on both sides of the machine, for a dual or bilateral weight stack system. Therefore, by virtue of this tubular revolving arc system, single or dual weight stacks can be employed. This embodiment can also be implemented with a z-axis isolated multi-axis resistance mechanism, a free flexible linkage mechanism, and other exercise mechanisms.

FIG. 17*a-b* illustrate fixed plane tension pulley 72 and tangent pivot tension pulley 71 routing mechanisms on right and left sides of the machine respectively. Note that no revolving arc is implemented in the fixed plane tension pulley mechanism 72 on right side of machine. Note also that the flexible linkage 67 on the left side of the machine may be routed in the opposite direction along the revolving axis 205 in the illustration, that is, flexible linkage 67 may be routed toward the user station 30 and through the boom 64 and race bearing 22.

18. Continuous-Loop Revolving Arc and Boom Structure

Figure 18A:
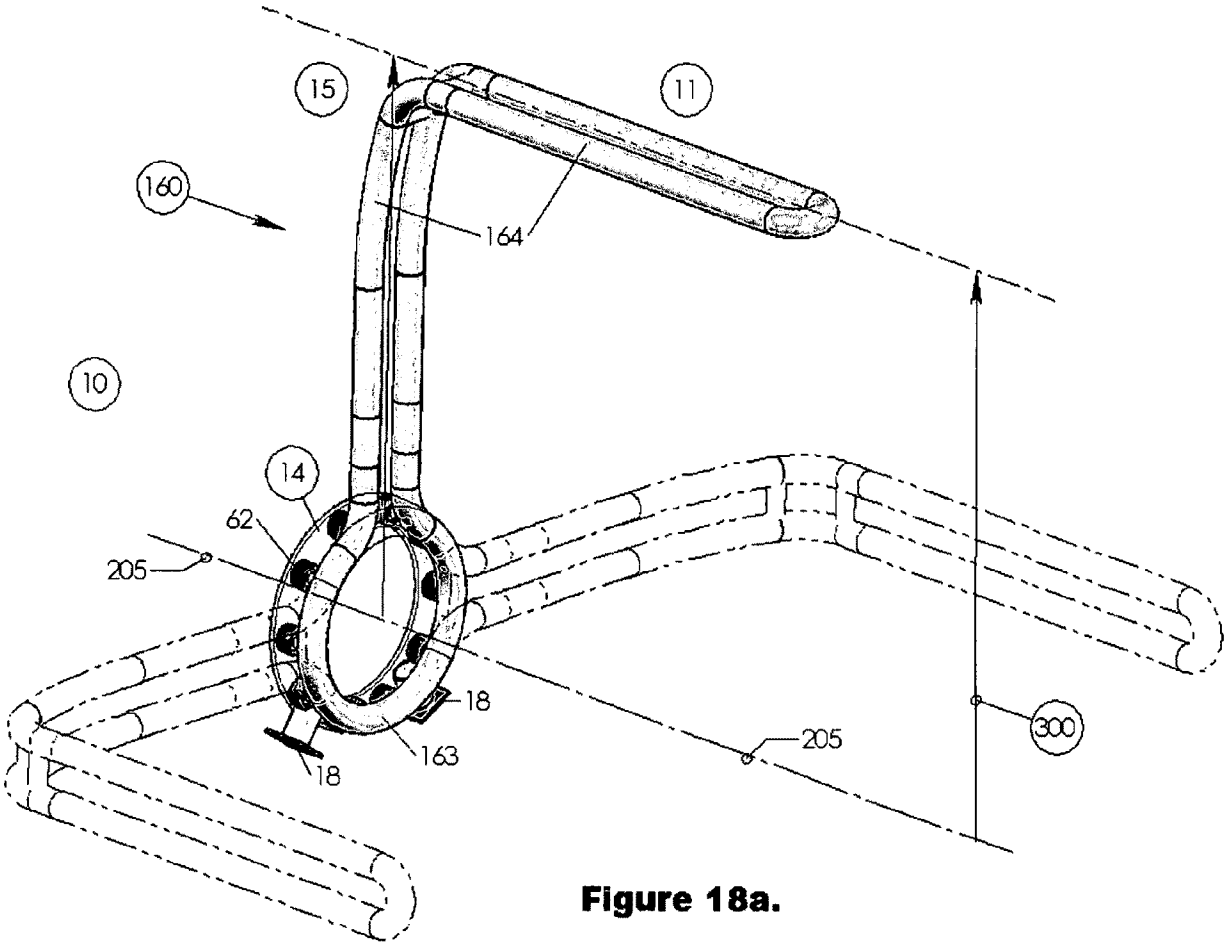
FIG. 18*a* provides a schematic perspective view illustrating a continuous loop revolving arc and boom with roller assembly for use in embodiments of the invention.
Figure 18B:
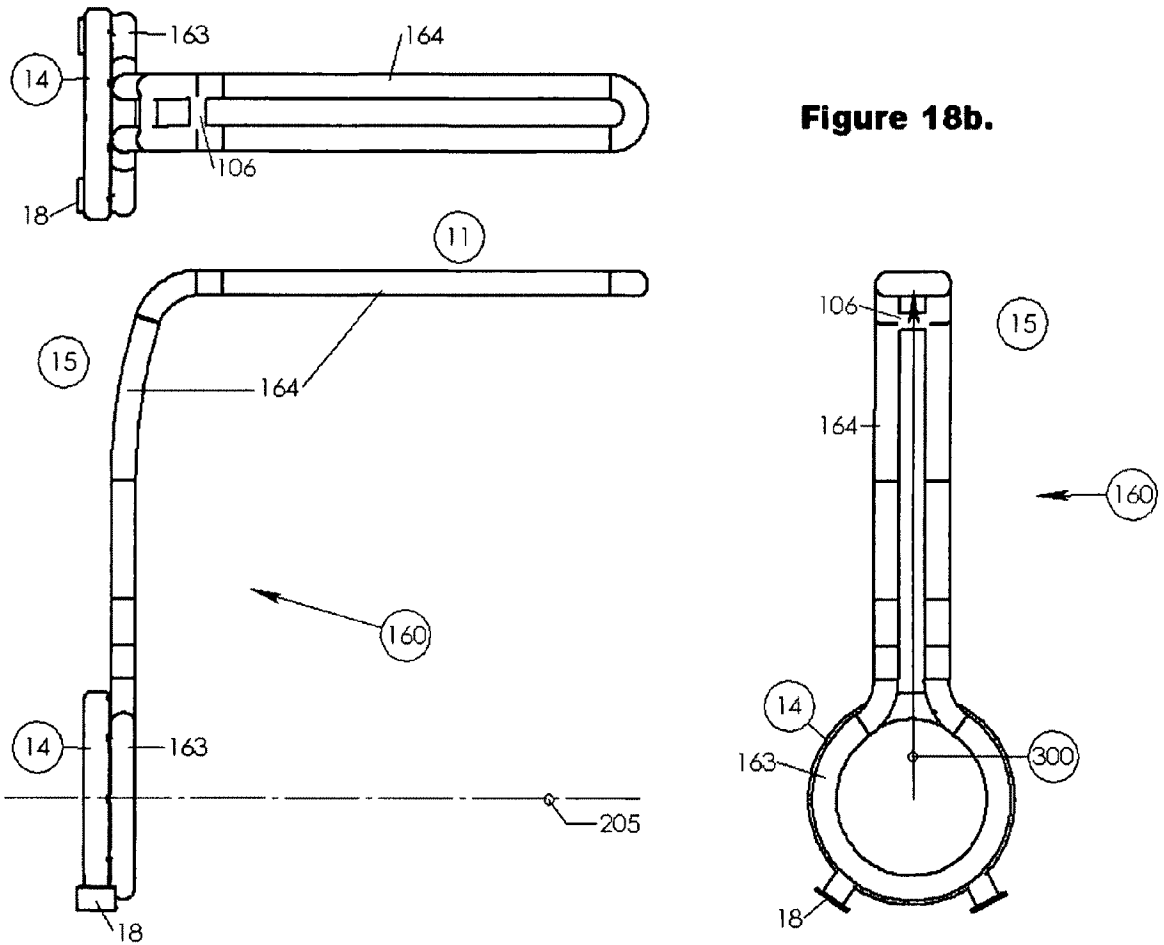
FIG. 18*b* provides (beginning in the lower left corner and proceeding clockwise) schematic side, top, and frontal views illustrating the continuous loop revolving arc and boom with roller assembly of FIG. 18*a*.
Figure 18C:
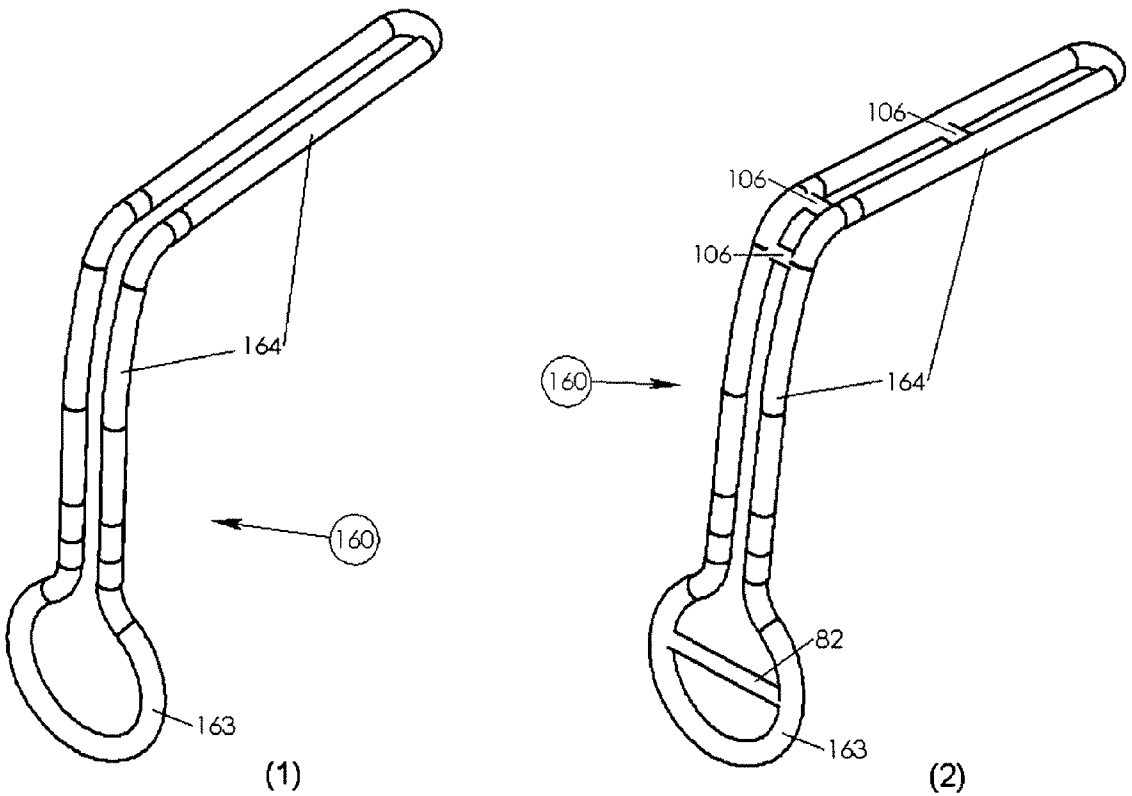
FIG. 18*c* provides schematic perspective views illustrating the continuous loop revolving arc and boom with roller assembly of FIG. 18*a* without braces and spokes (1) and with braces and spokes (2).

Booms of most previous embodiments can be described as being radially fixed to a circular revolving arc. In order to optimize structural strength and stability, and to minimize materials and cost, the revolving arc and boom may be formed as a continuous, closed-loop structure. FIG. 18*a*. shows a continuous-loop revolving arc/boom structure 160 comprised by an open revolving arc 163, and a projected loop of structural material 164 from the arc, which projected loop 164 constitutes the entirety of the boom in this illustration. This structure may be strengthened by bridge braces 106 spanning the parallel structural elements of the boom, and/or with spokes 82 spanning the revolving arc, as in FIG. 18*b-c*.

Figure 18D:
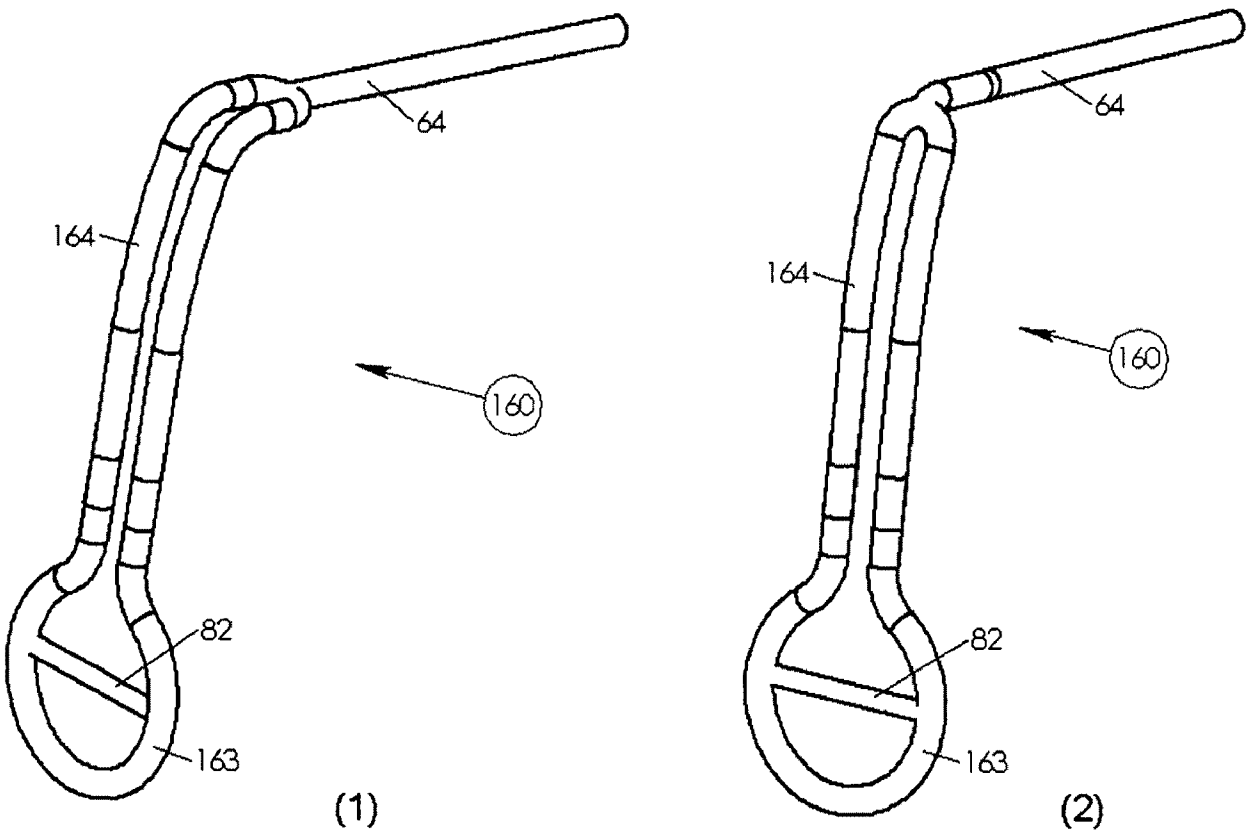
FIG. 18*d* provides schematic perspective views illustrating possible variations (1) and (2) of the continuous loop revolving arc and boom with roller assembly of FIG. 18*a*.
Figure 18E:
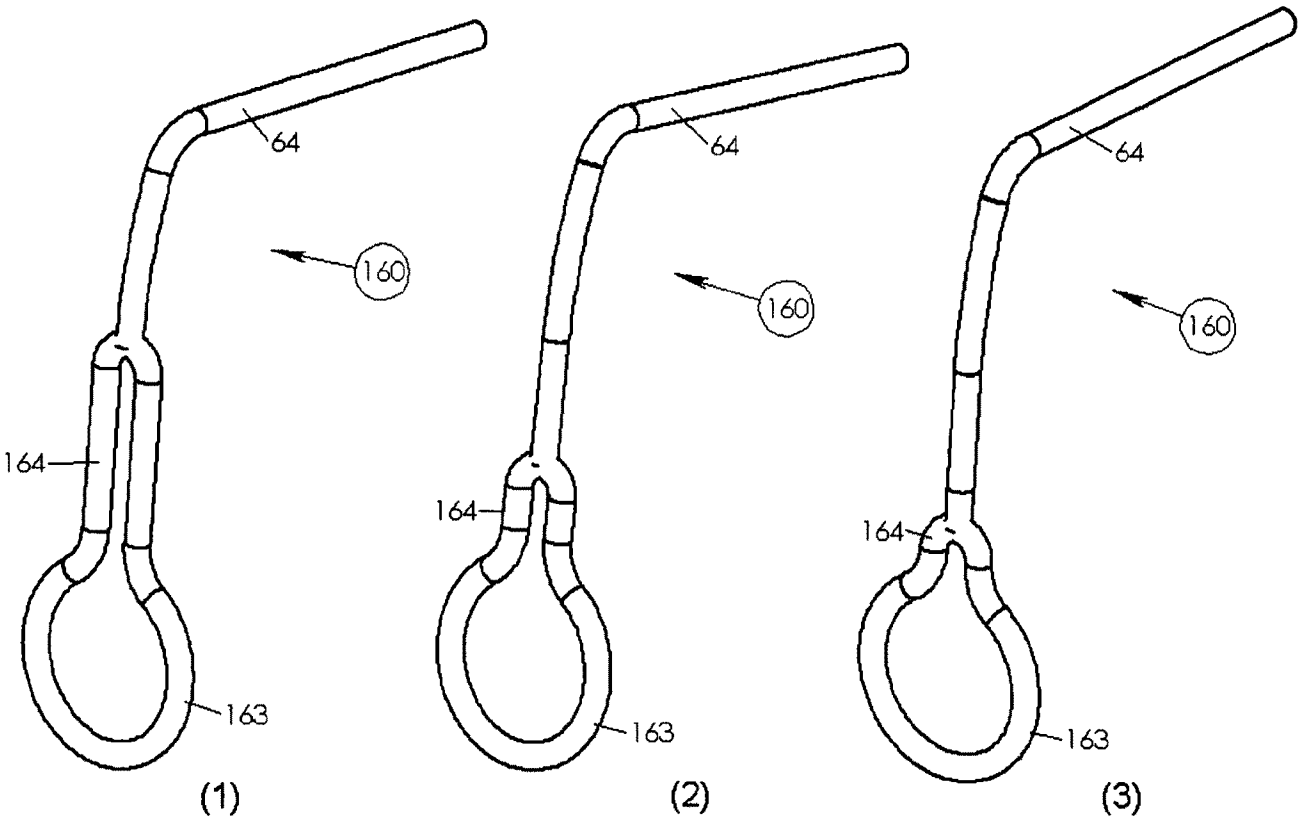
FIG. 18*e* provides schematic perspective views illustrating further possible variations (1), (2), and (3) of the continuous loop revolving arc and boom with roller assembly of FIG. 18*a*.
Figure 18F:
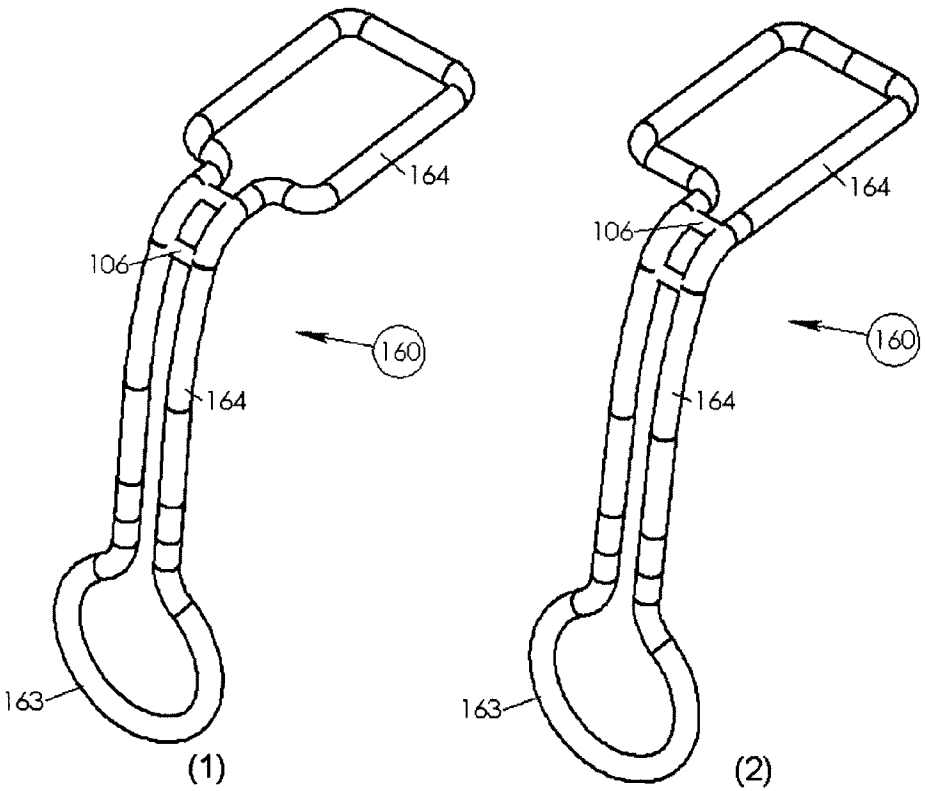
FIG. 18*f* provides schematic perspective views illustrating further possible distal configurations (1) and (2) for the continuous loop revolving arc and boom with roller assembly of FIG. 18*a*.

FIGS. 18*d-f*. show other possible continuous-loop revolving arc/boom structures 160 in which the projected loop of structural material/tubing from the open revolving arc 163 may constitute any portion of the length of the boom, and/or said projected loop of structural material may take any of a multitude of different shapes. The proportion of the boom that comprises the loop of structural material from the revolving arc 163 may be varied based on the structural demands of the specific embodiment. For example, in embodiments requiring greater structural strength, the loop may constitute the entire boom, whereas, in embodiments with lighter structural demands, it is advantageous to employ a lighter boom structure and smaller projected loop. As is illustrated, a single structural element 64 is employed to complete the length of the boom 164/64 in these embodiments.

The continuous-loop revolving arc/boom is an acentric structural element design, that is, the structural elements are offset from the radial 300 passing from the axis of revolution 205 to the overhead or drive assembly 11. This two-structural-element boom design provides significantly more stability to the overhead or drive assembly 11 than a single-element design. From an engineering perspective, this design increases structural strength and enables the use of much lighter structural materials. In addition, this acentric structural element design also provides space for drive components (i.e. pulleys, flexible linkages, gearing, shaft drives, etc.) which must be routed in the midline of conventional structural elements. Drilling, cutting, and/or punching material from structural elements (in order to position and mount drive components) weakens structural support. An acentric structural element boom design eliminates the need for material removal when routing midline drive components.

Figure 18G:
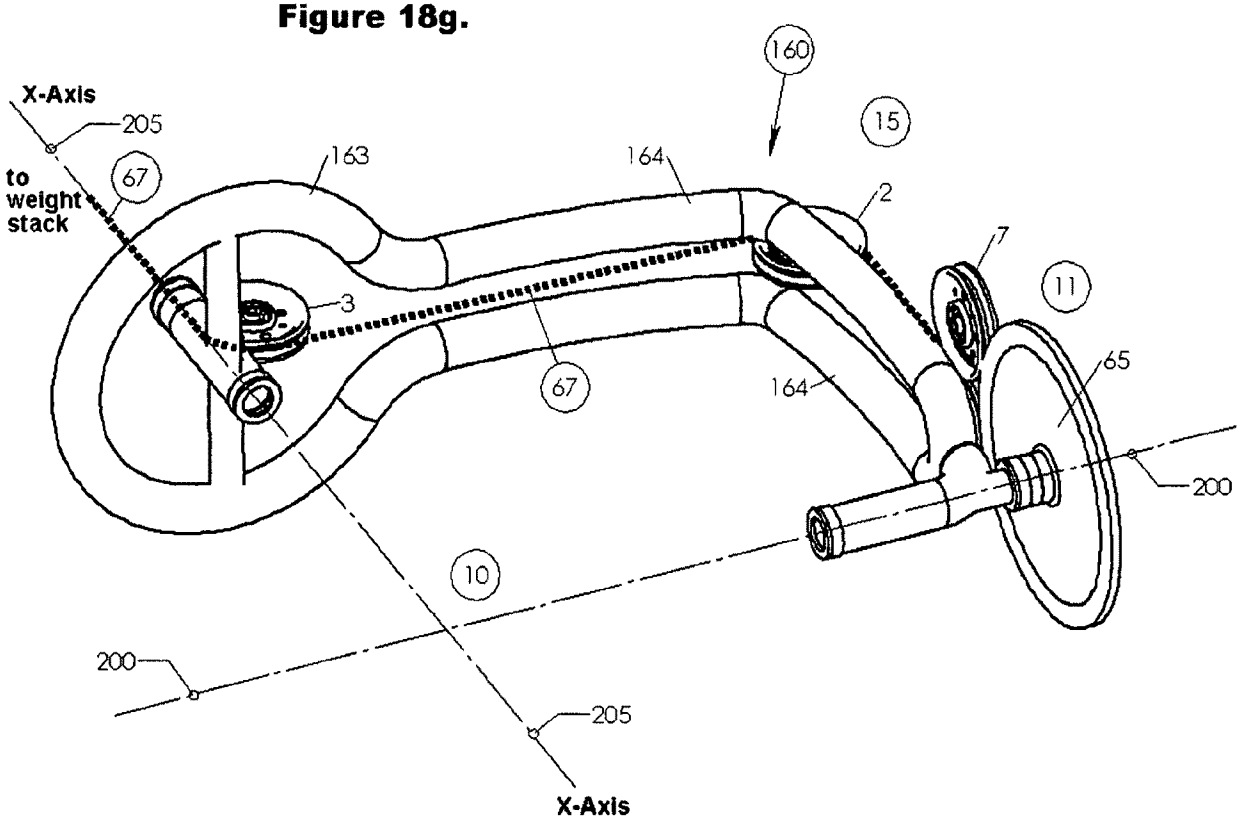
FIG. 18*g* provides a schematic perspective view illustrating the continuous loop revolving arc and boom with roller assembly of FIG. 18*a* applied with an X-axis boom.

The continuous-loop revolving arc/boom concept can be applied to enhance both wide and narrow revolving arc and boom structures. FIG. 18*g-h*. shows the continuous revolving arc/boom concept applied to a generic x-axis boom, and this concept may be applied to any embodiment of this invention.

19. Compact Revolving Arc Design—with Twin Unilateral Narrow Diameter Revolving Arcs FIG. 19*a-b*. shows a free flexible linkage device designed by a compact model. Notice that the narrow diameter revolving arcs 63*a*, 63*b* in this embodiment are parallel and concentric, and are supported by generally symmetric structural elements about the weight stack, resulting in a very compact and sturdy structural design. This is a narrow diameter revolving arc and radial boom structure built by the model of the x-axis and y-axis narrow revolving arc devices. Notice as well that this structure has polygonal bases of support at right angle to each other (i.e. a triangular base 150, and a decagonal base 155), providing maximal structural stability.

Figure 19A:
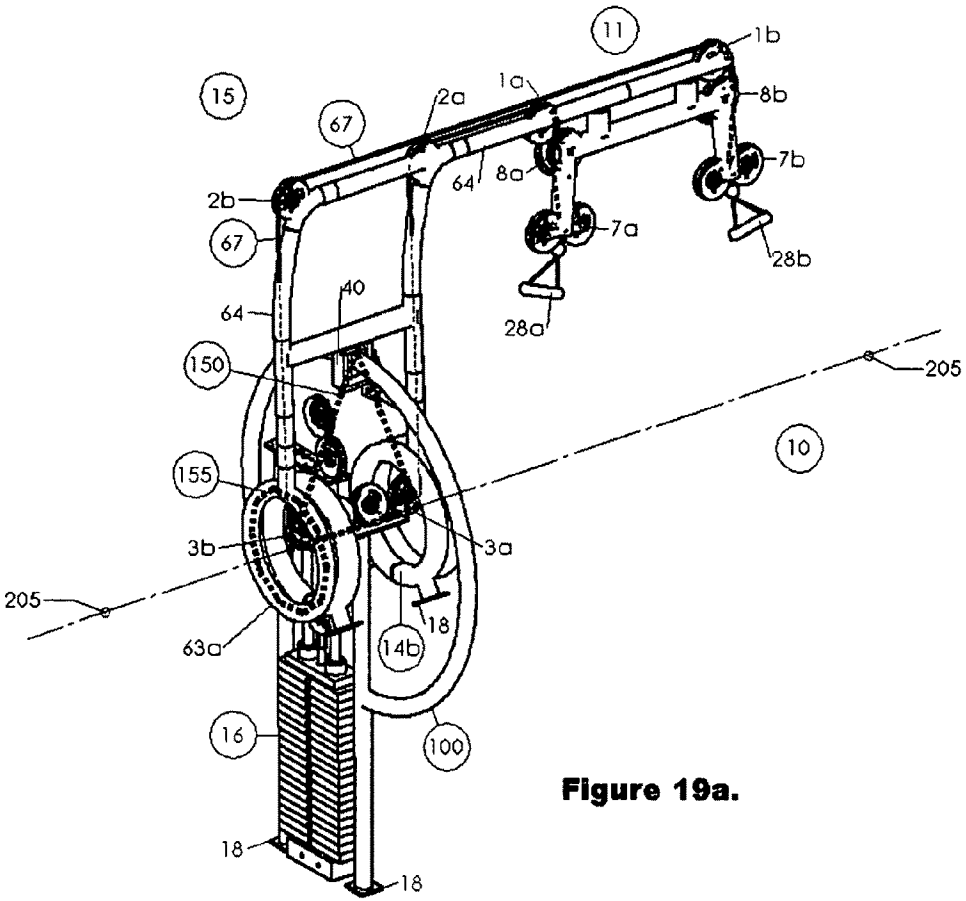
FIG. 19*a* provides a schematic perspective view illustrating a compact free flexible linkage multi-axis exercise embodiment of the present invention having twin unilateral narrow diameter revolving arcs.
Figure 19B:
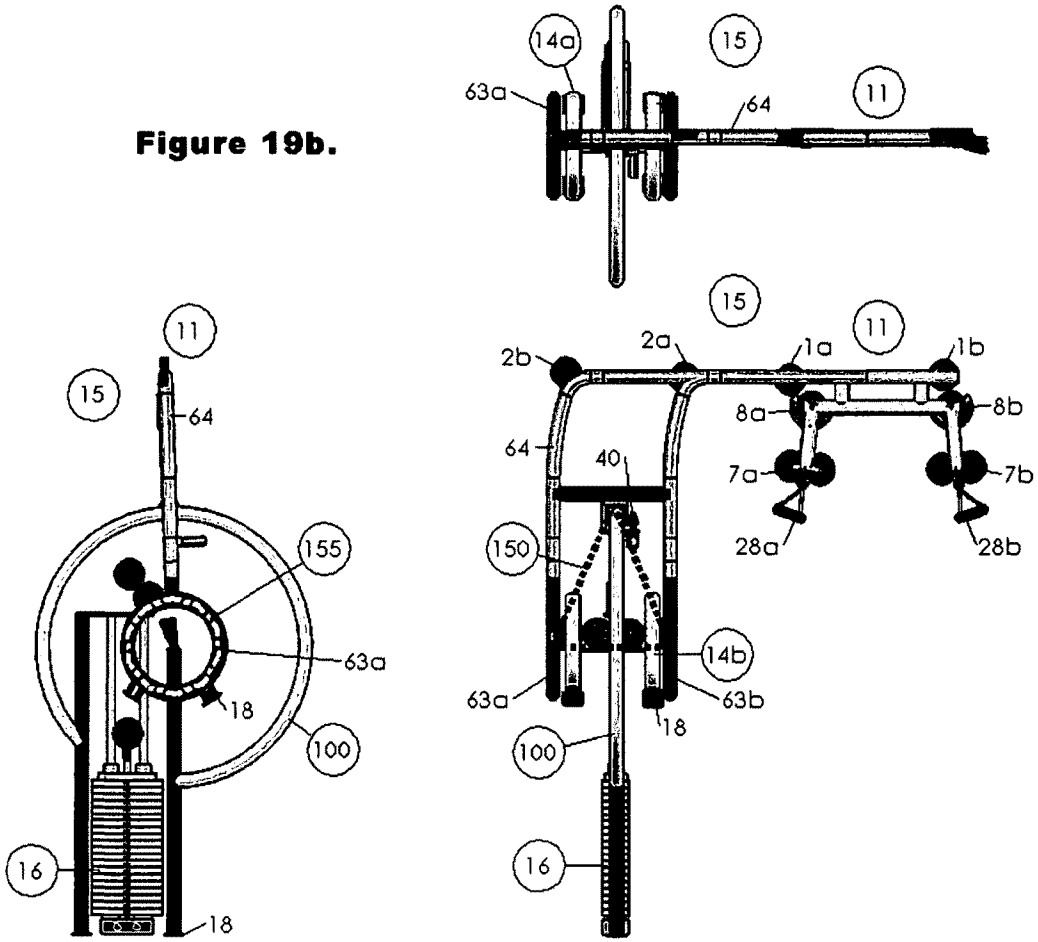
FIG. 19*b* provides (beginning in the lower left corner and proceeding clockwise) schematic side, top and frontal views further illustrating the compact free flexible linkage multi-axis exercise embodiment of FIG. 19*a*.
Figure 19C:
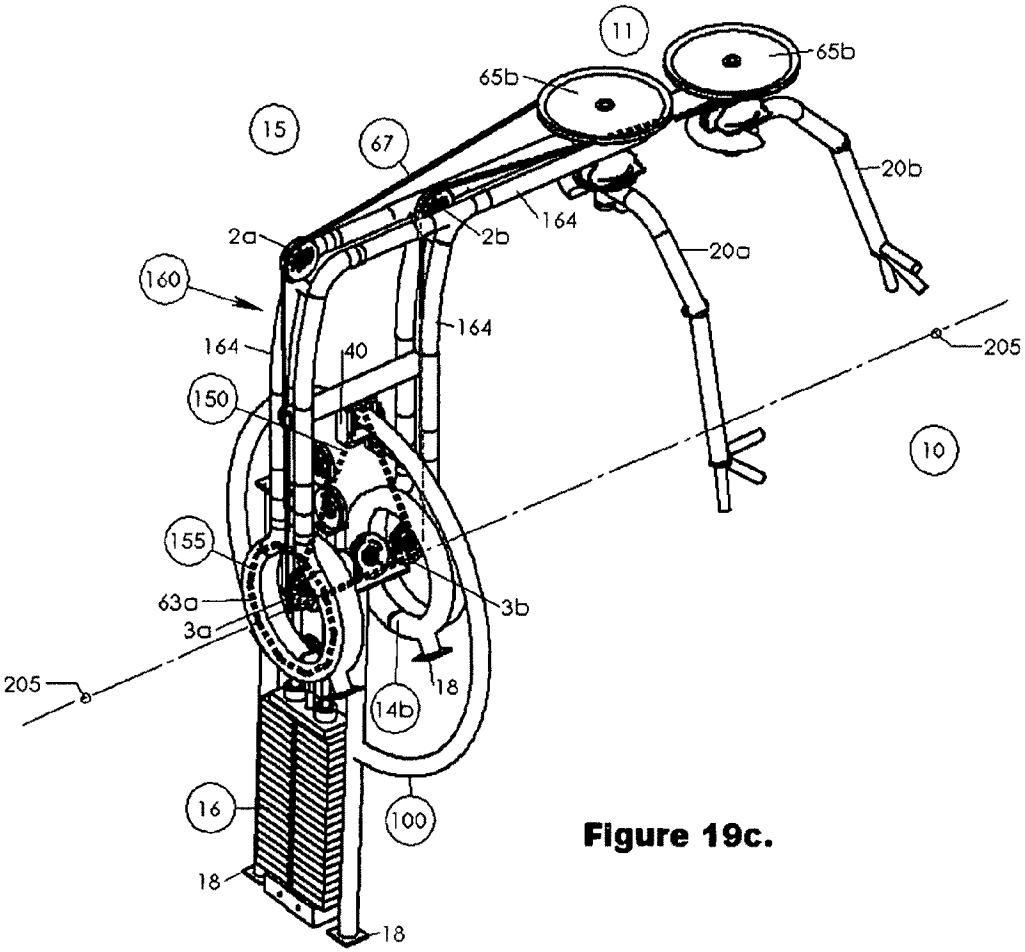
FIG. 19*c* provides a schematic perspective view illustrating a compact Z-axis/multi-axis exercise embodiment of the present invention having polygonal bases of support at right angles to each other.

The compact structural design can be strengthened by constructing the boom by the continuous-loop revolving arc/boom model, as in FIG. 19*c-d*. This is the acentric structural element design described previously. When compared to FIG. 19*a-b*, this four-structural-element radial boom design provides significantly more stability to the overhead or drive assembly 11 than single elements and it provides space for drive components (i.e. pulleys, flexible linkages, gearing, shaft drives, etc.) which must be routed in the midline of conventional structural elements, as discussed previously. Notice as well in FIG. 19*c-d* that this structure has polygonal bases of support at right angle to each other (i.e. a triangular base 150, and a decagonal base 155), providing maximal structural stability.

20. Telescoping Revolving Arc

Figure 20A:
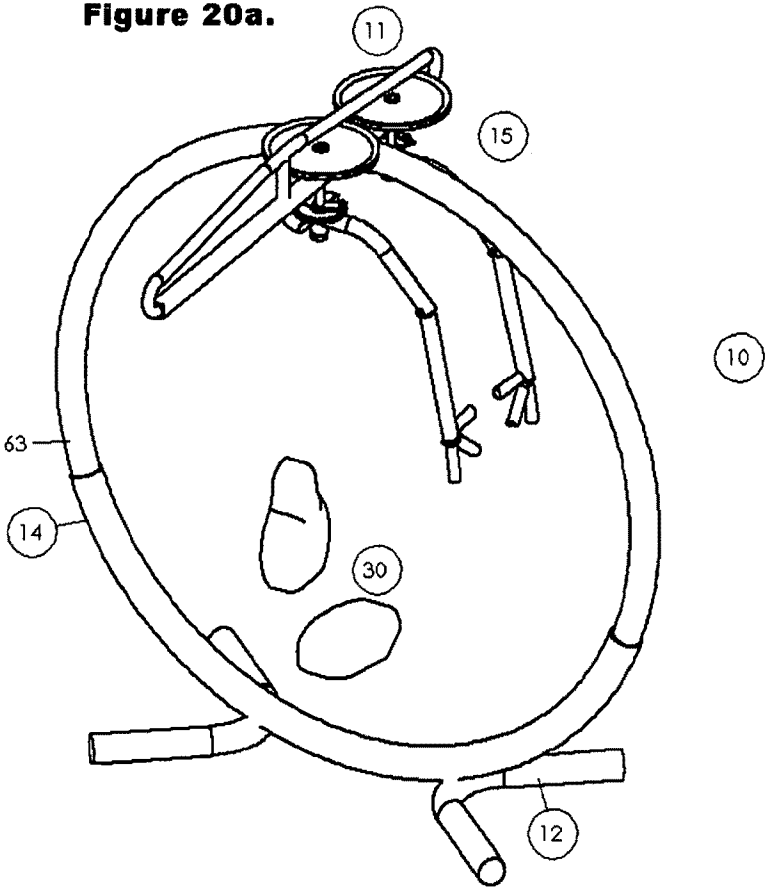
FIG. 20*a* provides a schematic perspective view illustrating an embodiment of the invention where a revolving arc structure is captured, supported and held in position (circular arc within circular tube) by a supporting arcuate tubular supporting element or guide.
Figure 20B:
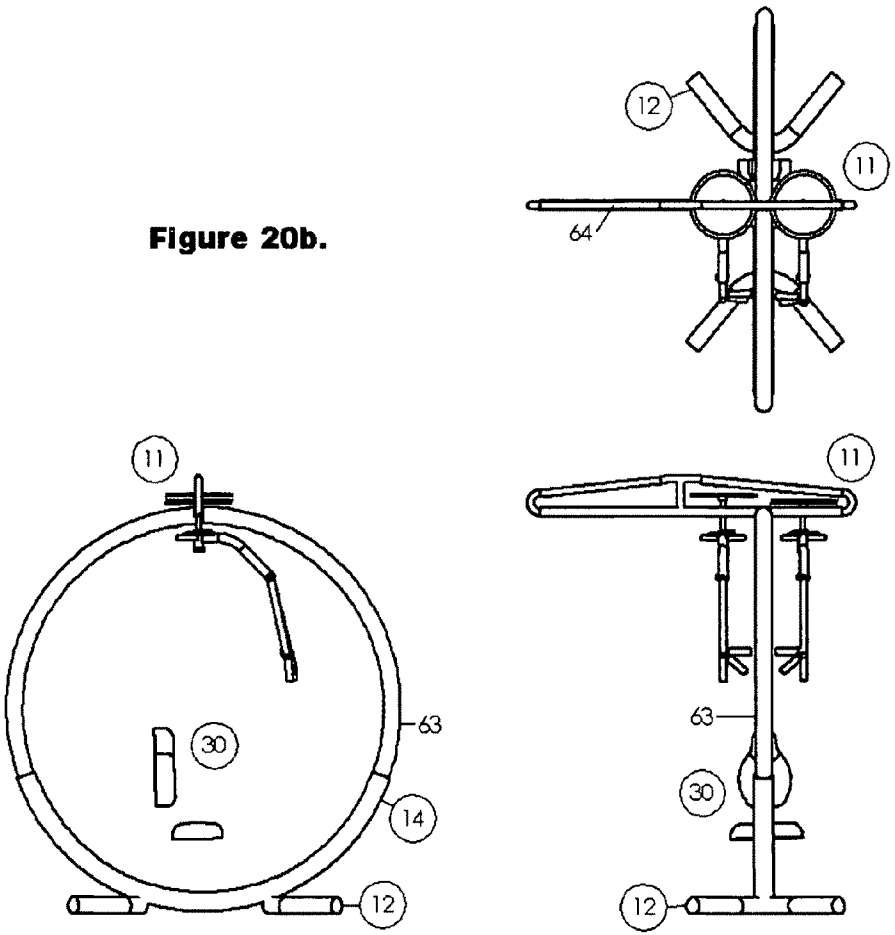
FIG. 20*b* provides (beginning in the lower left corner and proceeding clockwise) schematic side, top, and frontal views further illustrating the telescoping revolving arc exercise embodiment of FIG. 20*a*.

FIG. 20*a-b*. shows a revolving arc structure 63 that is captured by a substantial supporting element or arcuate guide 14, through which the revolving arc telescopes. This is a gliding/sliding type revolving mechanism which provides a true arcuate sliding surface for revolving motion of the revolving assembly 15, as described in Gautier 2008. A combination of sliding and previously described rolling mechanisms may also be employed for conveying the revolving arc 63.

21. Electromechanical Resistance Mechanism

Figure 21A:
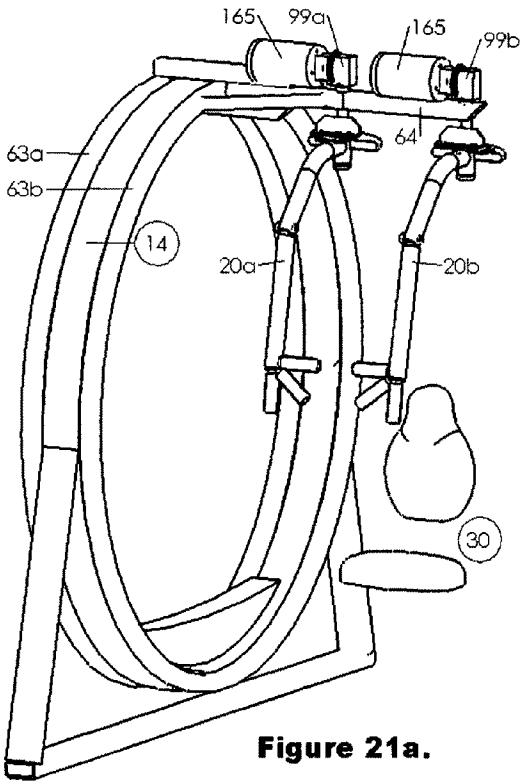
FIG. 21*a* provides a schematic perspective view illustrating a Z-axis/multi-axis exercise embodiment of the present invention utilizing independent electromechanical resistance.
Figure 21B:
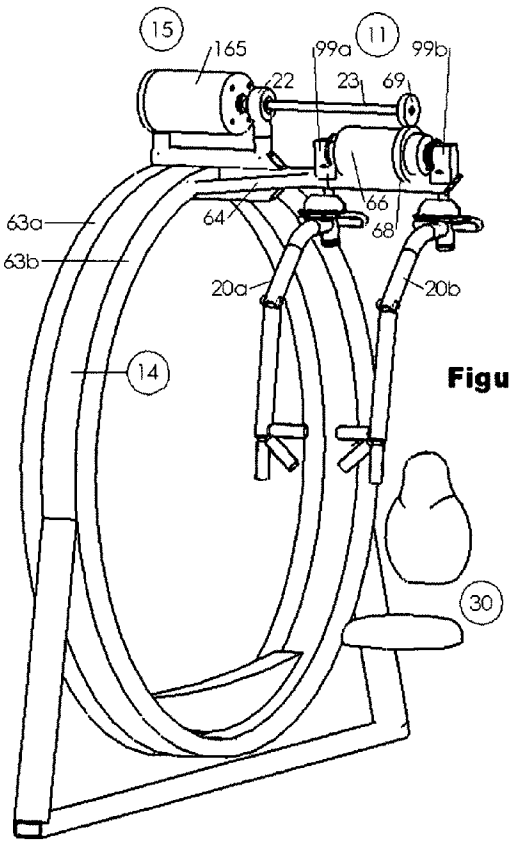
FIG. 21*b* provides a schematic perspective view illustrating a Z-axis/multi-axis exercise embodiment of the present invention utilizing electromechanical resistance with differential drive.
Figure 21C:
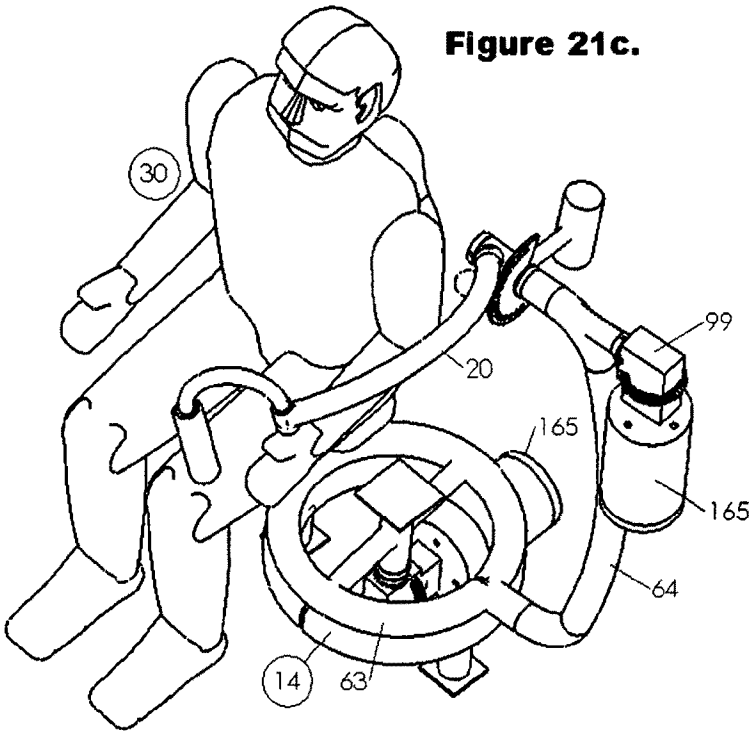
FIG. 21*c* provides a schematic perspective view illustrating a shoulder diagonal multi-axis exercise embodiment of the present invention utilizing electromechanical resistance.
Figure 21D:
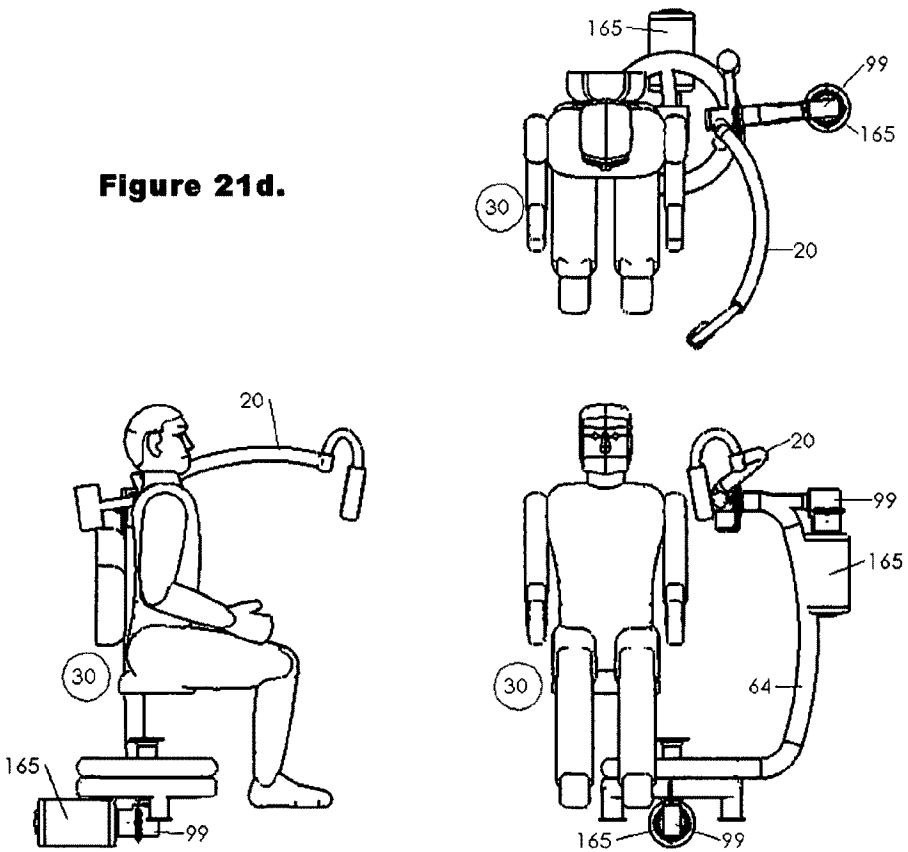
FIG. 21*d* provides (beginning in the lower left corner and proceeding clockwise) schematic side, top, and frontal views further illustrating the shoulder diagonal multi-axis exercise embodiment of FIG. 21*c*.

On devices previously described, an electromechanical mechanism can be employed anywhere a drive pulley is employed in the drive system. (All embodiments of the present invention can be built to utilize this resistance mechanism). This resistance mechanism lends itself to computerization and instrumentation. FIG. 21*a*. shows an example of an electromechanical resistance mechanism 165 employed on a z-axis device. This embodiment utilizes 2 independent electromechanical drives 165, as well as angle-gearing mechanisms 99*a*, 99*b* as described previously. FIG. 21*b*. Shows a z-axis device employing a differential drive 66, angle-gearing mechanisms 99*a*, 99*b*, and a single electromechanical drive 165. Compound, free cable, and other embodiments can also be built by this model. FIG. 21*c-d*. shows an example of an electromechanical resistance mechanism 165 employed on a shoulder diagonal multi-axis exercise device. Note that an electromechanical drive is employed on the revolving axis 205 of the device for resistance in a plane of motion perpendicular to the plane of motion and resistance provided by the user interface assembly 20. Y-axis, x-axis, and other embodiments can also be built by this model. Utilizing this design, complex planes and complex combinations of planes of motion can be produced, and/or replicated, and/or programmed for a given user for the purpose of fitness, performance enhancement, and/or injury prevention or injury rehabilitation.

22. Infinite Revolving Axes/Multi-Axis Exercise Device

Figure 22:
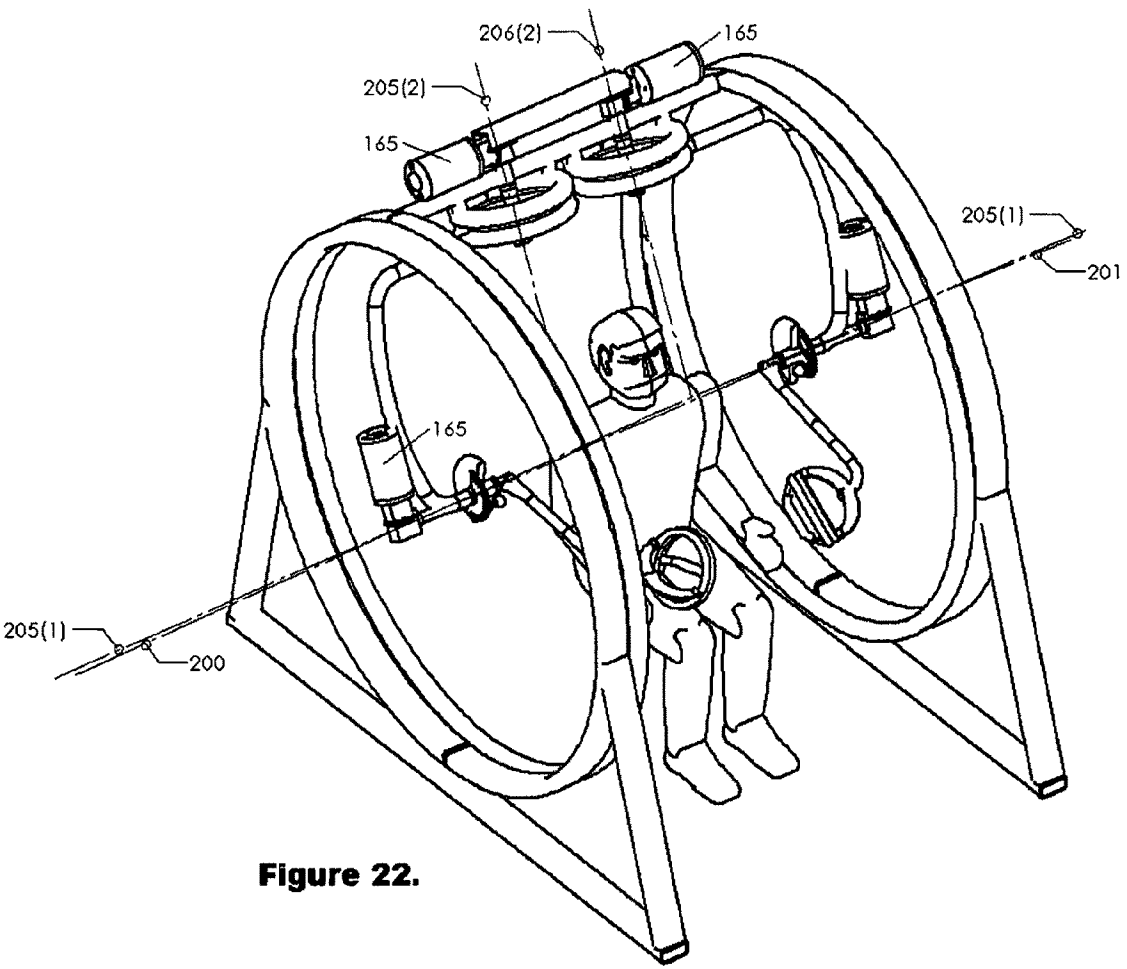
FIG. 22 provides a schematic perspective view illustrating an infinite revolving axis exercise embodiment of the present invention utilizing electromechanical resistance.

Whereas exercise devices previously described provide resisted motion in an infinite number of planes of exercise radial to only a single axis of shoulder motion, FIG. 22. shows an embodiment of the present invention that provides an infinite number of planes of exercise about any of an infinite number of axes of shoulder motion.

This infinite revolving axis functionality is provided by integration of the functionality of the narrow diameter revolving arc design and the wide diameter revolving arc design, each described in detail previously. Each revolving arc in this embodiment may operate independently of the others. This embodiment is illustrated employing an electromechanical resistance mechanism 165 (although other resistance mechanisms can be used, including a flexible linkage selectorized mechanism as in the preferred and other embodiments).

Figure 23A:
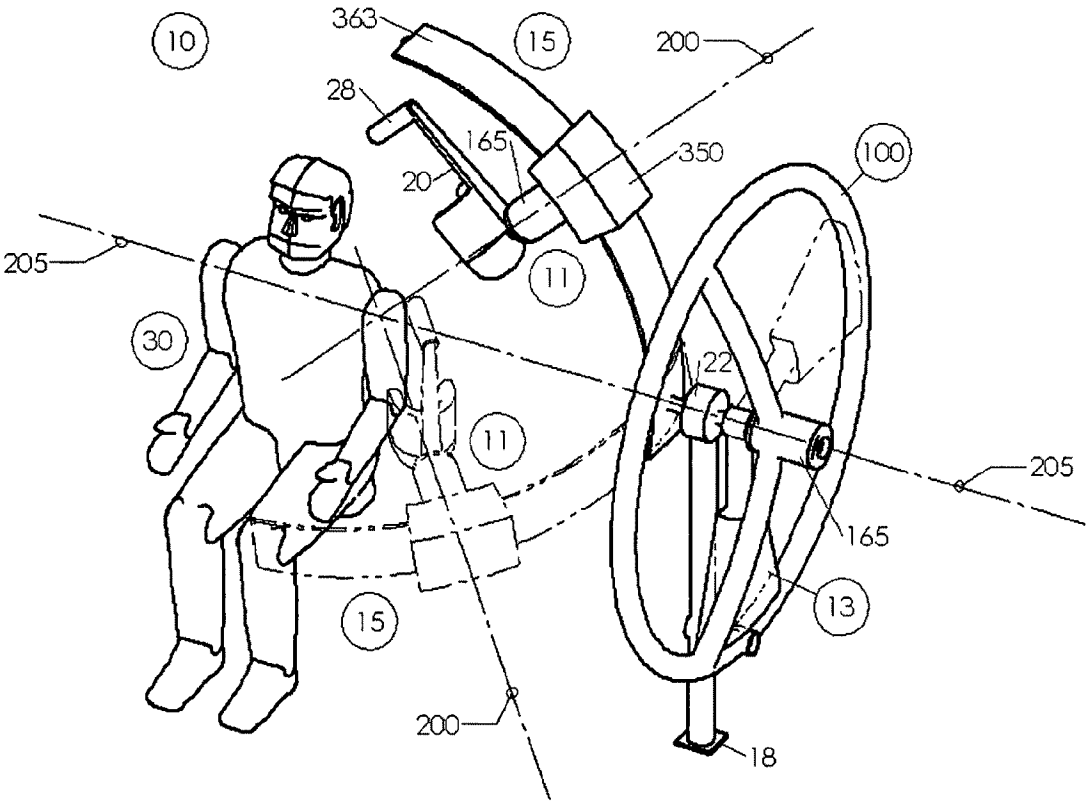
FIG. 23*a* provides a schematic perspective view illustrating another infinite revolving axis/multi-axis exercise embodiment of the present invention having a revolving arc that revolves on a line radial to the geometric arc of the revolving arc.
Figure 23B:
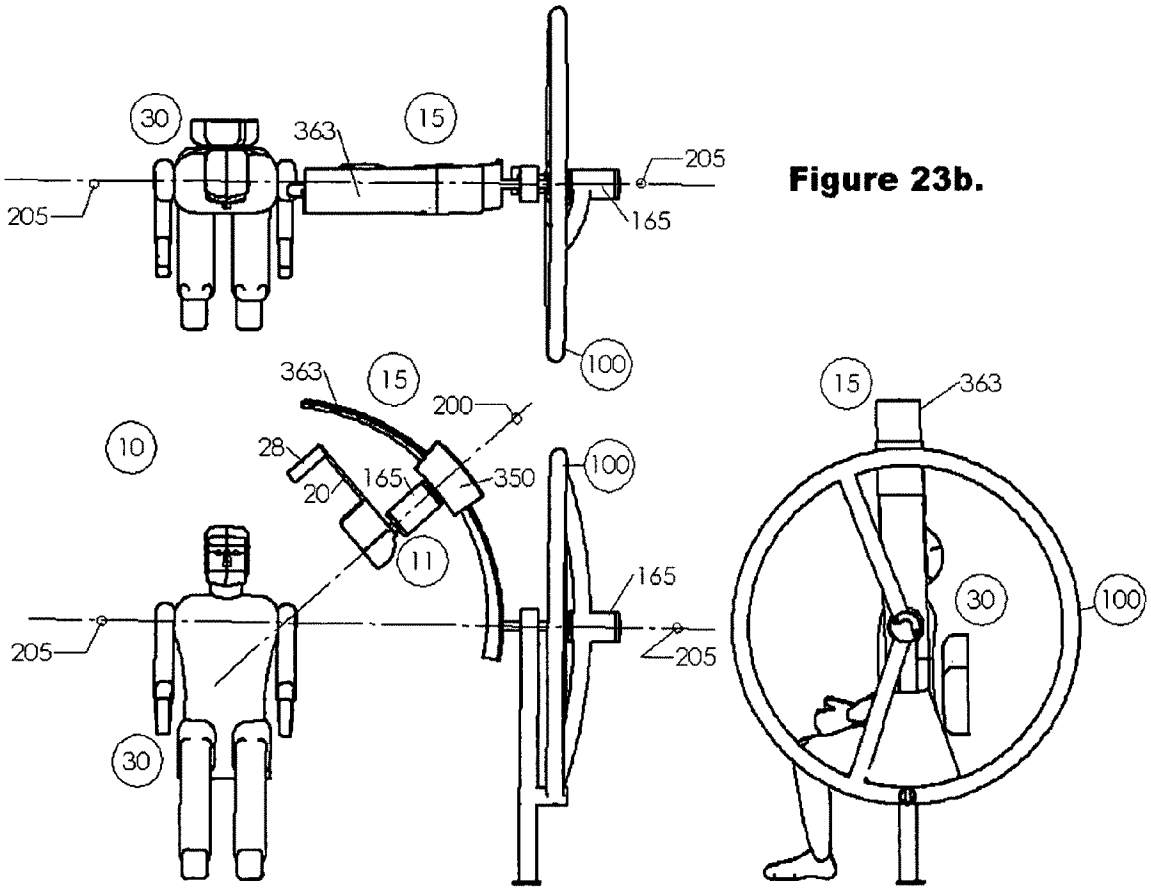
FIG. 23*b* provides (beginning in the lower left corner and proceeding clockwise) schematic frontal, top, and side views illustrating the infinite revolving axis/multi-axis exercise embodiment of FIG. 23*a*.
Figure 23C:
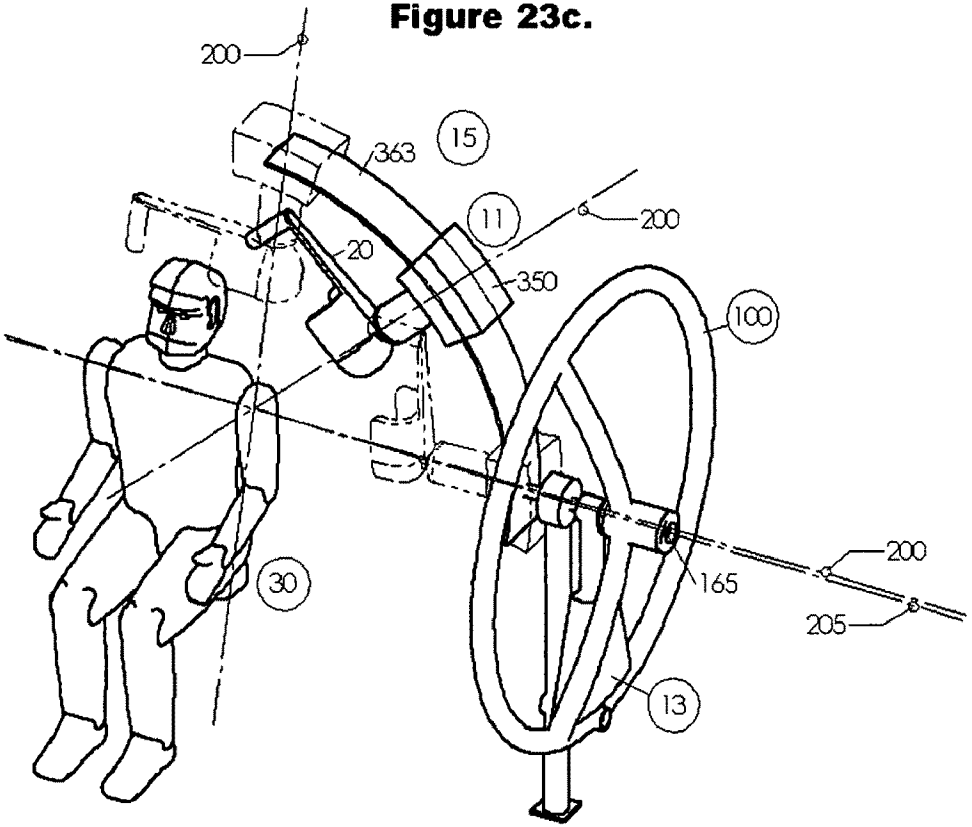
FIG. 23*c* provides a schematic perspective view illustrating the infinite revolving axis/multi-axis exercise embodiment of FIG. 23*a*, with further detail regarding the range of drive assembly crawler positions.

23. Radial Axis Revolving Arc—Infinite Revolving Axes/Multi-Axis Exercise Device A second infinite revolving axes/multi-axis exercise device embodiment is one that employs a revolving arc that revolves not on the center axis of the geometric arc of said revolving arc, but on a line radial to the geometric arc of said revolving arc. This revolving arc mechanism provides identical infinite radial axes of infinite radial planes of exercise to the embodiment above. FIG. 23*a-c*. shows a radial axis revolving arc embodiment. Note that the revolving arc pivots on a line that is collinear with a radial (i.e. the radius) of the geometric arc of said revolving arc.

24. Single Fixed Axis and Plane of Motion Devices

Each multi-axis machine described here can be used as a model for a group of strength training devices, each unit in each group providing a single fixed axis and plane of compound, x-axis, y-axis, z-axis, bicep/tricep, diagonal, rotational, or other infinite array of axes (radial, parallel, etc.) of joint motion. Each of these groups of devices is patentable separately from the multi-axis devices because:

1. each of these groups of devices specifically provides a novel group of planes of exercise (radial or parallel), that have not been available before;
2. these planes of exercise have not been available on devices employing the fulcrum-flexible-linkage, free-flexible-linkage, direct differential drive, or concentric shaft mechanisms;
3. these single fixed plane radial or parallel plane shoulder motion devices are designed by the same principles and constructed utilizing similar functional mechanisms as the multi-axis devices;
4. and the multiple planes of exercise provided by each group of single fixed plane devices (just as provided by each single multi-axis embodiment) are required to implement this novel multiple plane strength training method (i.e. multiple or infinite plane resistance exercise).

Thus, as the foregoing makes clear, my invention generally comprehends all exercise apparatus and systems where a user interface member has a point of attachment to the apparatus that is positionable at different locations along an arcuate path determined, dictated and/or supported/braced by an arcuate guide, as well as numerous additional and subsidiary exercise device concepts. In addition, and as the foregoing should also make clear, numerous additional variations can be made without exceeding the inventive concept. Moreover, various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the claims.

What is claimed is:

1. An apparatus for exercising muscles associated with a ball joint or ball joints of a human body, comprising:

a circular revolving arc defining a central axis of revolution, said circular revolving arc being substantially radially symmetrically arranged around said central axis;

a guide member circumferentially adjacent and supporting said circular revolving arc for revolution around said central axis;

a rigid user interface member for exercising a ball joint of a human body, said rigid user interface member depending from said circular revolving arc, which user interface member has a first end which is positionable at a plurality of points along an arcuate path centered on said central axis, and has a second end with a user interface;

apparatus providing adjustable resistance to movement of said user interface by a user; and wherein at least one of the central axis of said arcuate path intersects said ball joint, said guide member is an arcuate guide, said arcuate path and said guide member lie in spaced substantially parallel planes, and said user interface member comprises a rigid arm, a linkage is intermediate and forms part of an operative connection between said user interface and said apparatus providing adjustable resistance, said linkage being routed through a centering member proximate said central axis, and a linkage is intermediate and forms part of an operative connection between said user interface and said apparatus providing adjustable resistance, and said linkage is arranged and routed so as to maintain the same length when said user interface is repositioned along said arcuate path.

2. The apparatus for exercising muscles associated with a ball joint or ball joints of the human body of claim 1, wherein said guide member is an arcuate guide and one of: said arcuate guide comprises a complete circle, and said arcuate guide comprises a plurality of rotating support members adapted to rotatably support the revolving arc.

3. The apparatus for exercising muscles associated with a ball joint or ball joints of the human body of claim 1, wherein said linkage is a flexible linkage, said centering member is a pulley through which said flexible linkage is reeved, and said pulley at least one of:

lies in a plane that contains said central axis and has an axis of rotation perpendicular to said plane, has an axis of rotation parallel to the central axis, is a tangent pivot tension pulley, and is a fixed plane tension pulley.

4. The apparatus for exercising muscles associated with a ball joint or ball joints of the human body of claim 3, further comprising at least one other pulley through which said flexible linkage is reeved intermediate said pulley and said apparatus providing adjustable resistance, where said other pulley is one of a redirectioning pulley and a reserve pulley.

5. The apparatus for exercising muscles, associated with a ball joint of ball joints of the human body of claim 1, wherein said revolving arc is formed by an axially revolving ring.

6. The apparatus for exercising muscles associated with a ball joint or ball joints of the human body of claim 1, wherein at least one of:

adjustable resistance to movement of said other user interface by a user is provided by the same apparatus providing adjustable resistance to movement of the user interface by a user, adjustable resistance to movement of said other user interface by a user is provided by an other apparatus providing adjustable resistance to movement of the other user interface by a user, said other guide member is an other arcuate guide, said other arcuate path and said other guide member are substantially coplanar, and said other user interface member comprises an other rigid arm, an other central axis of said other arcuate path intersects said other ball joint, said other guide member is an other arcuate guide, said other arcuate path and said other guide member lie in spaced substantially parallel planes, and said other user interface member comprises one of an other rigid arm, and an other flexible member with an other free handle at its second end forming the other user interface, said other user interface member depends from an other revolving arc mounted to said other guide member, an other linkage is intermediate and forms part of an other operative connection between said other user interface and apparatus providing adjustable resistance, said other linkage being routed through an other centering member proximate said other central axis, and an other linkage is intermediate and forms part of an operative connection between said other user interface and apparatus providing adjustable resistance, and said other linkage is arranged and routed so as to maintain the same length when said other user interface is repositioned along said other arcuate path.

7. The apparatus for exercising muscles associated with a ball joint or ball joints of the human body of claim 1, wherein the user interface is a handle.

8. The apparatus for exercising muscles associated with a ball joint or ball joints of the human body of claim 7, wherein at least one of:

the handle is adapted for rotation around at least one of a first pivot axis, a second pivot axis transverse to the first pivot axis, and a third pivot axis transverse to the first and second pivot axes, and the handle is offset and arranged to avoid user contact with structural elements of the user interface and rotating handle.

9. The apparatus for exercising muscles associated with a ball joint or ball joints of the human body of claim 1, wherein said interface member is a rigid arm, which rigid arm is pivotably mounted to said apparatus for exercising muscles associated with a ball joint via its first end so as to define an axis of rotation for said interface member, which axis of rotation for said interface member one of intersects the ball joint, and is transverse to the central axis.

10. The apparatus for exercising muscles associated with a ball joint or ball joints of the human body of claim 1, wherein the central axis of said arcuate path intersects said ball joint and is coaxial with the z-axis of the shoulder joint.

11. An apparatus for exercising muscles associated with a ball joint or ball joints of the human body, comprising:

a circular revolving arc defining a central axis of revolution;

guide member circumferentially adjacent and supporting said circular revolving arc for revolution around said central axis;

a rigid user interface member for exercising a ball joint of a human body, said rigid user interface member depending from said circular revolving arc, which user interface member has a first end which is positionable at a plurality of points along an arcuate path centered on said central axis, and has a second end with a user interface;

apparatus providing adjustable resistance to movement of said user interface by a user;

wherein at least one of the central axis of said arcuate path intersects said ball joint, said guide member is an arcuate guide, said arcuate path and said guide member lie in spaced substantially parallel planes, and said user interface member comprises a rigid arm, a linkage is intermediate and forms part of an operative connection between said user interface and said apparatus providing adjustable resistance, said linkage being routed through a centering member proximate said central axis, and a linkage is intermediate and forms part of an operative connection between said user interface and said apparatus providing adjustable resistance, and said linkage is arranged and routed so as to maintain the same length when said user interface is repositioned along said arcuate path; and a drive assembly intermediate said revolving arc and said user interface member, said drive assembly including a boom member, with a portion of said boom member extending transversely of said arcuate path.

12. The apparatus for exercising muscles associated with a ball joint or ball joints of the human body of claim 11, further comprising a lateral stabilizer connected to one of said boom, and said revolving arc.

13. The apparatus for exercising muscles associated with a ball joint or ball joints of the human body of claim 12, wherein said lateral stabilizer is connected to said boom and at least one of:

said lateral stabilizer includes a parallel arcuate stabilizer guide centered on said central axis, which parallel arcuate stabilizer guide can be one of rotatable about said central axis and fixed, said lateral stabilizer includes a radial stabilizer member having an end connected to said boom and another end pivotably supported at and rotatable around said central axis, and said lateral stabilizer is formed as a radial extension of said boom.

14. The apparatus for exercising muscles associated with a ball joint or ball joints of the human body of claim 12, wherein said lateral stabilizer is connected to said revolving arc and includes one of:

a parallel arcuate stabilizer guide centered on said central axis, which parallel arcuate stabilizer guide can be one of rotatable about said central axis and fixed, and a radial stabilizer member having an end connected to said revolving arc and another end pivotably supported at and rotatable around said central axis.

15. The apparatus for exercising muscles associated with a ball joint or ball joints of the human body of claim 11, wherein said revolving arc is formed as part of a continuous loop, and wherein at least one of:

a portion of said continuous loop extends from said revolving arc to form a portion of said boom, and a portion of said continuous loop extends from said revolving arc to form a portion of said boom, with a central region of said boom being defined by the two sides of said loop forming said boom, and said linkage is routed through said central region.

16. An apparatus for exercising muscles associated with a ball joint or ball joints of the human body, comprising:

a circular revolving arc defining a central axis of revolution;

a guide member circumferentially adjacent and supporting said circular revolving arc for revolution around said central axis;

a rigid user interface member for exercising a ball joint of a human body, said rigid user interface member depending from said circular revolving arc, which user interface member has a first end which is positionable at a plurality of points along an arcuate path centered on said central axis, and has a second end with a user interface;

apparatus providing adjustable resistance to movement of said user interface by a user, wherein at least one of the central axis of said arcuate path intersects said ball joint, said guide member is an arcuate guide, said arcuate path and said guide member lie in spaced substantially parallel planes, and said user interface member comprises a rigid arm, a linkage is intermediate and forms part of an operative connection between said user interface and said apparatus providing adjustable resistance, said linkage being routed through a centering member proximate said central axis, and a linkage is intermediate and forms part of an operative connection between said user interface and said apparatus providing adjustable resistance, and said linkage is arranged and routed so as to maintain the same length when said user interface is repositioned along said arcuate path; and wherein the apparatus for exercising muscles associated with a ball joint of the human body further comprises a drive shaft intermediate and forming part of the linkage between said user interface and said apparatus providing adjustable resistance, and the apparatus providing adjustable resistance to movement of said user interface by a user includes a weight stack.

* * * * *